US007680433B2

(12) United States Patent
Saiki

(10) Patent No.: US 7,680,433 B2
(45) Date of Patent: Mar. 16, 2010

(54) PROCESS CARTRIDGE WITH CASINGS COMBINED BY COUPLING PIN, AND ASSEMBLING METHOD AND DISASSEMBLING METHOD THEREOF

(75) Inventor: Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 29 days.

(21) Appl. No.: 11/116,386

(22) Filed: Apr. 28, 2005

(65) Prior Publication Data

US 2006/0120755 A1 Jun. 8, 2006

(30) Foreign Application Priority Data

Dec. 8, 2004 (JP) ..... P.2004-354902
Dec. 8, 2004 (JP) ..... P.2004-354903

(51) Int. Cl.
*G03G 21/18* (2006.01)

(52) U.S. Cl. ..... 399/113

(58) Field of Classification Search ..... 399/113, 399/107

See application file for complete search history.

(56) References Cited

U.S. PATENT DOCUMENTS 6,070,029 A * 5/2000 Nishiuwatoko et al. ..... 399/111
6,327,448 B1 * 12/2001 Sasaki ..... 399/111
6,714,751 B2 3/2004 Higeta et al.
2002/0122674 A1 * 9/2002 Yokoi et al. ..... 399/113
2002/0131791 A1 * 9/2002 Yokoi et al. ..... 399/113
2005/0047828 A1 * 3/2005 Kawai ..... 399/126
2005/0271425 A1 * 12/2005 Shimomura et al. ..... 399/258

FOREIGN PATENT DOCUMENTS

JP 11-15354 A 1/1999
JP 2001-042753 A 2/2001
JP 2002108174 A * 4/2002
JP 2003195727 A * 7/2003

* cited by examiner

*Primary Examiner*—Quana M Grainger
(74) *Attorney, Agent, or Firm*—Sughrue Mion, PLLC

(57) ABSTRACT

A process cartridge includes an image carrier, a developing device, a first casing for supporting the image carrier, and a second casing for supporting the developing device. The first casing and the second casing are freely combined in a rotatable manner as coupling pins are inserted into first insertion holes formed in the first casing and a second insertion hole formed in the second casing. An engaging means, by which the coupling pin is press-fit into the first insertion hole, and the coupling pin is kept from being press-fit into the first casing and the second casing after being pre-fit, is disposed in at least one of the first casing and the second casing, and the coupling pin.

16 Claims, 48 Drawing Sheets

PROCESS CARTRIDGE WITH CASINGS COMBINED BY COUPLING PIN, AND ASSEMBLING METHOD AND DISASSEMBLING METHOD THEREOF

BACKGROUND OF THE INVENTION

1. Field of the Invention

The present invention relates to a process cartridge used in an image forming apparatus such as a printer, a copier or a facsimile, an assembling method, and a disassembling method thereof.

2. Background Art

Conventionally, an image forming apparatus using electrophotographic technology has adopted a process cartridge manner, in which a cartridge is formed by integrating an electrophotographic photosensitive body (the image carrier) and a process means that acts on the electrophotographic photosensitive body and the cartridge is detachable from the image forming apparatus.

In such a process cartridge, a first casing for supporting at least the electrophotographic photosensitive body, and a second casing for supporting at least the developing device are rotatably coupled by a coupling pin. At this time, in order to prevent the coupling pin from separating from the first casing and the second casing, the coupling pin is press-fit into at least one of the first casing and the second casing, and the coupling pin is attached to the first casing and the second casing in a press-fit manner.

In addition, in the process cartridge having the first casing and the second casing coupled by the coupling pin, in order to prevent the coupling pin from being pulled out by inadvertently a user, the coupling pin is press-fit into the first casing and the second casing, a cover for covering an end of the coupling pin is provided in an insertion hole for the coupling pin, and the cover is welded to conceal the coupling pin (for example, refer to JP-A-11-15354).

For example, however, as shown in FIG. 48, in case that the coupling pin 100 is attached to both sides of the first casing 102 and the second casing 104 in a press-fit manner, the pressure generates cracks 108 around three press-fit portions 106A, 106B, and 106C of the first casing 102 and the second casing 104, which causes problems that the first casing 102 and the second casing 104 are damaged, further an abnormal image occurs. Further, as shown in FIG. 48, one portion of the second casing 104 is inserted into two portions of the first casing 102. The same problems occur when the coupling pin is attached to one of the first casing and the second casing in a press-fit manner.

In addition, in case that the cover is welded so as to prevent the coupling pin from being pulled out inadvertently by a user, it becomes difficult to separate the coupling pin from the first casing and the second casing during recycling. This leads to a degraded efficiency of recycling.

SUMMARY OF THE INVENTION

In order to solve the problems, there is provided a process cartridge that is detachable from an image forming apparatus body, including an image carrier, a developing device, a first casing for supporting at least the image carrier, and a second casing for supporting at least the developing device. The first casing and the second casing are rotatably combined to each other such a manner that a coupling pin is inserted into first insertion holes formed in the first casing and a second insertion hole formed in the second casing. An engaging means for engaging the coupling pin with at least one of the first insertion holes and the second insertion hole by press-fitting is disposed in at least one of the first casing and the second casing, and the coupling pin. The coupling pin is thereby engaged with at least one of the first casing and the second casing after being inserted into the first insertion hole formed in the first casing and the second insertion hole formed in the second casing. Since the coupling pin is not engaged with the first casing and the second casing in a press-fit manner, no load is applied to the first casing and the second casing. Therefore, abnormalities such as crack do not occur.

The engaging means preferably has a convex portion disposed in the coupling pin, and a concave portion disposed in at least one of the first casing and the second casing. The engaging means preferably has a concave portion disposed in the coupling pin, and a convex portion disposed in at least one of the first casing and the second casing.

At least a portion of the coupling pin is preferably hollow in its axial direction. It causes the coupling pin to be easily extracted from the first casing and the second casing in such a manner that the jig is engaged with the coupling pin, and the coupling pin is then extracted during recycling, etc. It is thus possible to increase the efficiency of recycling. Furthermore, the coupling pin cannot be extracted from the first casing and the second casing without using the jig. This prevents the possibility that the first casing and the second casing can be separated from each other when a user extracts the coupling pin inadvertently. Moreover, since the wall is disposed at a portion of the hollow portion of the coupling pin in its axial direction or at the front end in the insertion direction, the partially hollow coupling pin is stronger compared to a coupling pin that is hollow in its entire length.

An extraction hole for extracting the coupling pin is preferably formed in a portion of the coupling pin. It causes the coupling pin to be easily extracted from the first casing and the second casing, by extracting the coupling pin with the jig being engaged with the extraction hole, during recycling, etc. It is thus possible to increase the efficiency of recycling. Furthermore, the coupling pin can be extracted form the first casing and/or the second casing only using the jig. This prevents the possibility that the first casing and the second casing can be separated from each other when a user extracts the coupling pin inadvertently.

A notch groove for extracting the coupling pin is preferably formed at a front end of the coupling pin in an insertion direction. By extracting the coupling pin with the jig being engaged with the notch groove formed in the insertion direction front end of the coupling pin, the coupling pin can be easily extracted from the first casing and the second casing, during recycling, etc. It is thus possible to increase the efficiency of recycling. Furthermore, the coupling pin can be extracted form the first casing and the second casing only using the jig. This prevents the possibility that the first casing and the second casing can be separated from each other when a user extracts the coupling pin inadvertently.

Preferably, in the process cartridge, a core is slightly press-fit into a hollow portion of the coupling pin, which can increase the strength of the coupling pin that is weak and breakable in the hollow state. At this time, since the core serves to enhance the strength of the coupling pin, it can be attached to the coupling pin in a state slightly being press-fit. A load against the coupling pin is low, thus there is no possibility that the coupling pin can be damaged. Further, it is possible to separate the coupling pin from the first casing and the second casing by extracting the coupling pin from the jig after the core is separated from the coupling pin.

According to a second aspect of the present invention, there is provided a method of assembling a process cartridge that is detachable from an image forming apparatus body. A first casing supporting at least an image carrier and a second casing supporting at least a developing device are combined together by engaging a coupling pin with at least one of the first casing and the second casing by press-fitting. The first casing and the second casing are combined together in a state where the coupling pin is engaged with at least one of the first casing and the second casing by press-fitting the coupling pin by snap fitting. After being inserted into the first insertion hole formed in the first casing and the second insertion hole formed in the second casing, the coupling pin is engaged with at least one of the first casing and the second casing without being press-fitted thereto. As such, since any load is not applied to the first casing and the second casing, abnormalities such as crack do not occur.

According to a third aspect of the present invention, there is provided a method of disassembling a process cartridge that is detachable from an image forming apparatus body, wherein a first casing for supporting at least an image carrier and a second casing for supporting at least a developing device, which are combined together by engaging a coupling pin that is partially hollow in its axial direction by way of a press fit, are separated from each other in such a manner that a jig having a protrusion portion is inserted into the hollow portion of the coupling pin, and the coupling pin is extracted by latching the protrusion portion of the jig to the coupling pin. The coupling pin can be easily extracted from the first casing and the second casing by extracting the coupling pin using the jig during recycling, etc. It is thus possible to increase the efficiency of recycling. Further, the coupling pin can be extracted form the first casing and the second casing only using the jig. This prevents the possibility that the first casing and the second casing can be separated from each other when a user extracts the coupling pin inadvertently.

According to a fourth aspect of the invention, there is provided a process cartridge that is detachable from an image forming apparatus body, including an image carrier, a developing device, a first casing for supporting at least the image carrier, and a second casing for supporting at least the developing device. The first casing and the second casing are rotatably coupled as a coupling pin is inserted into first insertion holes formed in the first casing and a second insertion hole formed in the second casing. An engaging means for engaging the coupling pin with at least one of the first insertion holes and the second insertion hole by press-fitting is further disposed in at least one of the first casing and the second casing, and to the coupling pin. The coupling pin has a head portion capable of being cut off. Therefore, after being inserted into the first insertion holes formed in the first casing and the second insertion hole formed in the second casing, the coupling pin is engaged with at least one of the first casing and the second casing without being press-fit into them. Accordingly, since no load is applied to the first casing and the second casing, abnormalities such as crack do not occur. Further, the coupling pin is disposed in such a way that the head portion is cut off therefrom. Thus, when the process cartridge is used, the inside of the coupling pin cannot be viewed through the head portion and the coupling pin cannot be thus separated. Thus, it is possible to prevent the coupling pin from being mistakenly extracted by a user. Moreover, in the case that the coupling pin is separated from the first casing and the second casing during recycling, it can be easily separated from them by cutting off the head portion of the coupling pin and then pulling out the coupling pin using a tool.

Preferably, in the process cartridge of the present invention, the engaging means has a convex portion disposed in the coupling pin, and a concave portion disposed in at least one of the first casing and the second casing. The engaging means preferably has a concave portion disposed in the coupling pin, and a convex portion disposed in at least one of the first casing and the second casing.

Preferably, in the process cartridge of the present invention, the coupling pin includes a coupling pin body extending in an axial direction, the head portion, and connection for connecting the coupling pin body and the head portion. The head portion is formed capable of being cut off from the coupling pin body with the connection disposed therebetween. In this way, the head portion of the coupling pin can be easily screw-cut from the coupling pint body with the connection interposed therebetween.

Preferably, in the process cartridge of the present invention, at least a portion of the coupling pin is hollow, and the tool can be inserted into the coupling pin body. Thereby, the coupling pin can be easily separated from the first casing and the second casing, during recycling, etc., in such a manner that the tool is inserted into a hollow portion of the coupling pin body, the tool is engaged with the coupling pin body, and the coupling pin is then pulled out. Thus, it is possible to enhance the efficiency of recycling. Furthermore, the coupling pin cannot be separated from the first casing and the second casing without using the tool. This prevents the first casing and the second casing from being separated from each other in the case that the coupling pin is mistakenly pulled out by a user.

Preferably, in the process cartridge of the present invention, an extraction hole for extracting the coupling pin is formed in a portion of the coupling pin. It causes the coupling pin to be easily separated from the first casing and the second casing, during recycling, etc., by engaging the tool with the extraction hole and then pulling out the coupling pin. It is thus possible to increase the efficiency of recycling. The coupling pin can not be separated from the first casing and the second casing without using the tool. This prevents the first casing and the second casing from being separated from each other when a user mistakenly pulls out the coupling pin.

Preferably, in the process cartridge of the present invention, a notch groove for extracting the coupling pin is formed at a front end portion of the coupling pin in its insertion direction. Therefore, the coupling pin can be easily separated from the first casing and the second casing, during recycling, etc. by engaging the tool with the notch groove formed at the front end portion of the coupling pin in its insertion direction and then pulling out the coupling pin. It is thus possible to increase the efficiency of recycling. The coupling pin can not be separated from the first casing and the second casing without using the tool. This prevents the first casing and the second casing from being separated from each other when a user mistakenly pulls out the coupling pin.

Preferably, in the process cartridge of the present invention, the coupling pin includes a pair of protrusions. Anti-rotation portions, for hindering the coupling pin from rotating as the protrusion abuts the first casing or the second casing, is disposed. In this way, in a state where the coupling pin is hindered from rotating, the head portion of the coupling pin can be rotatably screw-cut in a convenient manner using a plus driver, a minus driver or other tools.

Preferably, in the process cartridge of the present invention, a tool engagement groove for rotating the head portion is disposed at the head portion of the coupling pin. In this way, the head portion of the coupling pin can be rotatably screw-cut in a convenient manner by applying a plus driver, a minus driver or other tools to the tool engagement groove.

According to a fifth aspect of the invention, there is provided a method of disassembling a process cartridge that is detachable from an image forming apparatus body. In this case, a first casing for supporting at least an image carrier and a second casing for supporting at least a developing device, which are coupled together by engaging after press-fitting a coupling pin in which a head portion can be cut off from a coupling pin body that is partially hollow in its axial direction, are separated from each other in such a manner that a tool having a hook portion is inserted into the hollow portion of the coupling pin body, and the coupling pin body is pulled out by being engaged with the hook portion of the tool. By doing so, the first casing and the second casing are coupled together with the coupling pin being engaged with at least one of the first casing and the second casing by engaging after press fitting the coupling pin, that is, by snap fitting. Therefore, after being inserted into the first insertion holes formed in the first casing and the second insertion hole formed in the second casing, the coupling pin is engaged with at least one of the first casing and the second casing without being press-fit into them. Accordingly, since no load is applied to the first casing and the second casing, abnormalities such as crack do not occur.

According to a sixth aspect of the invention, there is provided a method of disassembling a process cartridge that is detachable from an image forming apparatus body. In this case, a first casing for supporting at least an image carrier and a second casing for supporting at least a developing device, which are coupled together by engaging after press-fitting a coupling pin in which a head portion can be cut off from a coupling pin body that is partially hollow in its axial direction, are separated from each other in such a manner that a tool having a hook portion is inserted into the hollow portion of the coupling pin body, and the coupling pin body is pulled out by being engaged with the hook portion of the tool. By doing so, when the process cartridge is used, the inside of the coupling pin cannot be viewed through the head portion, thus the coupling pin cannot be separated. It is thus possible to prevent the coupling pin from being mistakenly separated from the first casing and the second casing by a user. Moreover, in the case that the coupling pin is separated from the first casing and the second casing during recycling, it can be easily separated from the first casing and the second casing by extracting the coupling pin with the tool after cutting off the head portion of the coupling pin from the coupling pin body.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

First Embodiment

Hereinafter, a preferred embodiment of the present invention will now be described with reference to accompanying drawings.

Figure 1:
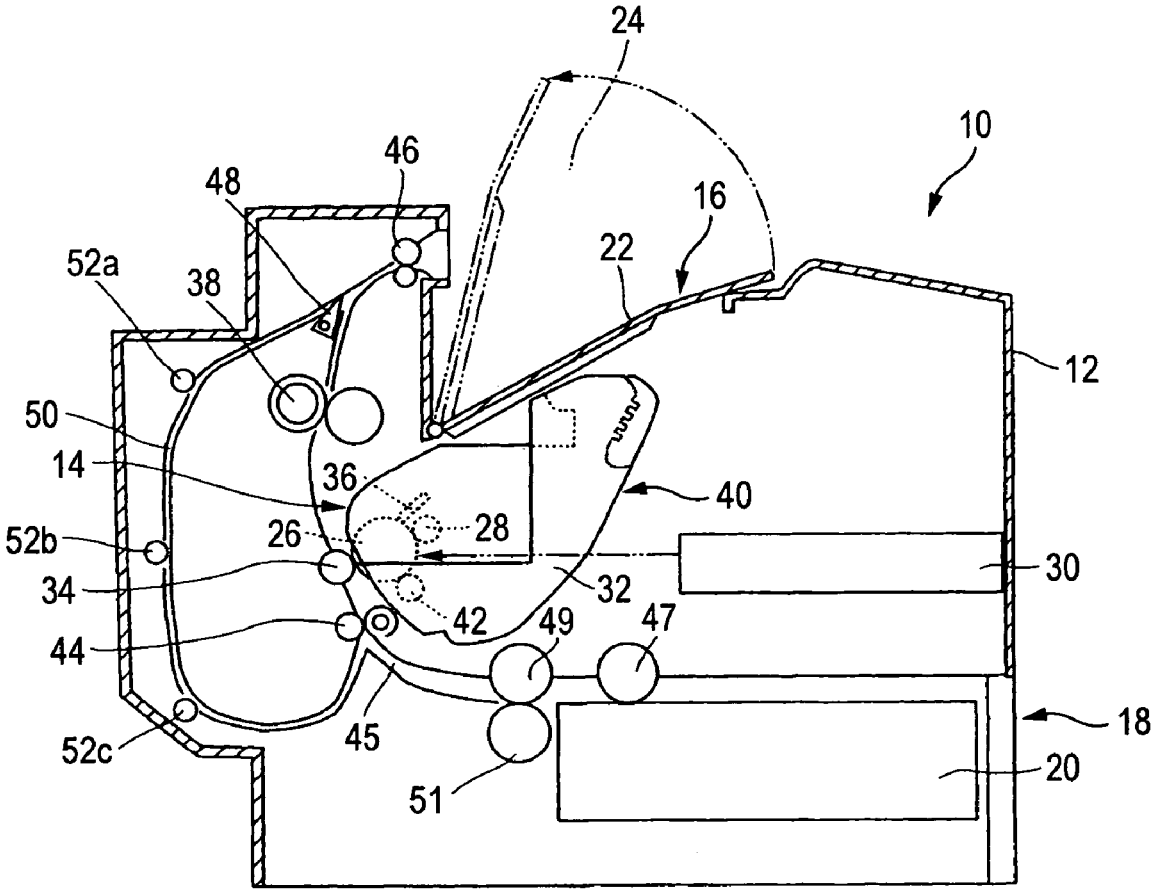
FIG. 1 is a cross-sectional view of an image forming apparatus according to an embodiment of the present invention.

FIG. 1 shows the outline of an image forming apparatus 10 according to the embodiment of the present invention. The image forming apparatus 10 includes an image forming apparatus body 12. An image forming means 14 is mounted in the image forming apparatus body 12. A discharging part 16 is disposed on the top of the image forming apparatus body 12. A paper feeding device 18 is disposed at a lower part of the image forming apparatus body 12.

The discharging part 16 has an inclined portion 22 which is rotatable around the image forming apparatus body 12. The inclined portion 22 whose outlet side is lower ascends gradually toward the front face (the right direction of FIG. 1). The inclined portion 22 has the outlet side as its bottom end, and the elevated front end as its top end. The inclined portion 22 is supported by the image forming apparatus body 12 in such a way to be rotatable around the bottom end. As indicated by a tow-dot chain line in FIG. 1, when the inclined portion 22 rotates upward and opens, an opening portion 24 is formed. A process cartridge 40 which will be described later can be attached or detached through the opening portion 24.

Since the image forming means 14 uses, for example, the electrophotographic mode, the image forming means 14 includes an image carrier 26 composed of a photoreceptor, a charging device 28, for example, composed a charging roll for uniformly charging the image carrier 26, an optical recording device 30 for writing a latent image on the image carrier 26 charged by the charging device 28 by a means of light, a developing device 32 for visualizing the latent image formed on the image carrier 26 by the optical recording device 30 by using a developing agent, a transfer device 34 composed of, for example, a transfer roll for transferring the developing agent image by the developing device 32 onto a sheet, a cleaning device 36 composed of, for example, a blade for cleaning the developing agent remaining on the image carrier 26, and a fixing device 38 composed of, for example, a pressuring roll and a heating roll for fixing an unfixed developing agent image transferred on a paper by the transfer device 34 on the paper. The optical recording device 30 can include a laser exposure device of, for example, a scanning type, and is disposed near the front face (the right side of FIG. 1) of the image forming apparatus body 12 parallel to a paper feed cassette 20 of the paper feeding device 18. The optical recording device 30 exposes the image carrier 26 to the light after crossing the inside of the developing device 32. The developing device 32 further includes a developing roll 42 disposed opposite to the image carrier 26.

The process cartridge 40 is constructed by integrating the image carrier 26, the charging device 28, the developing device 32 and the cleaning device 36 therein. The process cartridge 40 further includes a first casing 37 for supporting the image carrier 26, the charging device 28 and the cleaning device 36, and a second casing 39 for supporting the developing device 32 (refer to FIGS. 2A and 2B). The process cartridge 40 is disposed immediately under the inclined portion 22 of the discharging part 16. As described above the process cartridge 40 is also detachable through the opening portion 24, which is formed when the inclined portion 22 is opened.

Furthermore, in the image forming apparatus body 12, for example, a register roll 44 is disposed upstream of the transfer device 34 (the downward side of FIG. 1). The paper conveyed to a conveying path 45 via a feed roll 49 and a retard roll 51 after being picked up by a pick-up roll 47 from the paper feed cassette 20 of the paper feeding device 18 is temporarily stopped by the register roll 44, and then is sent to the image forming means 14 at a predetermined timing, so that an image is formed. Then, the paper is discharged toward the discharging part 16 by a discharging roll 46.

In case of double side printing, the paper is sent back to a reverse path 50. That is, this side of the discharging roll 46 is bisected, and a switching claw 48 is disposed at the bisected portion. There is also formed the reverse path 50 that returns from the bisected portion to the register roll 44. Conveying rolls 52*a* to 52*c* are located along the reverse path 50. In case of double side printing, the switching claw 48 is switched toward a side where the reverse path 50 is opened. The discharging roll 46 starts reversing at the time when the paper is latched immediately before the rear end of the discharging roll 46. Then, the paper is guided into the reverse path 50, passes through the register roll 44 and between the transfer device 34 and the image carrier 26, and through the fixing device 38, and then is discharged toward the discharging part 16.

The process cartridge 40 according to an embodiment of the present invention will now be described with reference to the accompanying drawings.

Figure 2A:
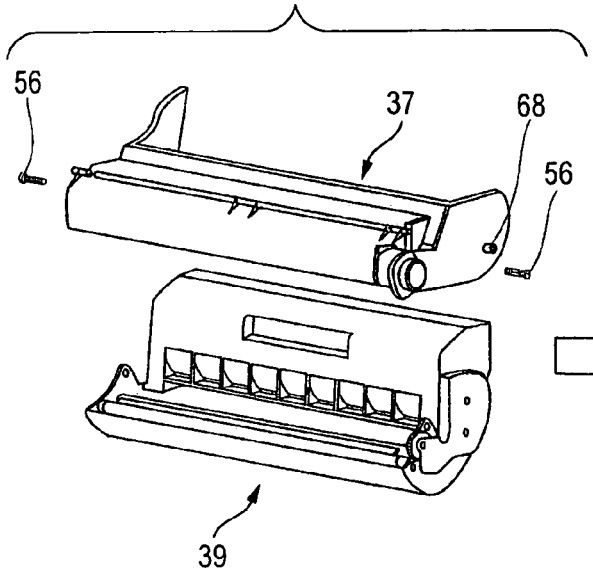
FIGS. 2A and 2B are front perspective views showing the outline of a process cartridge according to an embodiment of the present invention.
Figure 2B:
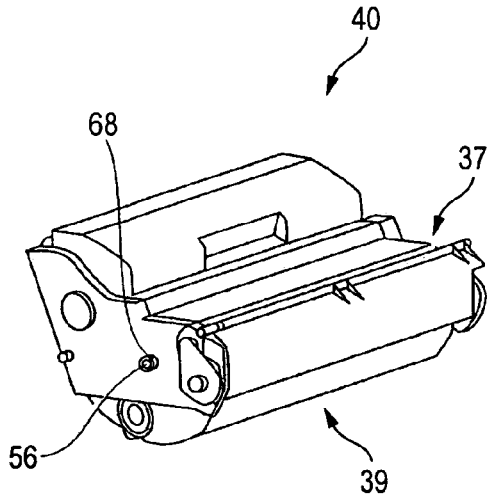

The process cartridge 40 is constructed by integrating the image carrier 26, the charging device 28, the developing device 32 and the cleaning device 36 therein, as described above. As shown in FIG. 2A, the process cartridge 40 includes the first casing 37, which supports the image carrier 26, the charging device 28 and the cleaning device 36, and the second casing 39, which supports the developing device 32. Further, as shown in FIG. 2B, the first casing 37 and the second casing 39 are coupled by the coupling pin 56 in such a way to freely rotate against each other.

Figure 3:
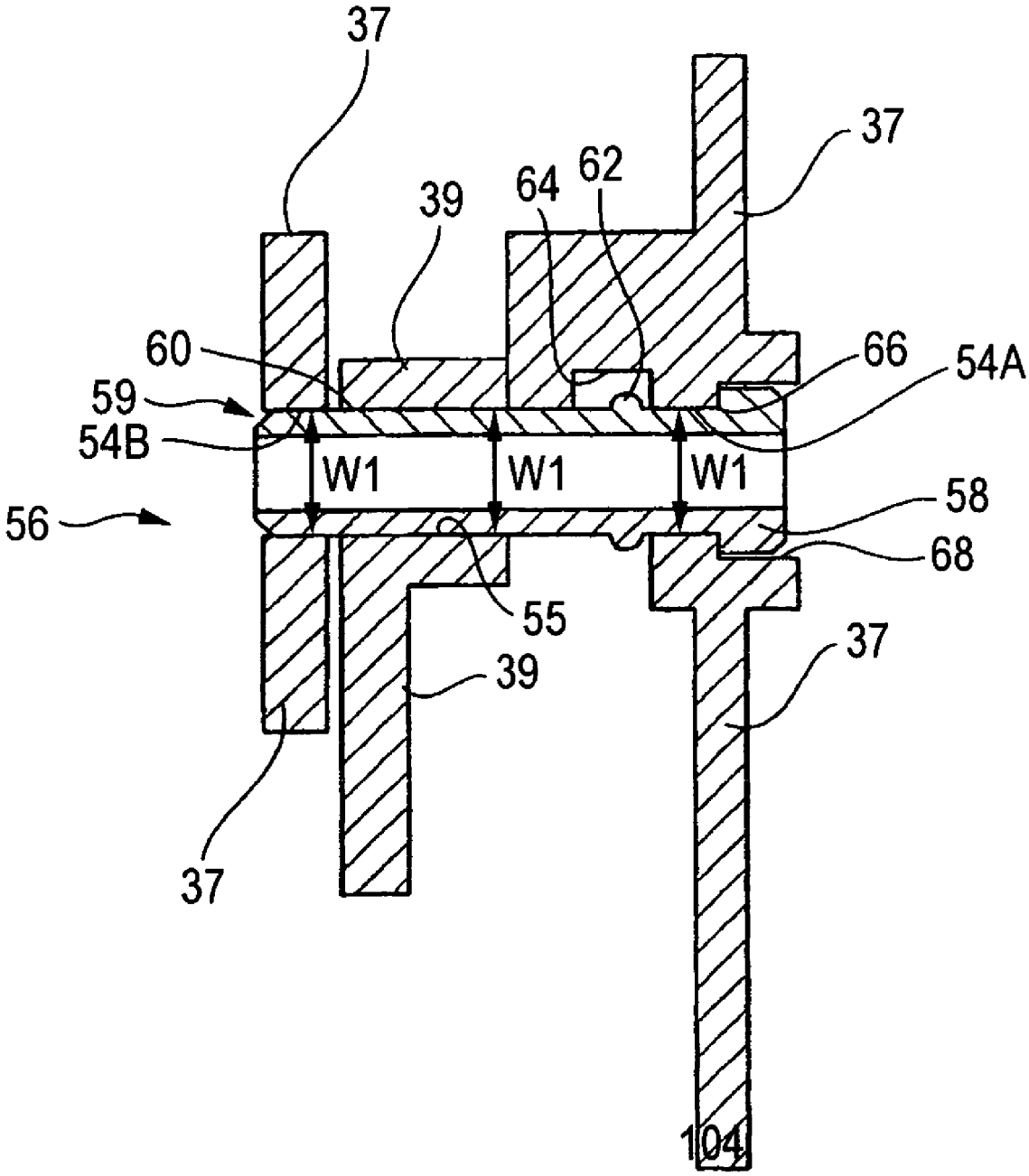
FIG. 3 is a cross-sectional view of main elements of the process cartridge according to an embodiment of the present invention.

FIG. 3 is a cross-sectional view showing integral elements of a combined portion of the process cartridge 40, in which the first casing 37 and the second casing 39 are combined together by the coupling pins 56 according to an embodiment. There is shown, in FIG. 3, that the first casing 37 and the second casing 39 are coupled by means of the coupling pins 56 in a state where one portion of the second casing 39 is inserted between two portions of the first casing 37 from both sides. The second insertion hole 55 of the second casing 39 is disposed between first insertion holes 54A and 54B of the first casing 37. In this case, the first insertion holes 54A and 54B, and the second insertion hole 55 have a same inside diameter W1.

The coupling pins 56 of the process cartridge according to a first embodiment of the present invention will now be described.

Figure 4D:
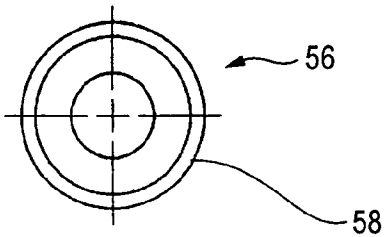
FIGS. 4A to 4E are a side view, a cross-sectional view, a perspective view, a front view and a top view showing the shape of the coupling pin according to a first embodiment of the present invention.
Figure 4E:
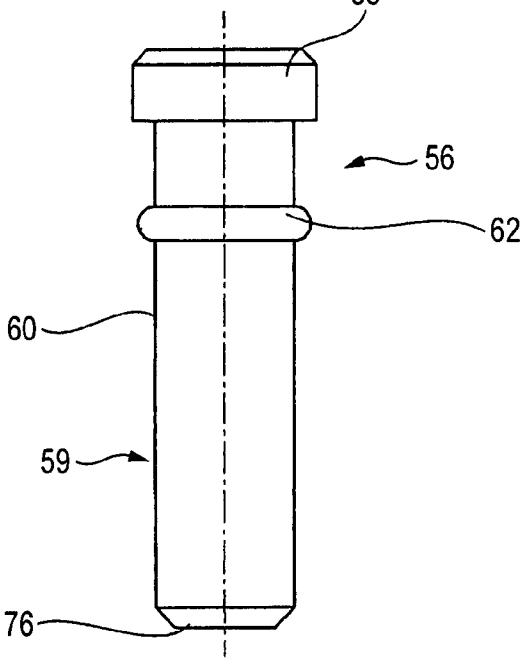
Figure 4A:
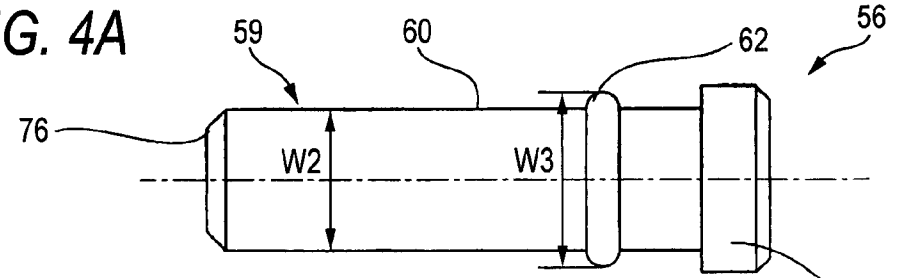
Figure 4B:
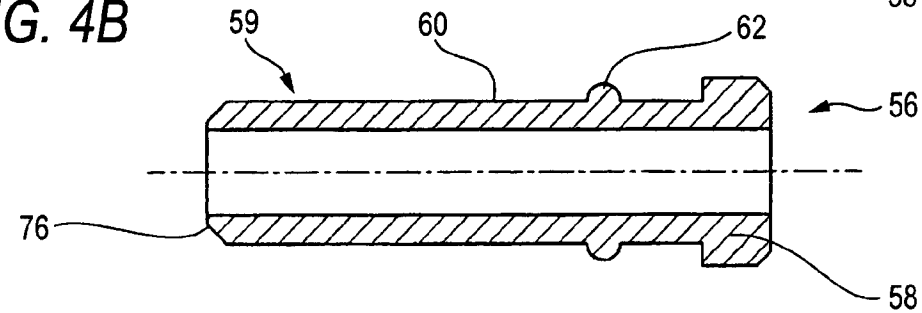
Figure 4C:
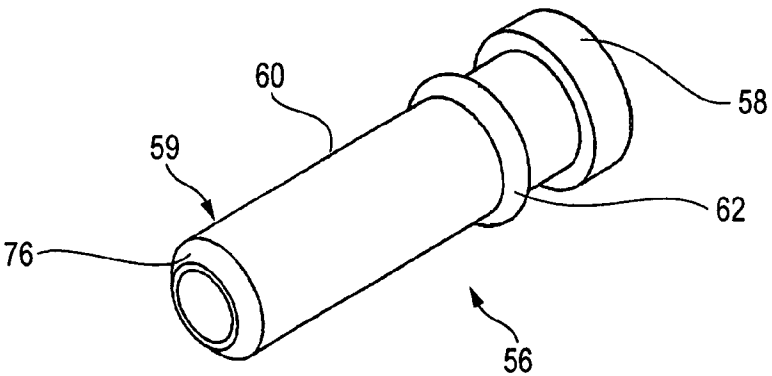

The coupling pins 56 are formed of, e.g., resin. In FIGS. 4A to 4E, FIG. 4A is a side view, FIG. 4B is a cross-sectional view, FIG. 4C is a perspective view, FIG. 4D is a front view, and FIG. 4E is a top view of the coupling pins 56 according to the first embodiment of the present invention. As shown in the cross-sectional view of FIG. 4B, the coupling pins 56 of this example have a hollow and approximately cylindrical shape along the entire length of its axial direction. A head portion 58 having an outside diameter greater than that of other portions is disposed at the rear end of the coupling pin 56 in its insertion direction. At a portion of the outer peripheral side 60 of a cylindrical external wall 59 of the coupling pins 56, a convex portion 62 whose cross section in its axial direction is hemispheric-shaped due to elastic deformation is disposed to go around an outer peripheral side 60 at a predetermined location of the coupling pin 56 in its axial direction. The convex portion 62 having flexibility is elastically deformed, and serves to prevent the coupling pin 56 from being pulled out. The convex portion 62 can also have any kind of a shape, for example, is integrally formed of resin with other portions except for the coupling pin 56.

As shown in FIG. 3, when the coupling pin 56 is inserted into the first insertion holes 54A and 54B formed in the first casing 37, and the second insertion hole 55 formed in the second casing 39, the convex portion 62 is press-fit into the first insertion hole 54A of the first casing 37, and is engaged with the concave portion 64. In other words, the convex portion 62 is engaged with the concave portion 64 by snap fitting (i.e., an example of an engaging means). The concave portion 64 can also have any kind of a shape if it is engaged with the convex portion 62. In FIG. 3, the top of the concave portion 64 is formed into a groove shape, and the bottom of the concave portion 64 is formed in an open shape. For instance, however, the overall concave portion 64 can have a groove shape.

Moreover, a coupling pin head fitting portion 68 having the head portion 58 of the coupling pin 56 fitted thereinto is disposed outside of the coupling pin insertion hole 66 of the first insertion hole 54A of the first casing 37. As the head portion 58 is fitted into the coupling pin head fitting portion 68, the head portion 58 of the coupling pin 56 is kept from protruding from the first casing 37, and the coupling pin 56 is prevented from being inadvertently pulled out by a user. It is therefore possible to prevent the first casing 37 and the second casing 39 from being separated from each other in occasions other than recycling.

In addition, as the convex portion 62 of the coupling pin 56 is engaged with the concave portion 64 of the coupling pin 56, an outside diameter W2 (refer to FIGS. 4A to 4E) of portions other than the convex portion 62 of the external wall 59 of the coupling pin 56 is approximately the same as the inside diameter W1 of the first insertion holes 54A and 54B formed in the first casing 37 and the second insertion hole 55 formed in the second casing 39. The outside diameter W2 also is a diameter that can be inserted into the first insertion holes 54A and 54B and the second insertion hole 55 in a state where the coupling pin 56 does not apply load (pressure) to the first casing 37 and the second casing 39. Further, an outside diameter W3 of the convex portion 62 of the coupling pin 56, which is not elastically deformed, is greater than the inside diameter W1 of the first insertion hole 54A. The outside diameter W3 also is a diameter that can be inserted into the first insertion hole 54A as the convex portion 62 is elastically deformed and the first insertion hole 54A widens.

Through this construction, after being inserted into the first insertion holes 54A and 54B formed in the first casing 37 and the second insertion hole 55 formed in the second casing 39, the coupling pin 56 is engaged with at least one of the first casing 37 and the second casing 39 without being press-fit into them. Therefore, since the coupling pin 56 has a structure in which any load is not applied to any of the first casing 37 and the second casing 39, abnormalities such as crack do not occur.

Next, a process of an embodiment of the method of assembling the process cartridge 40 using the coupling pin 5 according to the first embodiment will now be described with reference to the accompanying drawings.

Figure 5A:
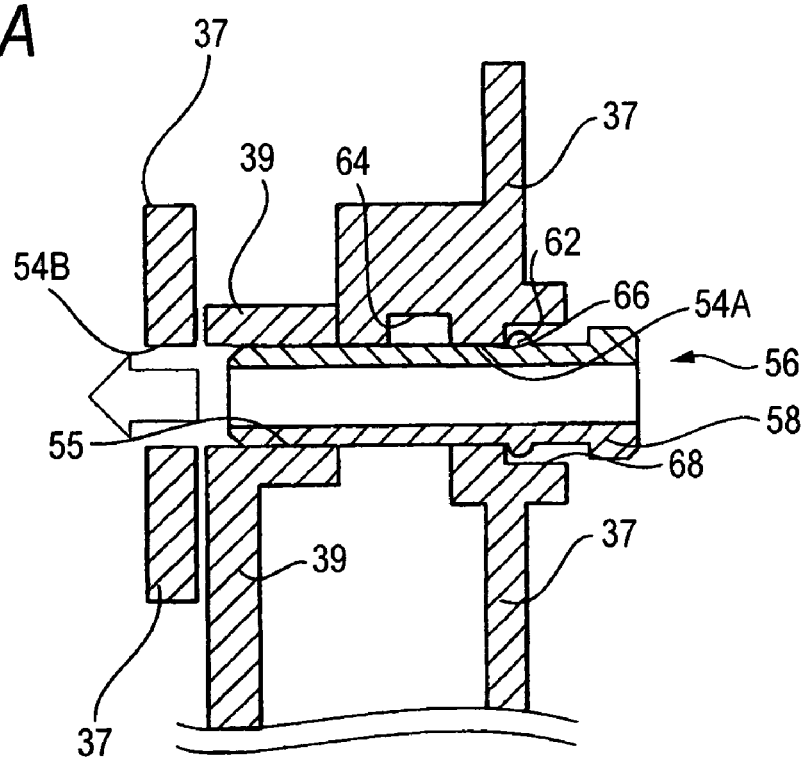
FIGS. 5A and 5B are process views showing a method of assembling the process cartridge using the coupling pins according to the first embodiment of the present invention.
Figure 5B:
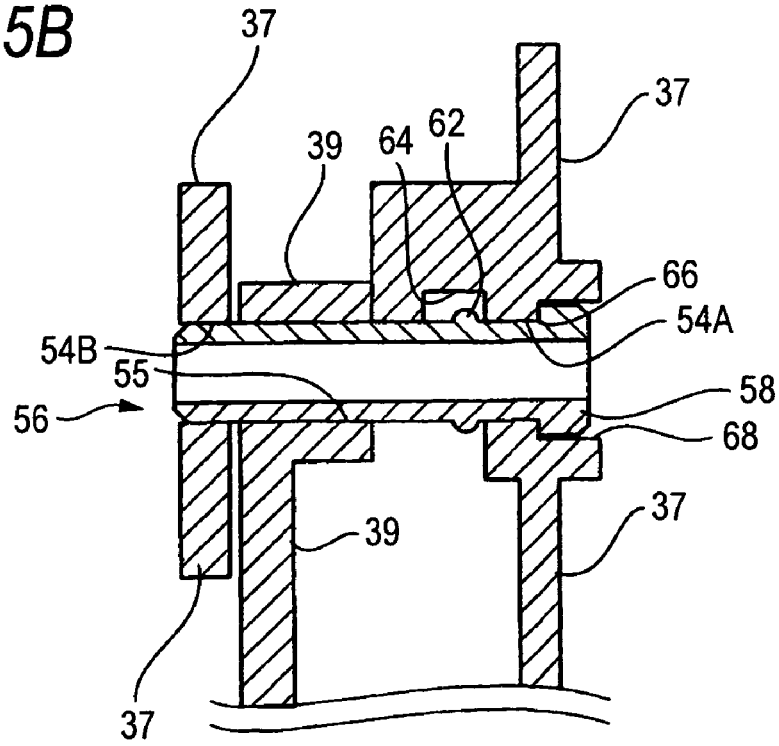

As shown in FIG. 5A, the coupling pin 56 is inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not inserted into the first insertion hole 54A and the second insertion hole 55 in a press-fit manner. Further, the convex portion 62 is elastically deformed by being press-fit from the coupling pin insertion hole 66 of the first casing 37, and can pass through the first insertion hole 54A by widening the first insertion hole 54A of the first casing 37. At the time when the convex portion 62 reaches the concave portion 64, as shown in FIG. 5B, the convex portion 62 returns to its original shape, and the convex portion 62 is engaged with the concave portion 64. That is, the convex portion 62 is engaged with the concave portion 64 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to the first casing 37 and the second casing 39.

Next, a process of an embodiment of a method of disassembling the process cartridge 40 using the coupling pin 56 according to the first embodiment will now be described with reference to the accompanying drawings.

Figure 6:
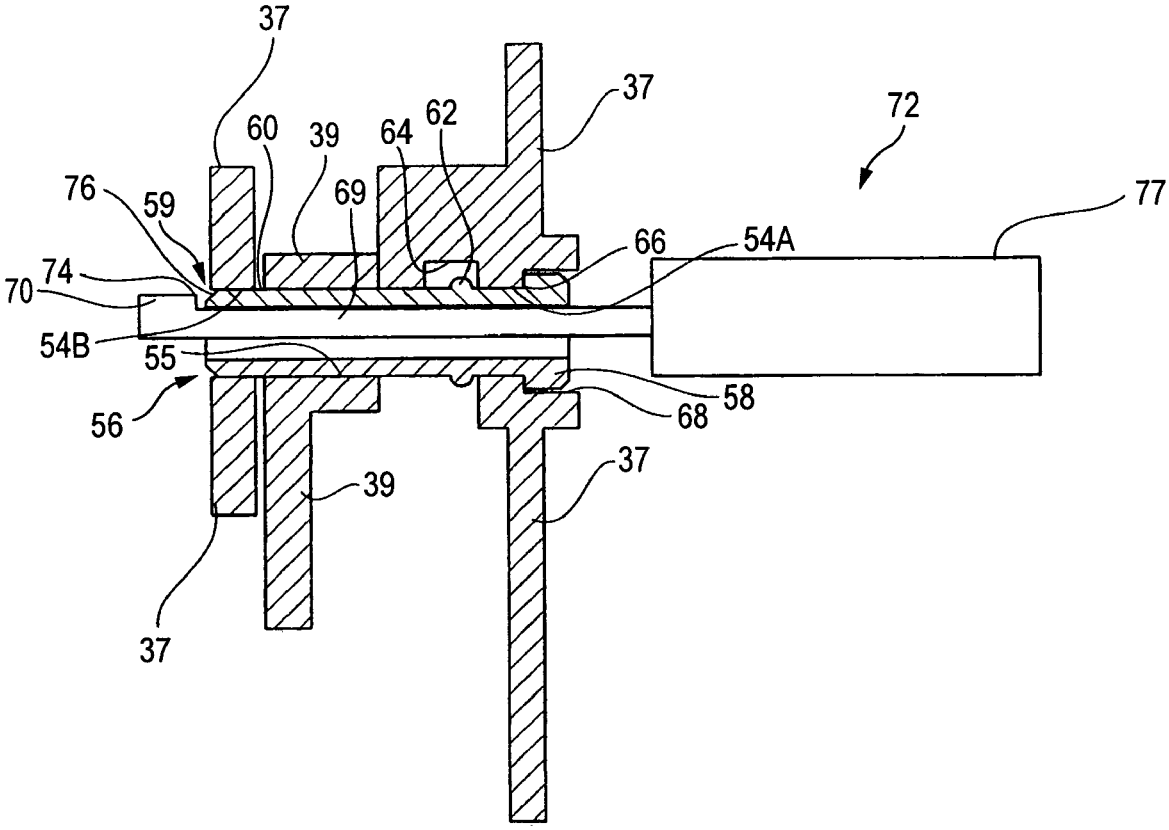
FIG. 6 is a cross-sectional view showing an extracting method of the coupling pin.

For the purpose of disassembling the process cartridge 40 during recycling, etc., in order to extract the coupling pin 56 from the first insertion holes 54A and 54B of the first casing 37 and the second insertion hole 55 of the second casing 39, an insertion rod portion 69 of a jig 72 is first inserted into the hollow portion of the coupling pin 56, and the jig 72 is pulled out in an extraction direction (the right direction in FIG. 6) of the coupling pin 56, by using the jig 72 having a protrusion portion 70 in the insertion rod portion 69, as shown in FIG. 6. The first casing 37 and the second casing 39, which were combined together, are thus separated from each other. A handle part 77 is also disposed in the jig 72, which further facilitates the extraction of the coupling pin 56.

Figure 7A:
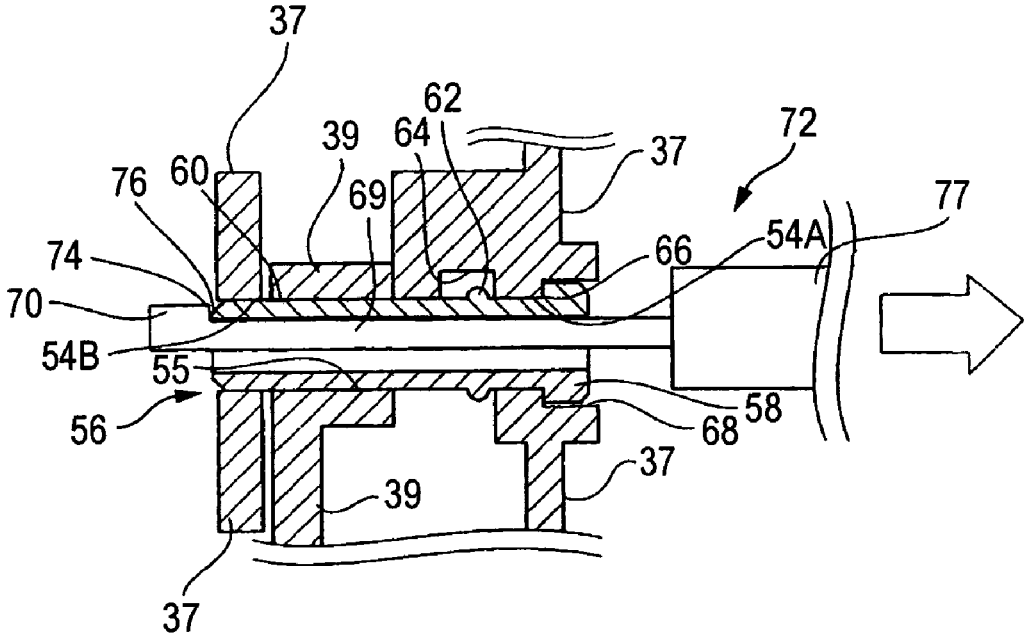
FIGS. 7A and 7B are process views showing a method of disassembling the process cartridge using the coupling pins according to the first embodiment of the present invention.

To describe in more detail, as shown in FIG. 7A, the insertion rod portion 69 of the jig 72 is inserted into the hollow portion of the coupling pin 56, and an outer end 74 of the protrusion portion 70 is brought to abut a front end 76 in an insertion direction of the coupling pin 56, so that the protrusion portion 70 of the jig 72 is engaged with the coupling pin 56.

Figure 7B:
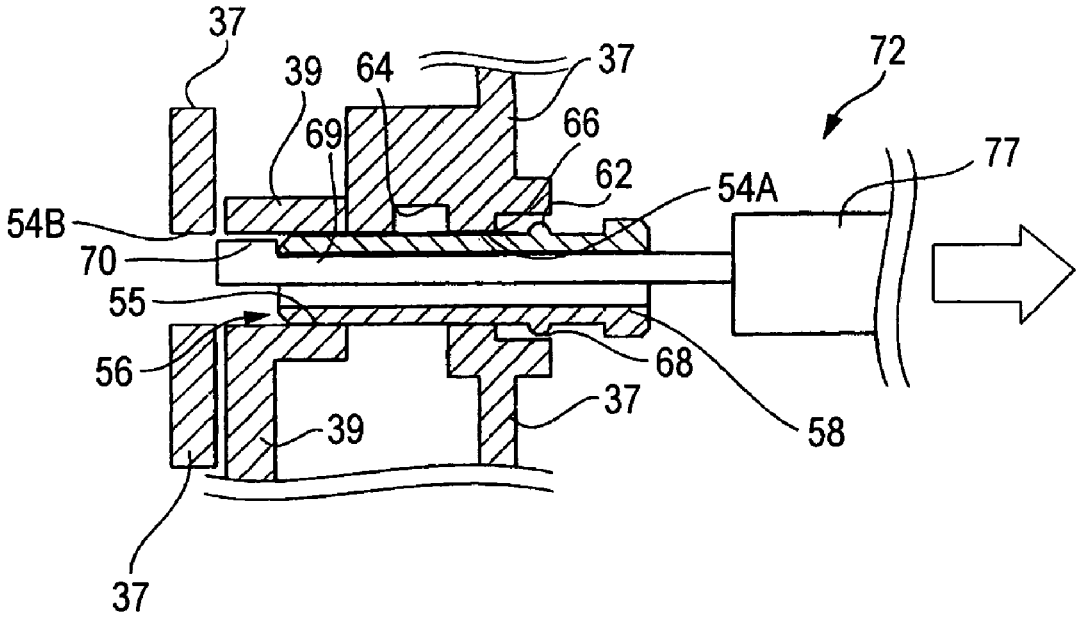
Figure 8D:
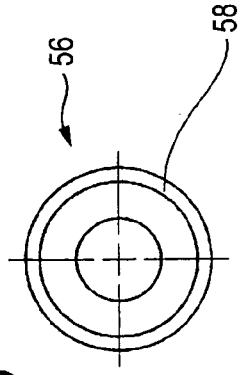
FIGS. 8A to 8E are a side view, a cross-sectional view, a perspective view, a front view and a top view showing the shape of the coupling pin according to a second embodiment of the present invention.
Figure 8E:
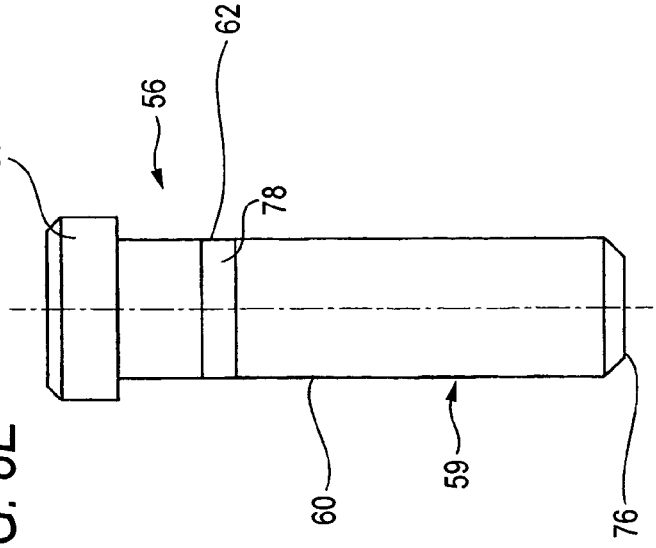
Figure 8A:
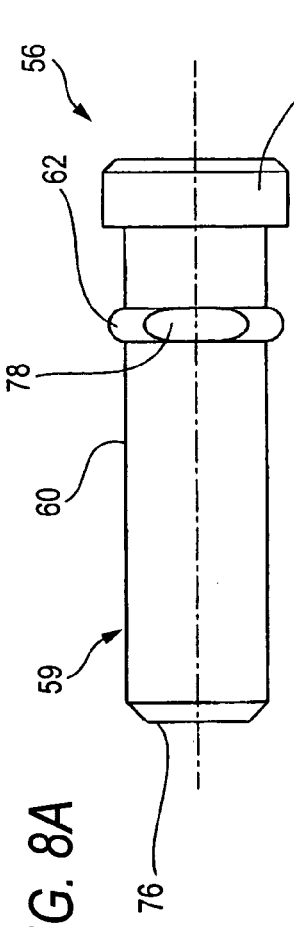
Figure 8B:
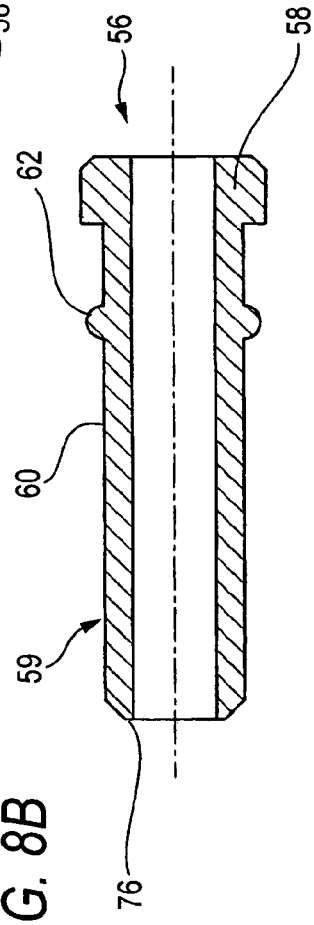
Figure 8C:
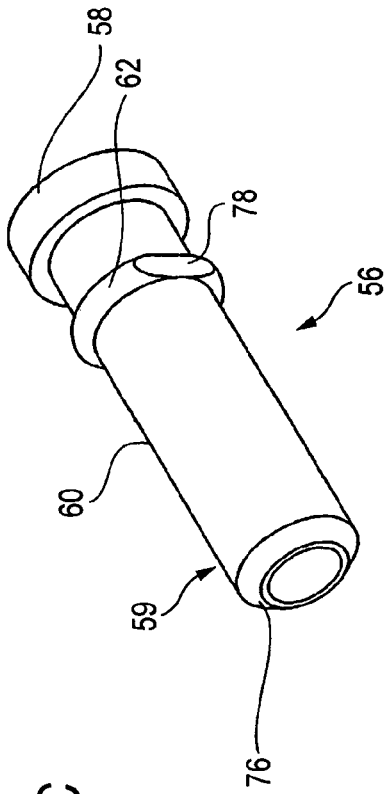
Figure 9D:
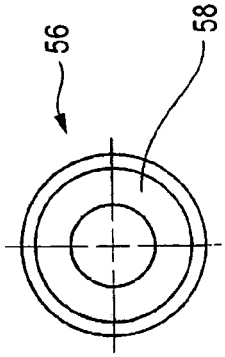
FIGS. 9A to 9E are a side view, a cross-sectional view, a perspective view, a front view and a top view showing the shape of the coupling pin according to a third embodiment of the present invention.
Figure 9E:
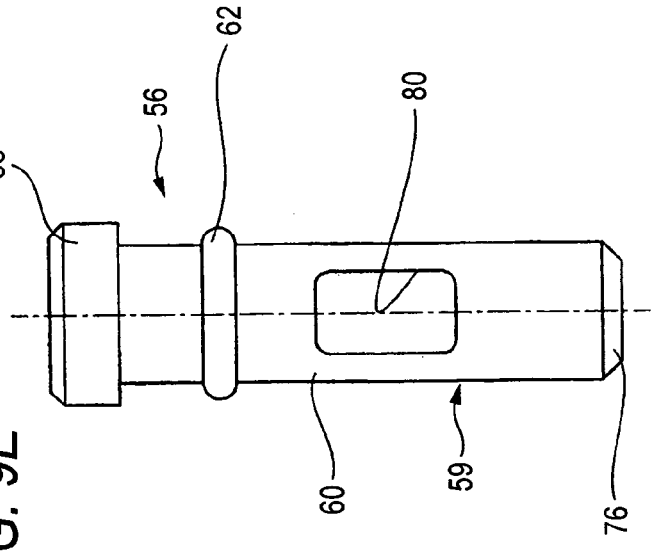
Figure 9A:
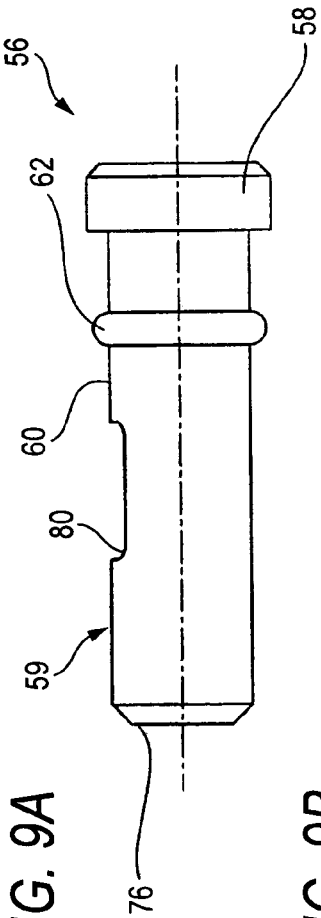
Figure 9B:
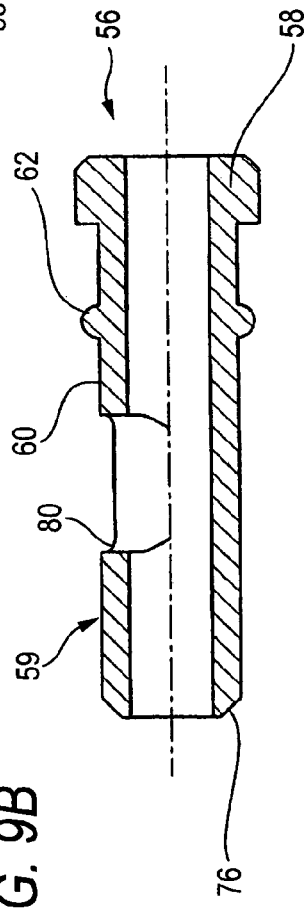
Figure 9C:
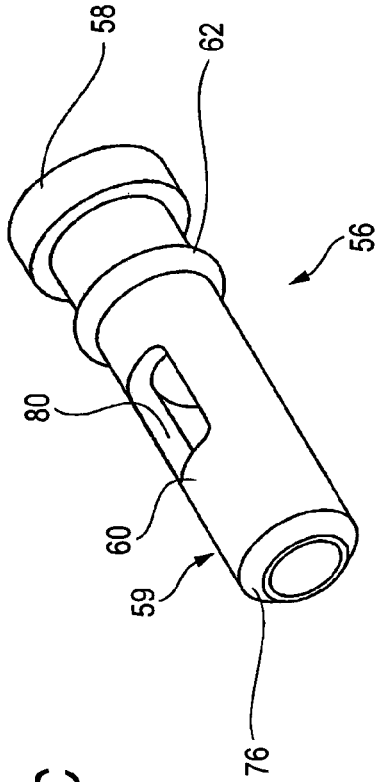

The convex portion 62 is elastically deformed by extracting the coupling pin 56 in the extraction direction (the right direction in FIGS. 7A and 7B) by the jig 72. The convex portion 62 is press-fit into the first insertion hole 54A by widening the first insertion hole 54A, and thus passes through the first insertion hole 54A. Thereafter, at the time when the convex portion 62 reaches the coupling pin head fitting portion 68 outside the first insertion hole 54A as shown in FIG. 7B, the convex portion 62 that has been elastically deformed and the first insertion hole 54A that has widened return to their original shapes. Moreover, the entire coupling pin 56 is detached from the first casing 37 and the second casing 39 by extracting the coupling pin 56, and the first casing 37 and the second casing 39 are separated accordingly.

In this way, during recycling, etc., the coupling pin 56 can be easily separated from the first casing 37 and the second casing 39 by extracting the coupling pin 56 using the jig 72, etc., and the efficiency of recycling can be thus enhanced. In addition, the coupling pin 56 cannot be separated from the first casing 37 and the second casing 39 without using the jig. This prevents the possibility that the first casing 37 and the second casing 39 can be separated from each other when a user extracts the coupling pin 56 inadvertently.

Next, the coupling pin 56 according to a second embodiment of the present invention will now be described.

In the coupling pin 56 according to the first embodiment, the convex portion 62 is disposed to go around the outer peripheral side 60 at a predetermined location of the coupling pin 56 in its axial direction. However, in the coupling pin 56 according to the second embodiment, as shown in a side view, a cross-sectional view, a perspective view, a front view and a top view of FIGS. 8A to 8E, the convex portion 62 is formed on the outer peripheral side 60 of the coupling pin 56 in a state where a notch portion 78 is formed by notching one part of the hemispheric convex portion 62. In this way, even in case that the convex portion 62 is disposed at a portion of the outer peripheral side 60 of the coupling pin 56 not to go around it, the coupling pin 56 can be inserted into the first insertion holes 54A and 54B and the second insertion hole 55 from the coupling pin insertion hole 66 by the elastic deformation of the convex portion 62. Furthermore, although the notch portion 78 is disposed at two symmetrical locations in FIGS. 8A to 8E, the notch portion 78 may be located only at one location, three locations or three or more locations. Furthermore, a plurality of the convex portions 62 having, e.g., the hemispheric shape may be disposed in a distributed manner to go around the outer peripheral side 60 at a predetermined location of the coupling pin 56 in its axial direction, or may have other shape than the hemispheric shape as its cross section.

In addition, in the same manner as the coupling pin 56 according to the first embodiment, the coupling pin 56 according to the second embodiment is formed of, for example, resin. The convex portion 62 has flexibility and can be elastically deformed. Further, the convex portion 62 can have any kind of a shape if only it can prevent the coupling pin 56 from being pulled out. For example, the convex portion 62 is formed of resin and integrated with other portions of the coupling pin 56. Moreover, in the same manner as the coupling pin 56 of the first embodiment, as shown in the cross-sectional view of FIG. 8B, the coupling pin 56 of the second embodiment can have a hollow and approximately cylindrical shape along the entire length of the axial direction, and the head portion 58 whose outside diameter is greater than other portions is formed at the rear end of the coupling pin 56 in the insertion direction.

Hereinafter a process of an embodiment of the method of assembling the process cartridge 40 using the coupling pin 56 according to the second embodiment will now be described with reference to the accompanying drawings. In the same manner as the coupling pin 56 of the first embodiment, as shown in FIG. 5A, the coupling pin 56 is inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not inserted into the first insertion hole 54A and the second insertion hole 55 in a press-fit manner. Further, the convex portion 62 is elastically deformed by being press-fit from the coupling pin insertion hole 66 of the first casing 37, and can pass through the first insertion hole 54A by widening the first insertion hole 54A of the first casing 37. At the time when the convex portion 62 reaches the concave portion 64, as shown in FIG. 5B, the convex portion 62 returns to its original shape, and the convex portion 62 is engaged with the concave portion 64. That is, the convex portion 62 is engaged with the concave portion 64 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to any of the first casing 37 and the second casing 39.

Next, a process of an embodiment of the method of disassembling the process cartridge 40 using the coupling pin 56 according to the second embodiment will now be described with reference to the accompanying drawings. For the purpose of disassembling the process cartridge 40 during recycling, etc., as shown in FIG. 7A, the insertion rod portion 69 of the jig 72 is inserted into the hollow portion of the coupling pin 56, and the outer end 74 of the protrusion portion 70 is brought to abut the insertion direction front end 76 of the coupling pin 56, so that the protrusion portion 70 of the jig 72 is engaged with the coupling pin 56.

The convex portion 62 is elastically deformed by extracting the coupling pin 56 in the extraction direction (the right direction in FIGS. 7A and 7B) by the jig 72. The convex portion 62 is press-fit into the first insertion hole 54A by widening the first insertion hole 54A, and thus passes through the first insertion hole 54A. Thereafter, at the time when the convex portion 62 reaches the coupling pin head fitting portion 68 outside the first insertion hole 54A as shown in FIG. 7B, the convex portion 62 that has been elastically deformed and the first insertion hole 54A that has widened return to their original shapes. Moreover, the entire coupling pin 56 is detached from the first casing 37 and the second casing 39 by extracting the coupling pin 56, and the first casing 37 and the second casing 39 are separated accordingly.

In this way, during recycling, etc., the coupling pin 56 can be easily separated from the first casing 37 and the second casing 39 by extracting the coupling pin 56 using the jig 72, etc., and the efficiency of recycling can be thus enhanced. In addition, the coupling pin 56 cannot be separated from the first casing 37 and the second casing 39 without using the jig. This prevents the possibility that the first casing 37 and the second casing 39 can be separated from each other when a user extracts the coupling pin 56 inadvertently.

The coupling pin 56 according to a third embodiment will be described below.

In the coupling pin 56 according to the third embodiment, an extraction hole 80 through which the coupling pin 56 is extracted from the first insertion holes 54A and 54B, and the second insertion hole 55 is formed by cutting part of the external wall 59 of the coupling pin 56 according to the first embodiment, as shown in a side view, a cross-sectional view, a perspective view, a front view and a top view of FIGS. 9A to 9E.

In addition, in the same manner as the coupling pin 56 according to the first embodiment, the coupling pin 56 according to the third embodiment is formed of, for example, resin. The convex portion 62 has flexibility and can be elastically deformed. Further, the convex portion 62 can have any kind of a shape if it can prevent the coupling pin 56 from being pulled out. For example, the convex portion 62 is formed of resin and integrated with other portions of the coupling pin 56. Moreover, in the same manner as the coupling pin 56 of the first embodiment, as shown in the cross-sectional view of FIG. 9B, the coupling pin 56 of the third embodiment can have a hollow and approximately cylindrical shape along the entire length of the axial direction, and the head portion 58 whose outside diameter is greater than other portions is formed at the rear end of the coupling pin 56 in the insertion direction.

Figure 10:
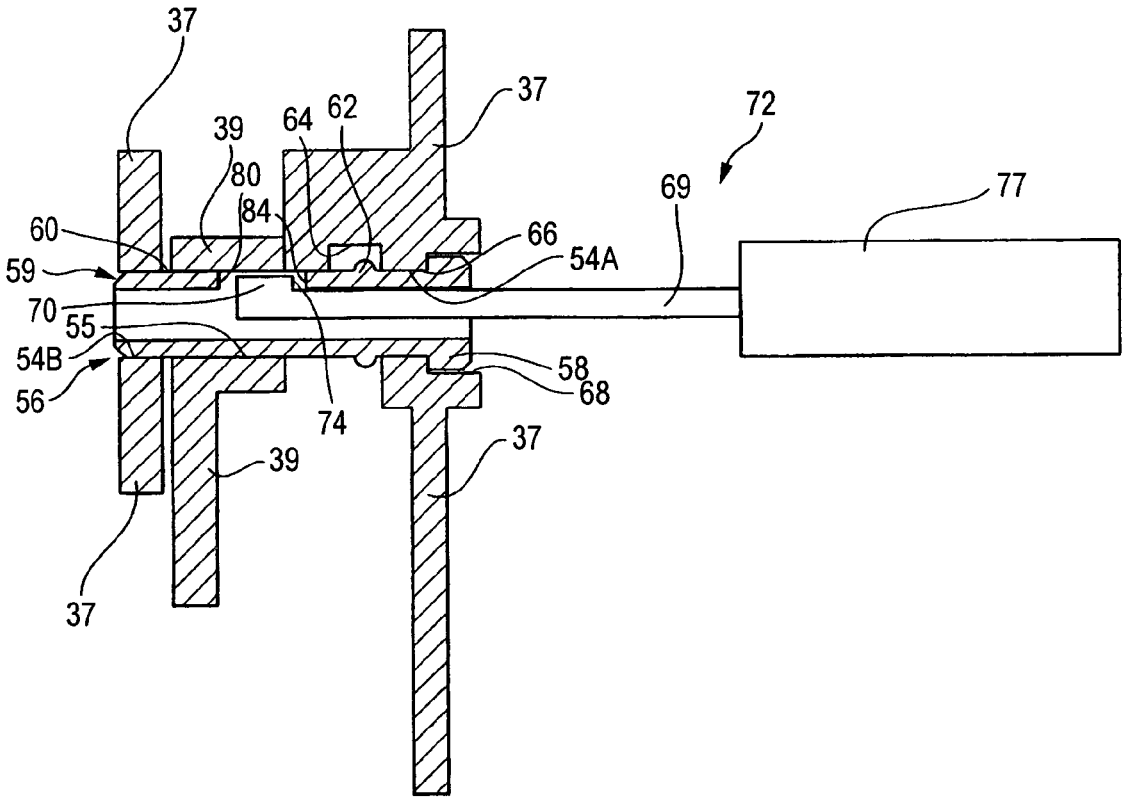
FIG. 10 is a cross-sectional view showing an extracting method of the coupling pin of FIGS. 9A to 9E.

By doing so, for example, as shown in the cross-sectional view of FIG. 10, by using the jig 72 having the insertion rod portion 69 and the protrusion portion 70, the insertion rod portion 69 of the jig 72 is inserted into the hollow portion of the coupling pin 56, the protrusion portion 70 is located in the extraction hole 80, and the jig 72 is pulled out in an extraction direction of the coupling pin 56 (the right direction in FIG. 10) in the handle part 77. Thus, the outer end 74 of the protrusion portion 70 is engaged with an edge 84 of an extraction hole 80, and the convex portion 62 is elastically deformed and the first insertion hole 54A also widens. As a result, the convex portion 62 passes through the first insertion hole 54A, and the coupling pin 56 is detached from the first casing 37 and the second casing 39, so that the first casing 37 and the second casing 39, which are combined together, are separated from each other.

Figure 11A:
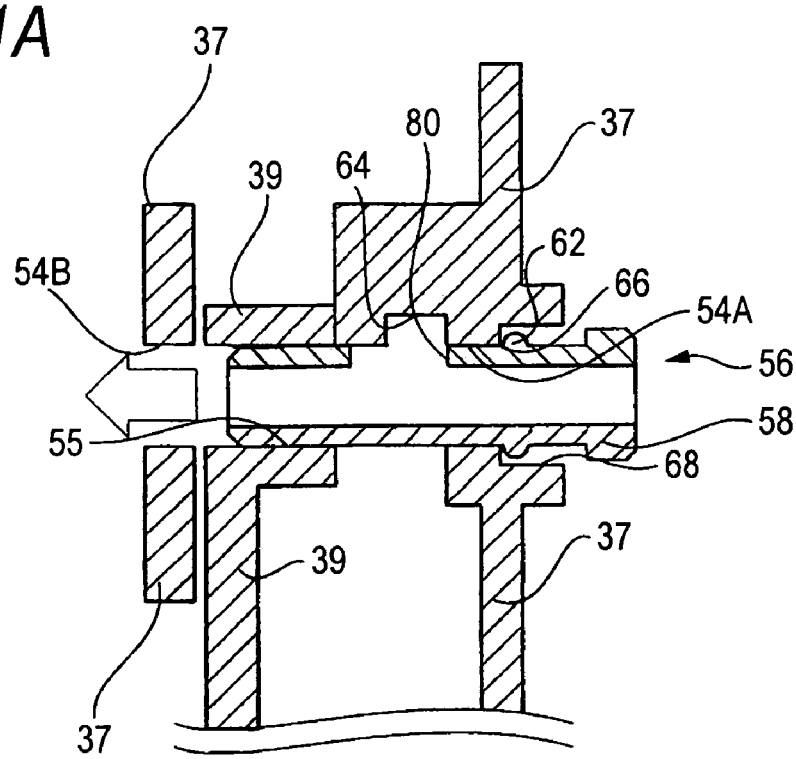
FIGS. 11A and 11B are process views showing a method of assembling the process cartridge using the coupling pins according to the third embodiment of the present invention.
Figure 11B:
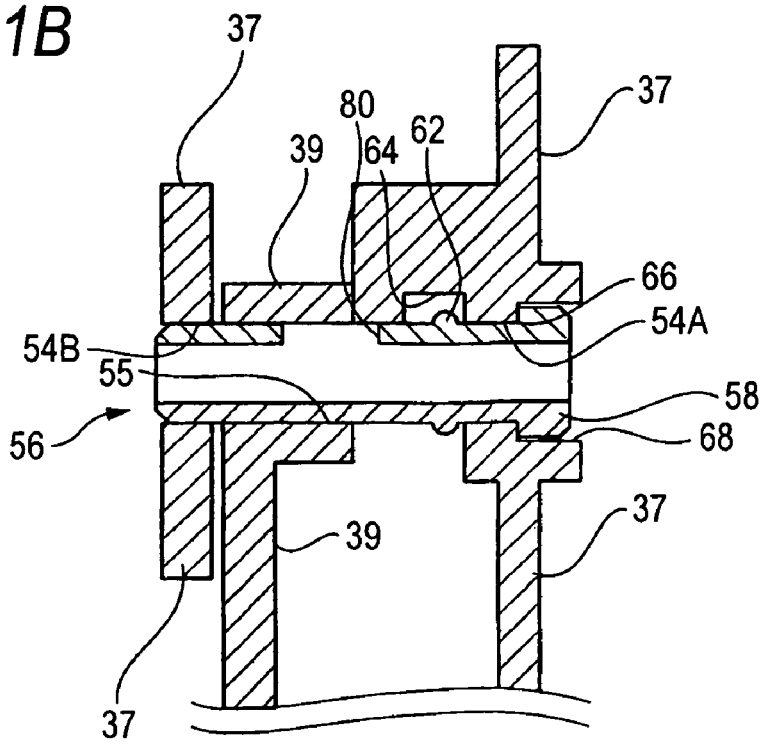

Hereinafter, a process of an embodiment of the method of assembling the process cartridge 40 using the coupling pin 56 according to the third embodiment will now be described with reference to the accompanying drawings. At first, in the same manner as the coupling pin 56 of the first embodiment, as shown in FIG. 11A, the coupling pin 56 is inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not inserted into the first insertion hole 54A and the second insertion hole 55 in a press-fit manner. Further, the convex portion 62 is elastically deformed by being press-fit from the coupling pin insertion hole 66 of the first casing 37, and can pass through the first insertion hole 54A by widening the first insertion hole 54A of the first casing 37. At the time when the convex portion 62 reaches the concave portion 64, as shown in FIG. 11B, the convex portion 62 returns to its original shape, and the convex portion 62 is engaged with the concave portion 64. That is, the convex portion 62 is engaged with the concave portion 64 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to any of the first casing 37 and the second casing 39.

A process of an embodiment of the method of disassembling the process cartridge 40 using the coupling pin 56 according to the third embodiment will now be described with reference to the accompanying drawings.

Figure 12A:
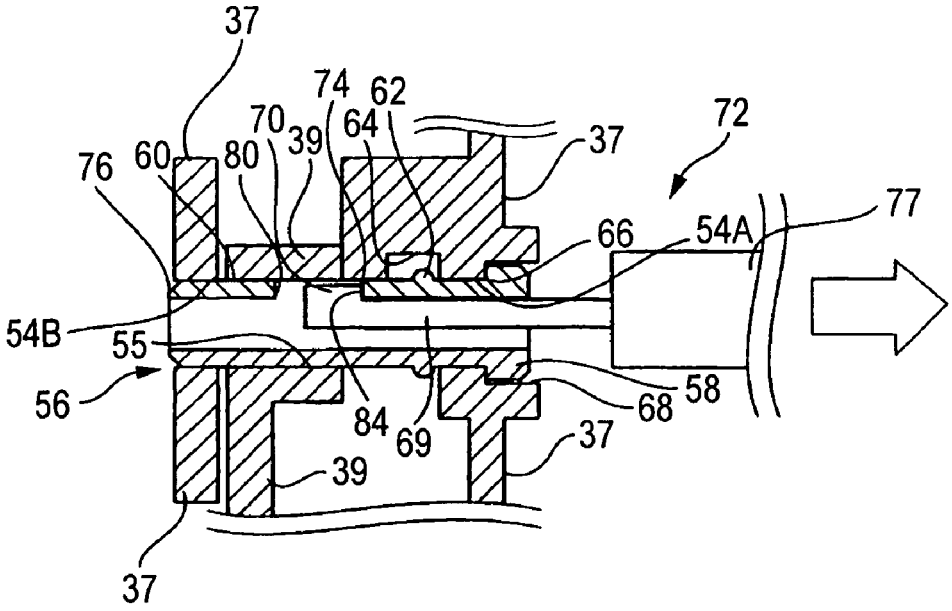
FIGS. 12A and 12B are process views showing a method of disassembling the process cartridge using the coupling pins according to the third embodiment of the present invention.

For the purpose of disassembling the process cartridge 40 during recycling, etc., as shown in FIG. 7A, in order to extract the coupling pin 56 of the third embodiment from the first insertion holes 54A and 54B of the first casing 37 and the second insertion hole 55 of the second casing 39, as shown in FIG. 12A, the insertion rod portion 69 of the jig 72 is first inserted into the hollow portion of the coupling pin 56, the protrusion portion 70 is located in the extraction hole 80, and the jig 72 is pulled out in the extraction direction of the coupling pin 56 (the right direction in FIGS. 12A and 12B) in the handle part 77, as shown in FIG. 12A. Thus, the outer end 74 of the protrusion portion 70 is being engaged with the edge 84 of the extraction hole 80 (refer to FIG. 10).

Figure 12B:
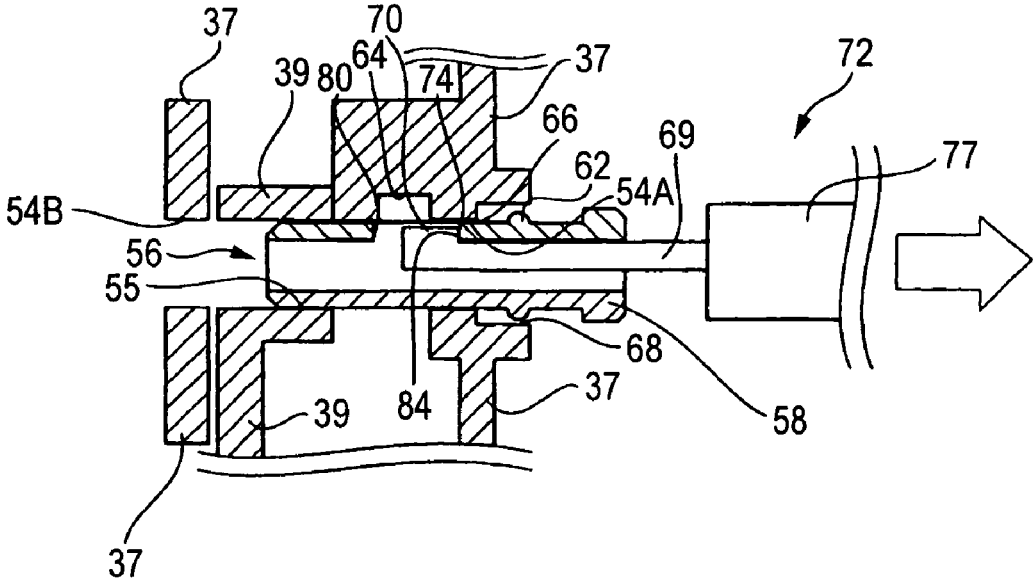
Figure 13D:
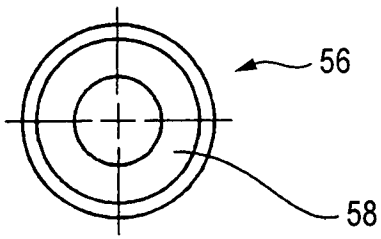
FIGS. 13A to 13E are a side view, a cross-sectional view, a perspective view, a front view and a top view showing another shape of the coupling pin according to the third embodiment of the present invention.
Figure 13E:
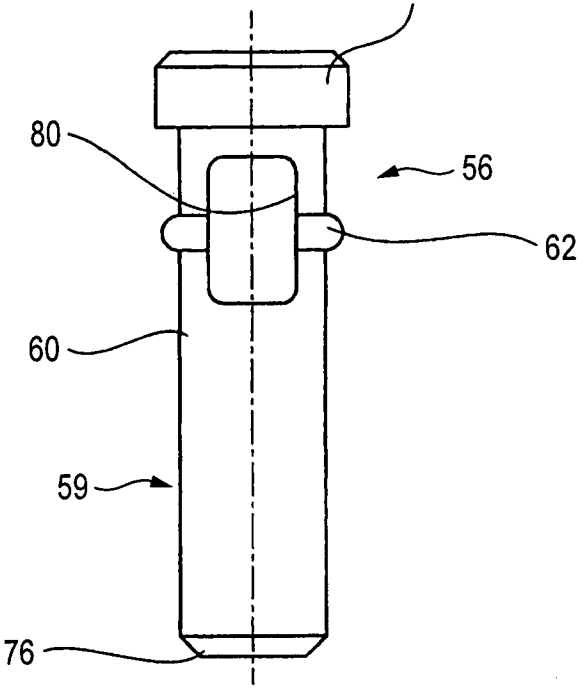
Figure 13A:
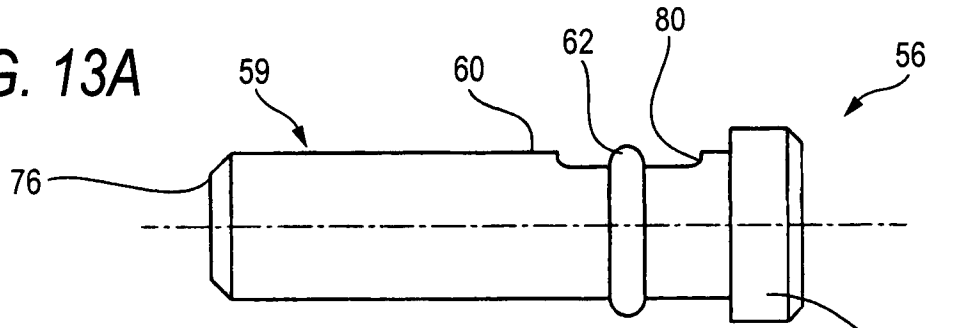
Figure 13B:
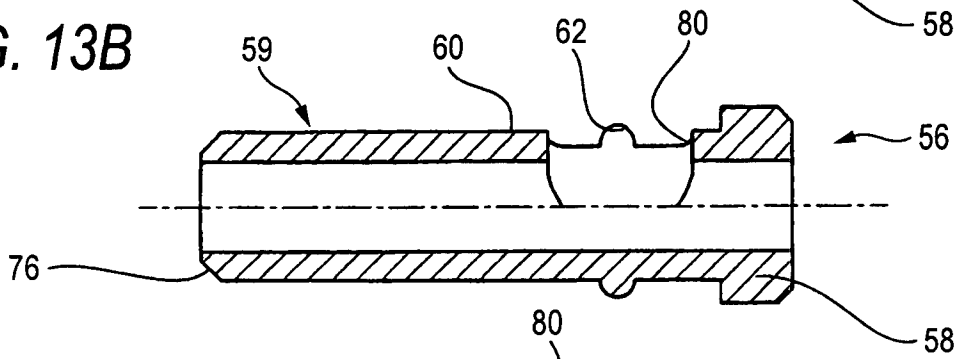
Figure 13C:
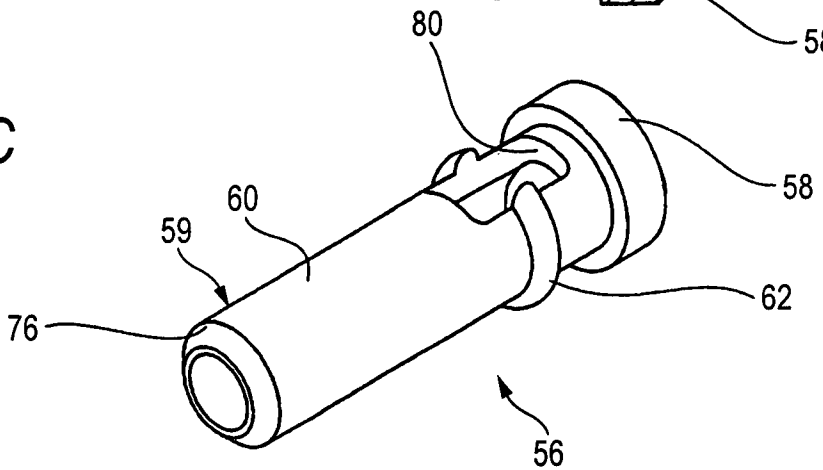
Figure 14D:
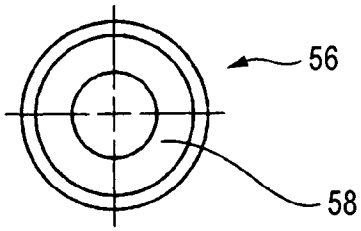
FIGS. 14A to 14E are a side view, a cross-sectional view, a perspective view, a front view and a top view showing the shape of the coupling pin according to a fourth embodiment of the present invention.
Figure 14E:
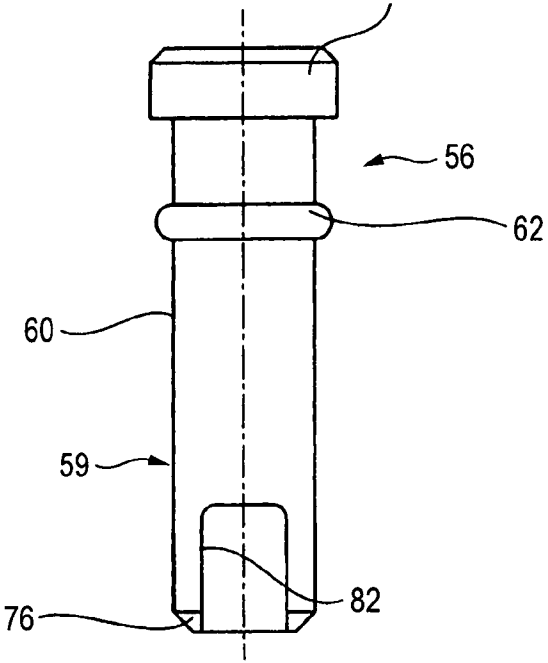
Figure 14A:
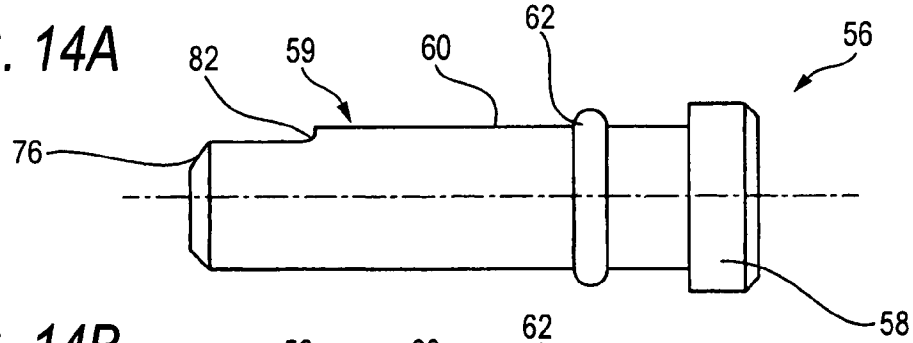
Figure 14B:
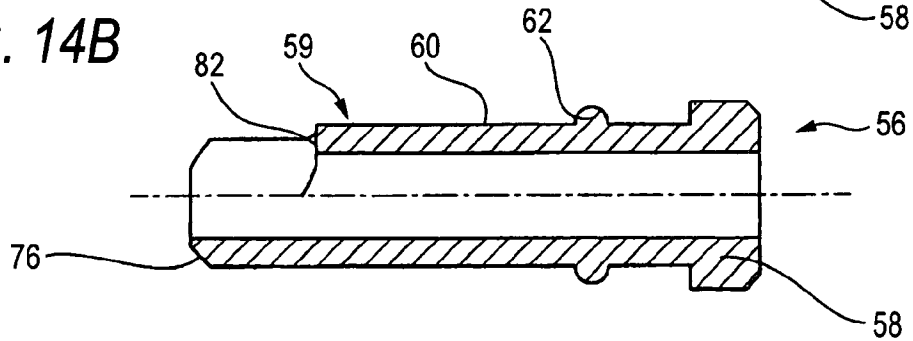
Figure 14C:
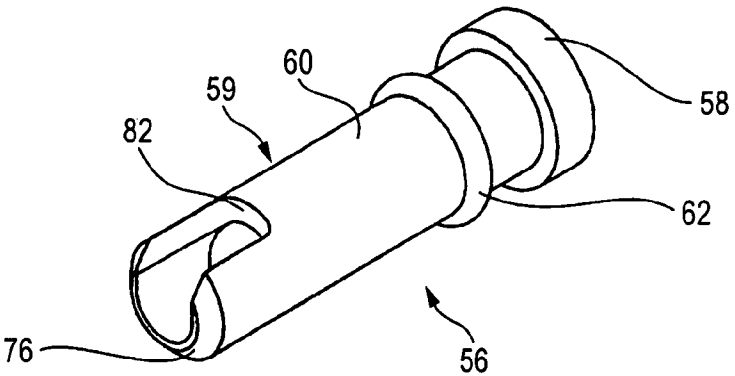

Furthermore, the convex portion 62 is elastically deformed by extracting the coupling pin 56 in the extraction direction (the right direction in FIGS. 12A and 12B) by the jig 72. The convex portion 62 is press-fit into the first insertion hole 54A by widening the first insertion hole 54A, and thus passes through the first insertion hole 54A. Thereafter, as shown in FIG. 12B, At the time when the convex portion 62 reaches the coupling pin head fitting portion 68 outside the first insertion hole 54A, the convex portion 62 that has been elastically deformed and the first insertion hole 54A that has widened return to their original shapes. Moreover, the entire coupling pin 56 is detached from the first casing 37 and the second casing 39 by extracting the coupling pin 56.

In this way, during recycling, etc., the coupling pin 56 can be easily separated from the first casing 37 and the second casing 39 by extracting the coupling pin 56 using the jig 72, etc., and the efficiency of recycling can be thus enhanced. In addition, the coupling pin 56 cannot be separated from the first casing 37 and the second casing 39 without using the jig. This prevents the possibility that the first casing 37 and the second casing 39 can be separated from each other when a user extracts the coupling pin 56 inadvertently.

In the coupling pin 56 of FIGS. 9A to 9E, it has also been shown that the extraction hole 80 is disposed approximately at a central portion of the external wall 59 of the coupling pin 56 in its axial direction. However, as shown in FIGS. 13A to 13E, the extraction hole 80 can be disposed at the convex portion 62 by cutting the convex portion 62. Further, if the coupling pin 56 can be detached from the first casing 37 and the second casing 39 with the protrusion portion 70 being engaged with the extraction hole 80 using the jig 72, the extraction hole 80 can be located at any location of the coupling pin 56 in its axial direction.

The coupling pin 56 according to a fourth embodiment will now be described.

In the coupling pin 56 according to the fourth embodiment, a portion from which the insertion direction front end 76 of the coupling pin 56 is cut off is arranged as a notch groove 82 through which the coupling pin 56 is extracted from the first insertion holes 54A and 54B and the second insertion hole 55, as shown in FIGS. 14A to 14E.

Figure 15:
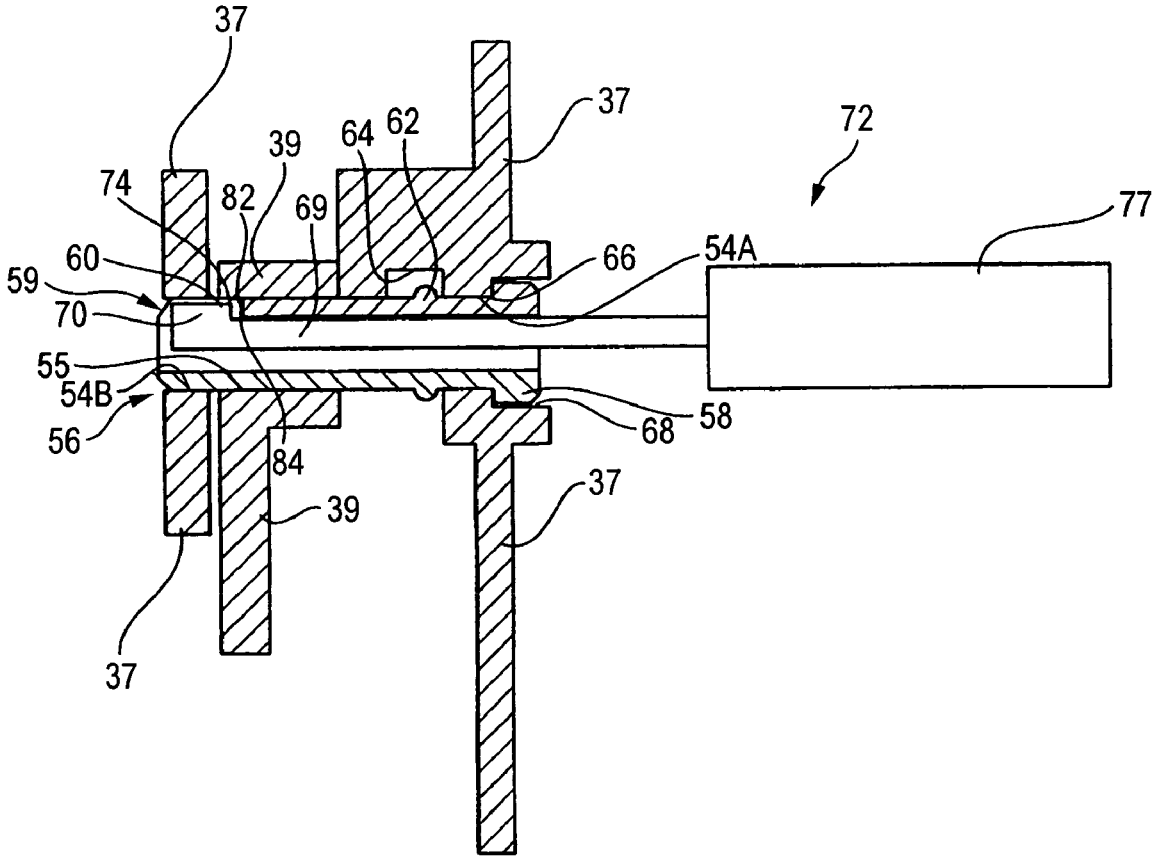
FIG. 15 is a cross-sectional view showing an extracting method of the coupling pin of FIGS. 14A to 14E.

By doing so, as shown in the cross-sectional view of FIG. 15, for example, by using the jig 72 having the insertion rod portion 69 and the protrusion portion 70, the insertion rod portion 69 of the jig 72 is inserted into the hollow portion of the coupling pin 56, the protrusion portion 70 is located in the notch groove 82, and the jig 72 is pulled out in the extraction direction of the coupling pin 56 (the right direction in FIG. 15) in the handle part 77. Thus, the outer end 74 of the protrusion portion 70 is engaged with the edge 84 of the notch groove 82, and the convex portion 62 is elastically deformed and the first insertion hole 54A also widens. As a result, the convex portion 62 passes through the first insertion hole 54A, and the coupling pin 56 is detached from the first casing 37 and the second casing 39, so that the first casing 37 and the second casing 39, which are combined together, are separated from each other.

In addition, in the same manner as the coupling pin 56 according to the fourth embodiment, the coupling pin 56 according to the second embodiment is formed of, for example, resin. The convex portion 62 has flexibility and can be elastically deformed. Further, the convex portion 62 can have any kind of a shape if it can prevent the coupling pin 56 from being pulled out. For example, it can be formed of resin and integrated with other portions of the coupling pin 56 using resin. Moreover, the coupling pin 56 of the fourth embodiment can have a hollow and approximately cylindrical shape along the entire length of the axial direction, and the head portion 58 whose outside diameter is greater than other portions is formed at the rear end of the coupling pin 56 in the insertion direction, in the same manner as the coupling pin 56 of the first embodiment, as shown in the cross-sectional view of FIG. 14B.

Figure 16A:
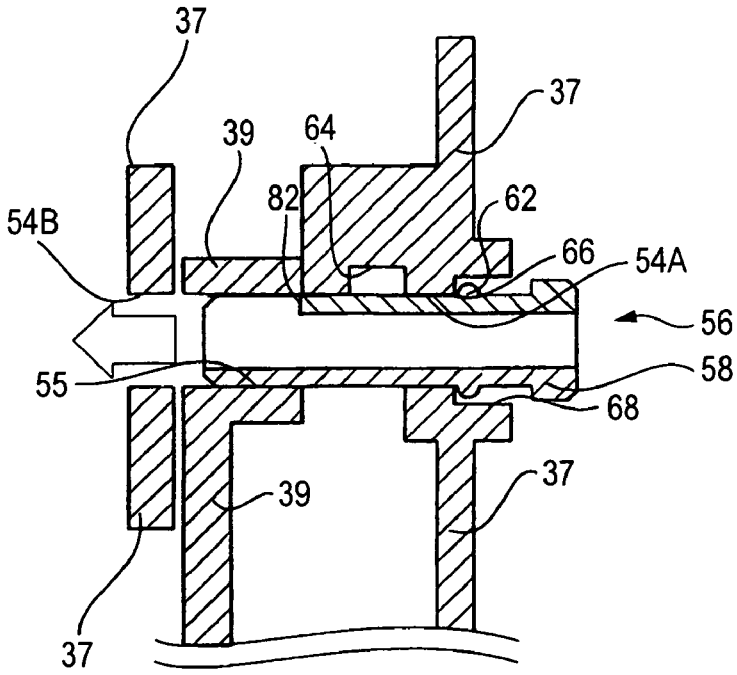
FIGS. 16A and 16B are process views showing a method of assembling the process cartridge using the coupling pins according to the fourth embodiment of the present invention.
Figure 16B:
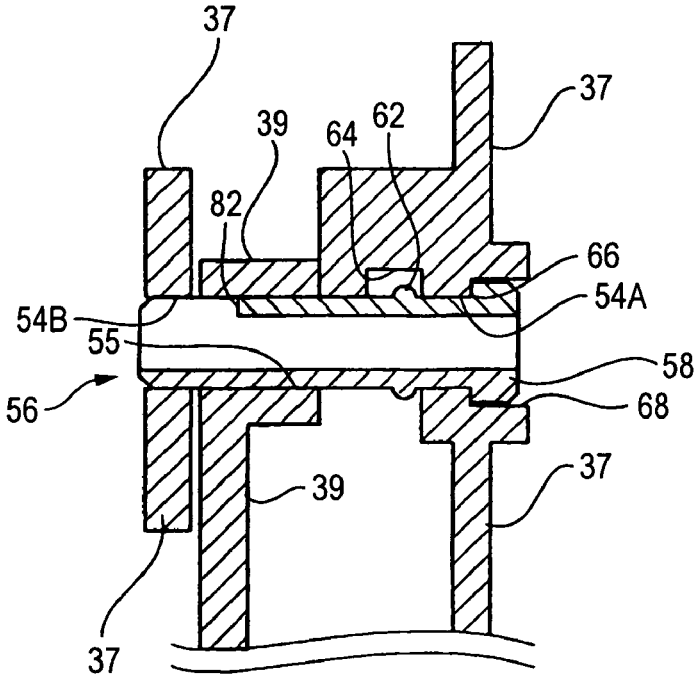

Hereinafter, a process of an embodiment of the method of assembling the process cartridge 40 using the coupling pin 56 according to the fourth embodiment will now be described with reference to the accompanying drawings. In the same manner as the coupling pin 56 of the first embodiment, as shown in FIG. 16A, the coupling pin 56 is first inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not inserted into the first insertion hole 54A and the second insertion hole 55 in a press-fit manner. Further, the convex portion 62 is elastically deformed by being press-fit from the coupling pin insertion hole 66 of the first casing 37, and can pass through the first insertion hole 54A by widening the first insertion hole 54A of the first casing 37. At the time when the convex portion 62 reaches the concave portion 64, as shown in FIG. 16B, the convex portion 62 returns to its original shape, and the convex portion 62 is engaged with the concave portion 64. That is, the convex portion 62 is engaged with the concave portion 64 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to any of the first casing 37 and the second casing 39.

Next, a process of an embodiment of the method of disassembling the process cartridge 40 using the coupling pin 56 according to the fourth embodiment will be described hereinafter with reference to the accompanying drawings.

Figure 17A:
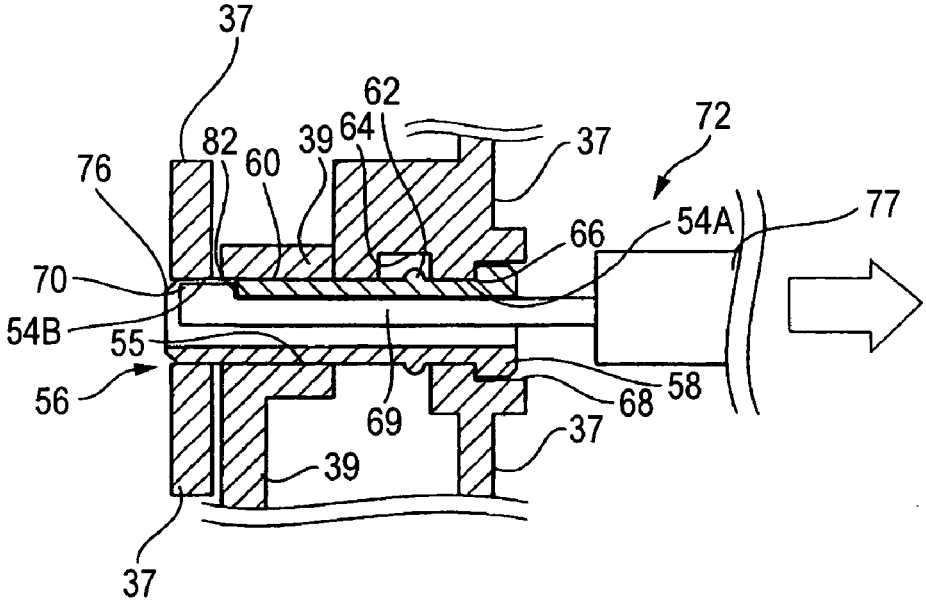
FIGS. 17A and 17B are process views showing a method of disassembling the process cartridge using the coupling pins according to the fourth embodiment of the present invention.

For the purpose of disassembling the process cartridge 40 during recycling, etc., in order to extract the coupling pin 56 of the fourth embodiment from the first insertion holes 54A and 54B of the first casing 37 and the second insertion hole 55 of the second casing 39, as shown in FIG. 17A, the insertion rod portion 69 of the jig 72 is first inserted into the hollow portion of the coupling pin 56, the protrusion portion 70 is located in the notch groove 82, and the jig 72 is pulled out in the extraction direction of the coupling pin 56 (the right direction in FIGS. 17A and 17B) in the handle part 77. Thus, the outer end 74 of the protrusion portion 70 is being engaged with the edge 84 of the notch groove 82 (refer to FIG. 15).

Figure 17B:
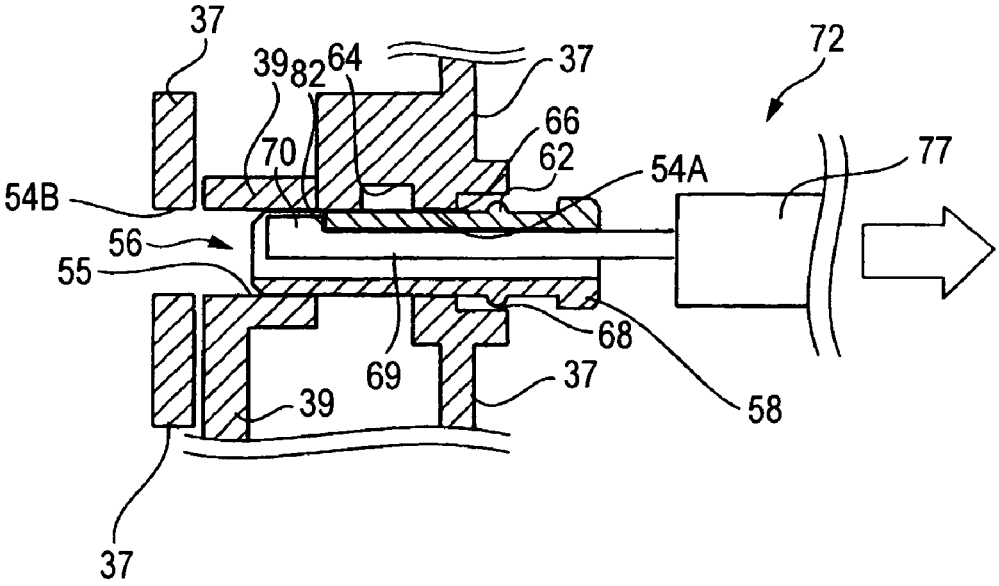
Figure 18D:
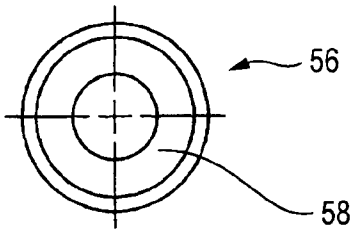
FIGS. 18A to 18E are a side view, a cross-sectional view, a perspective view, a front view and a top view showing another shape of the coupling pin according to a fifth embodiment of the present invention.
Figure 18E:
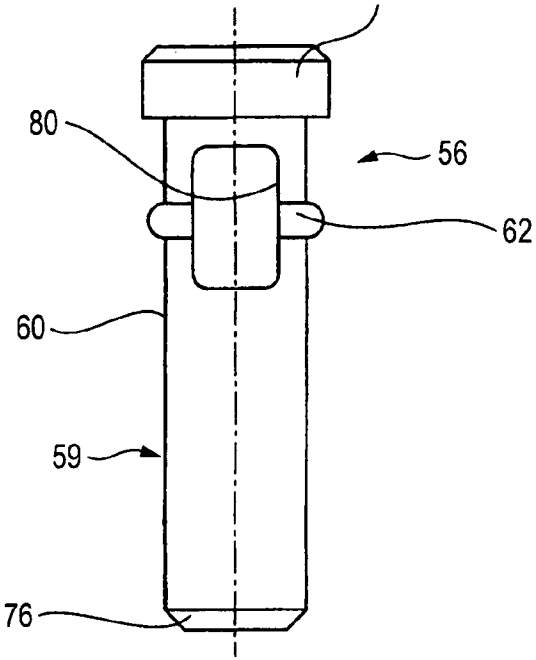
Figure 18A:
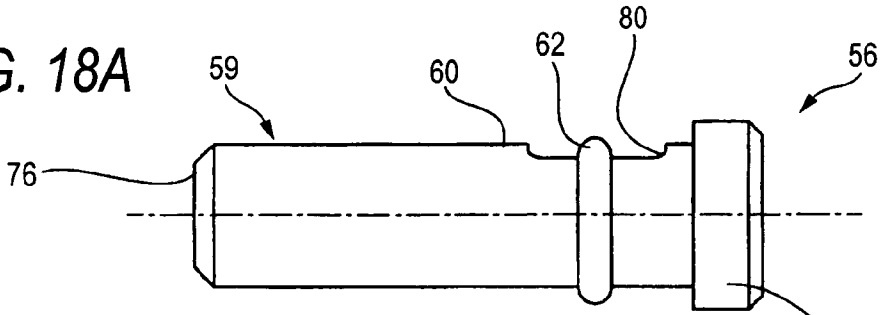
Figure 18B:
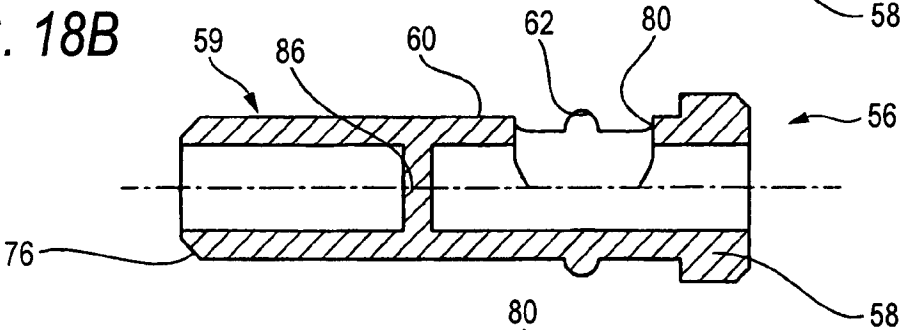
Figure 18C:
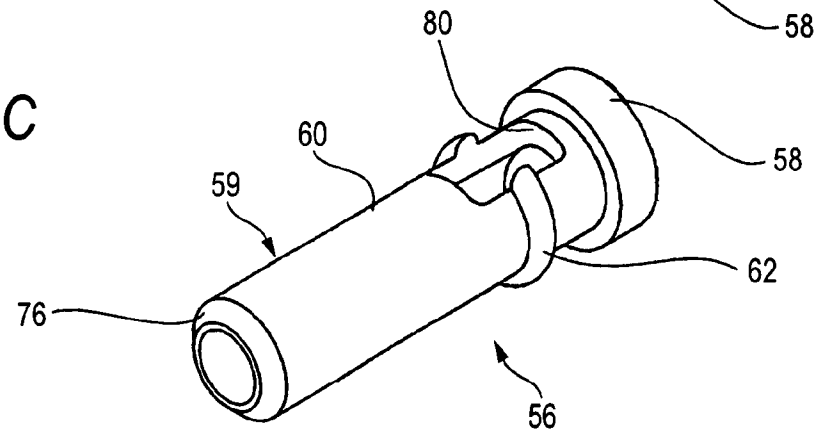

Furthermore, the convex portion 62 is elastically deformed by extracting the coupling pin 56 in the extraction direction (the right direction in FIGS. 17A and 17B) by the jig 72. The convex portion 62 is press-fit into the first insertion hole 54A by widening the first insertion hole 54A, and thus passes through the first insertion hole 54A. Thereafter, at the time when the convex portion 62 reaches the coupling pin head fitting portion 68 outside the first insertion hole 54A as shown in FIG. 17B, the convex portion 62 that has been elastically deformed and the first insertion hole 54A that has widened return to their original shapes. The entire coupling pin 56 is also detached from the first casing 37 and the second casing 39 by extracting the coupling pin 56, and the first casing 37 and the second casing 39 can be separated from each other accordingly.

In this way, by extracting the coupling pin 56 using the jig 72, etc. during recycling, etc., the coupling pin 56 can be easily separated from the first casing 37 and the second casing 39. The efficiency of recycling can be thus enhanced. Further, the coupling pin 56 can not be separated from the first casing 37 and the second casing 39 without using the jig. This prevents the possibility that the first casing 37 and the second casing 39 can be separated from each other when a user extracts the coupling pin 56 inadvertently.

Next, the coupling pin 56 according to a fifth embodiment will now be described.

The coupling pin 56 according to the first to fourth embodiments has a hollow cylindrical shape in its entire length. In the coupling pin 56 according to a fifth embodiment, however, a wall 86 is formed in the hollow portion approximately at a central portion in its axial direction of the coupling pin 56, as shown in FIGS. 18A to 18E. If the wall 86 is disposed in the hollow portion in this way, the strength of the coupling pin 56 increases, and damage of the coupling pin 56 is thus prevented. Furthermore, in case that the wall 86 is disposed in the hollow portion, it is required that the extraction hole 80 be arranged closer at the head portion 58 than at the wall 86. For this reason, in case of the coupling pin 56 of FIGS. 18A to 18E, the extraction hole 80 is disposed to cut the convex portion 62, in the same manner as the coupling pin 56 of FIGS. 13A to 13E.

Figure 19A:
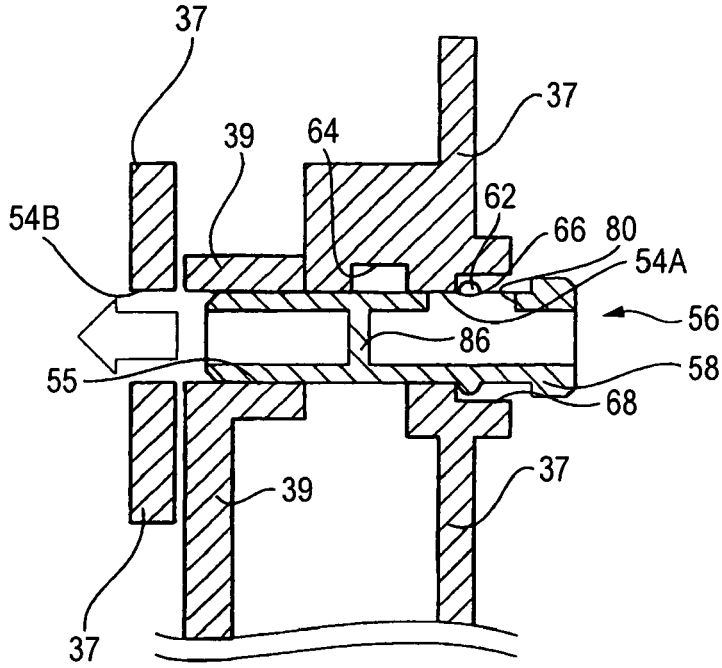
FIGS. 19A and 19B are a side view, a cross-sectional view, a perspective view, a front view and a top view showing the shape of the coupling pin according to the fifth embodiment of the present invention.
Figure 19B:
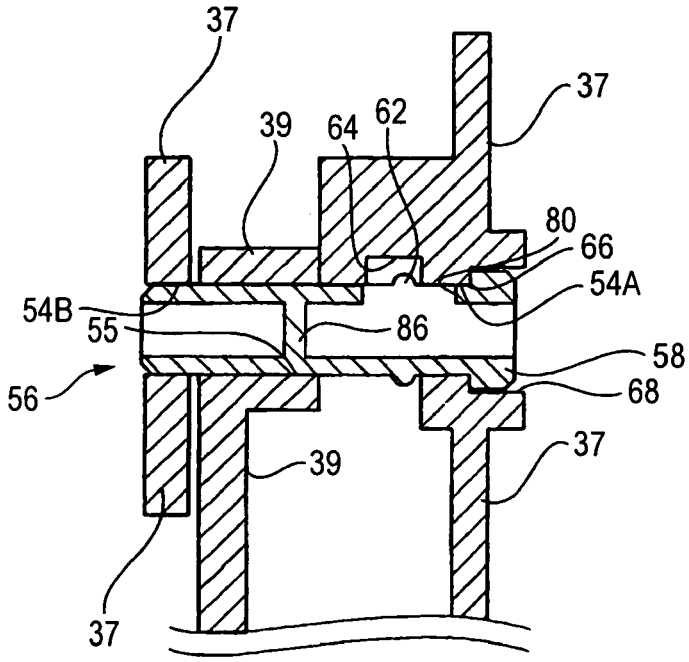

Hereinafter, a process of an embodiment of the method of assembling the process cartridge 40 using the coupling pin 56 according to the fifth embodiment will now be described with reference to the accompanying drawings. In the same manner as the coupling pin 56 of the first embodiment, as shown in FIG. 19A, the coupling pin 56 is first inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not inserted into the first insertion hole 54A and the second insertion hole 55 in a press-fit manner. Further, the convex portion 62 is elastically deformed by being press-fit from the coupling pin insertion hole 66 of the first casing 37, and can pass through the first insertion hole 54A by widening the first insertion hole 54A of the first casing 37. At the time when the convex portion 62 reaches the concave portion 64, as shown in FIG. 19B, the convex portion 62 returns to its original shape, and the convex portion 62 is engaged with the concave portion 64. That is, the convex portion 62 is engaged with the concave portion 64 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to any of the first casing 37 and the second casing 39.

Figure 20A:
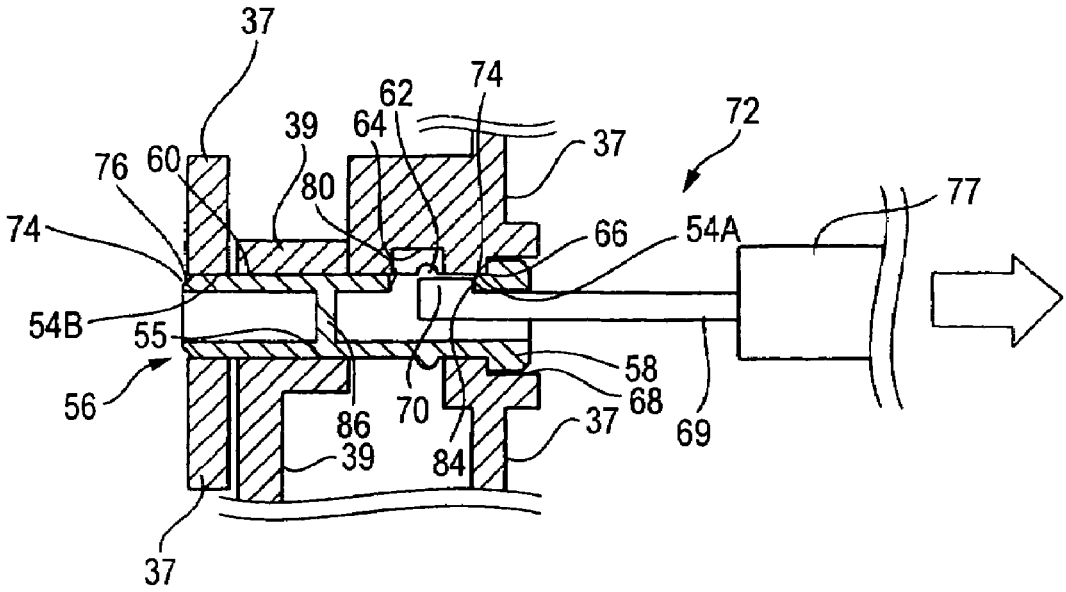
FIGS. 20A and 20B are process views showing a method of disassembling the process cartridge using the coupling pins according to the fifth embodiment of the present invention.

Next, a process of an embodiment of the method of disassembling the process cartridge 40 using the coupling pin 56 according to the fifth embodiment will be described below with reference to the accompanying drawings. In order to extract the coupling pin 56 of the fifth embodiment from the first insertion holes 54A and 54B of the first casing 37 and the second insertion hole 55 of the second casing 39, the insertion rod portion 69 of the jig 72 is first inserted into the hollow portion of the coupling pin 56, the protrusion portion 70 is located in the extraction hole 80, and the jig 72 is pulled out in the extraction direction of the coupling pin 56 (the right direction in FIGS. 20A and 20B) in the handle part 77, as shown in FIG. 20A. Thus, the outer end 74 of the protrusion portion 70 is being engaged with the edge 84 of the extraction hole 80.

Figure 20B:
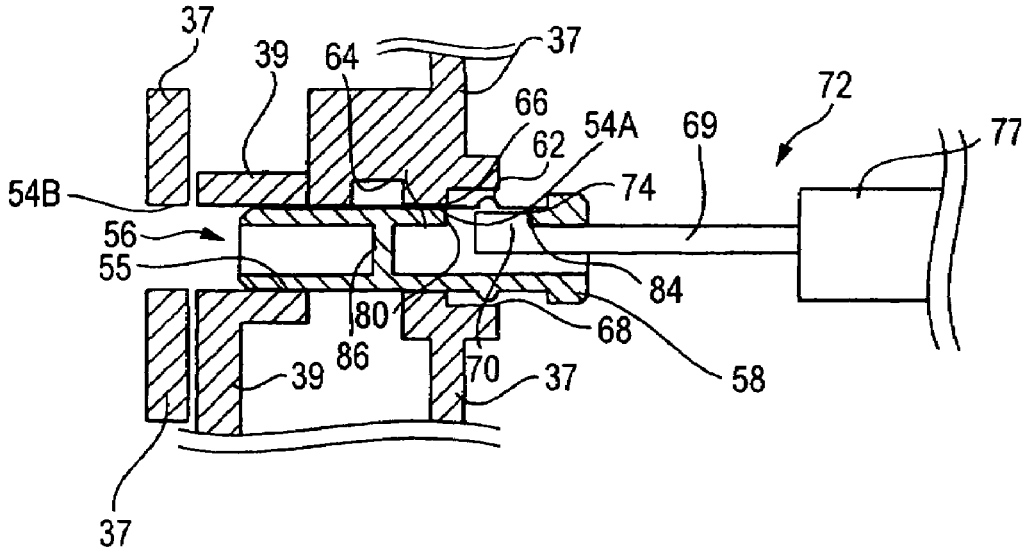
Figure 21D:
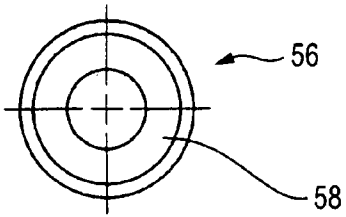
FIGS. 21A to 21E are a side view, a cross-sectional view, a perspective view, a front view and a top view showing another shape of the coupling pin according to a sixth embodiment of the present invention.
Figure 21E:
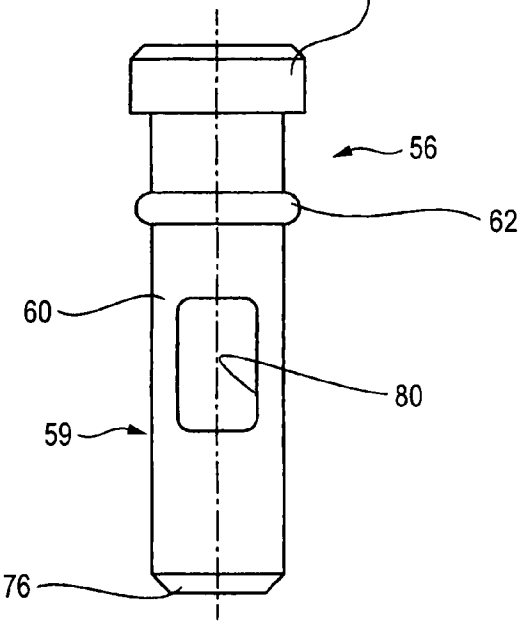
Figure 21A:
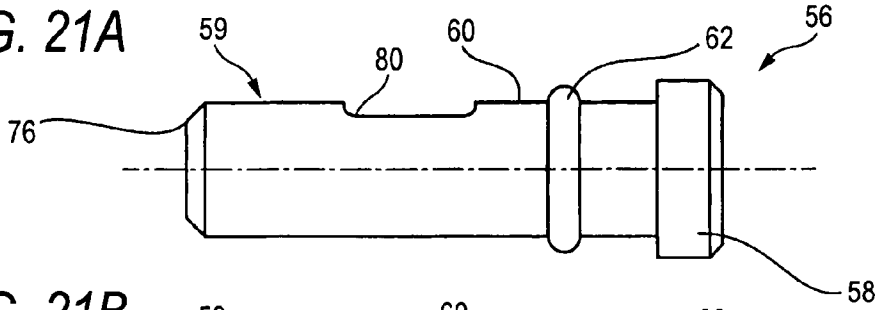
Figure 21B:
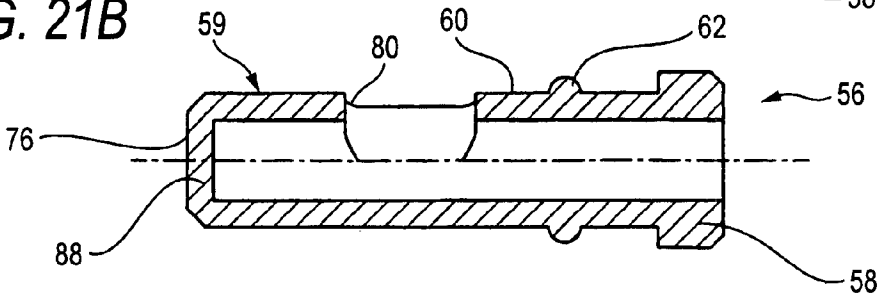
Figure 21C:
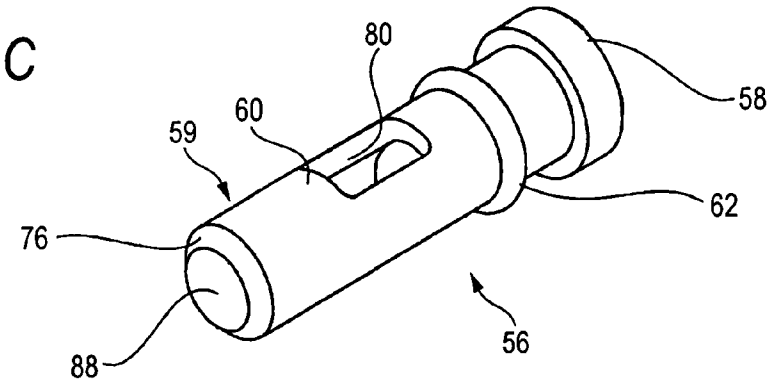

Furthermore, the convex portion 62 is elastically deformed by extracting the coupling pin 56 in the extraction direction (the right direction in FIGS. 20A and 20B) by the jig 72. The convex portion 62 is press-fit into the first insertion hole 54A by widening the first insertion hole 54A, and thus passes through the first insertion hole 54A. Thereafter, at the time when the convex portion 62 reaches the coupling pin head fitting portion 68 outside the first insertion hole 54A as shown in FIG. 20B, the convex portion 62 that has been elastically deformed and the first insertion hole 54A that has widened return to their original shapes. The entire coupling pin 56 is also detached from the first casing 37 and the second casing 39 by extracting the coupling pin 56, and the first casing 37 and the second casing 39 can be separated from each other accordingly.

In this way, by extracting the coupling pin 56 using the jig 72, etc. during recycling, etc., the coupling pin 56 can be easily separated from the first casing 37 and the second casing 39. The efficiency of recycling can be thus enhanced. Further, the coupling pin 56 can not be separated from the first casing 37 and the second casing 39 without using the jig. This prevents the possibility that the first casing 37 and the second casing 39 can be separated from each other when a user extracts the coupling pin 56 inadvertently.

Next, the coupling pin 56 according to a sixth embodiment will now be described.

Further, in the coupling pin 56 of FIGS. 18A to 18E, it has been shown that the wall 86 is formed at the hollow portion. In the coupling pin 56 of the sixth embodiment, however, a wall 88 is formed at the insertion direction front end 76 of the coupling pin 56, as shown in FIGS. 21A to 21E. By doing so, as the strength in the entire length increases compared to that of the coupling pin 56, which is hollow, damage to the coupling pin 56 can be prevented. Moreover, in case of the coupling pin 56 of FIGS. 21A to 21E, the extraction hole 80 is arranged closer at the head portion 58 than the insertion direction front end 76. The extraction hole 80 is, however, disposed approximately at the central portion of the axial direction, in the same manner as the coupling pin 56 of FIGS. 9A to 9E.

Figure 22A:
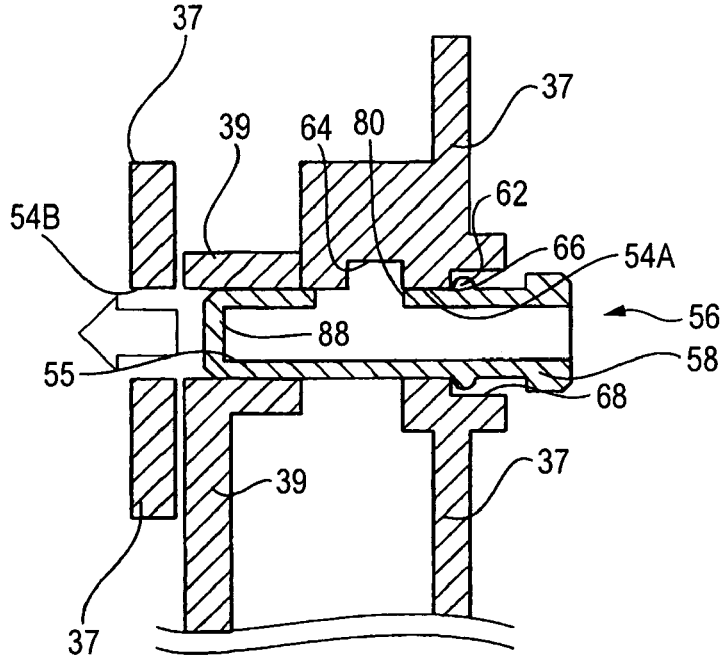
FIGS. 22A and 22B are a side view, a cross-sectional view, a perspective view, a front view and a top view showing the shape of the coupling pin according to the sixth embodiment of the present invention.
Figure 22B:
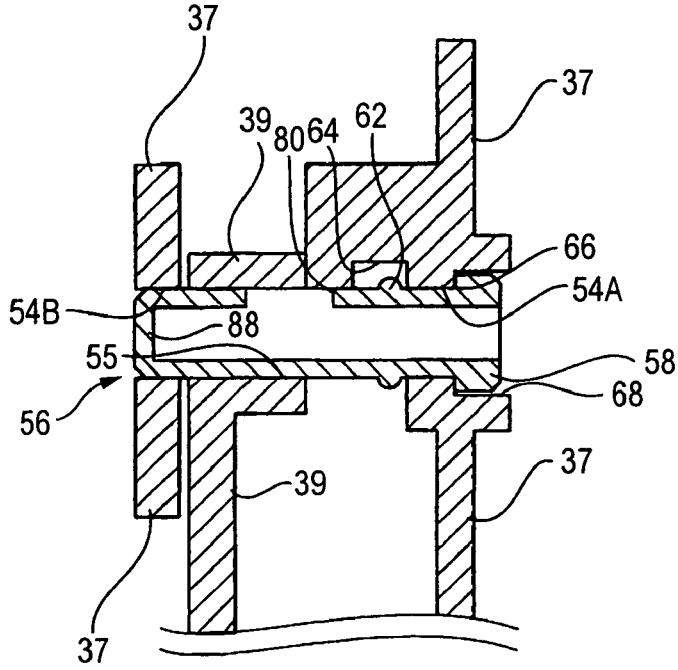

Hereinafter, a process of an embodiment of the method of assembling the process cartridge 40 using the coupling pin 56 according to the sixth embodiment will now be described with reference to the accompanying drawings. In the same manner as the coupling pin 56 of the first embodiment, as shown in FIG. 22A, the coupling pin 56 is inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not inserted into the first insertion hole 54A and the second insertion hole 55 in a press-fit manner. Further, the convex portion 62 is elastically deformed by being press-fit from the coupling pin insertion hole 66 of the first casing 37, and can pass through the first insertion hole 54A by widening the first insertion hole 54A of the first casing 37. At the time when the convex portion 62 reaches the concave portion 64, as shown in FIG. 22B, the convex portion 62 returns to its original shape, and the convex portion 62 is engaged with the concave portion 64. That is, the convex portion 62 is engaged with the concave portion 64 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to any of the first casing 37 and the second casing 39.

Figure 23A:
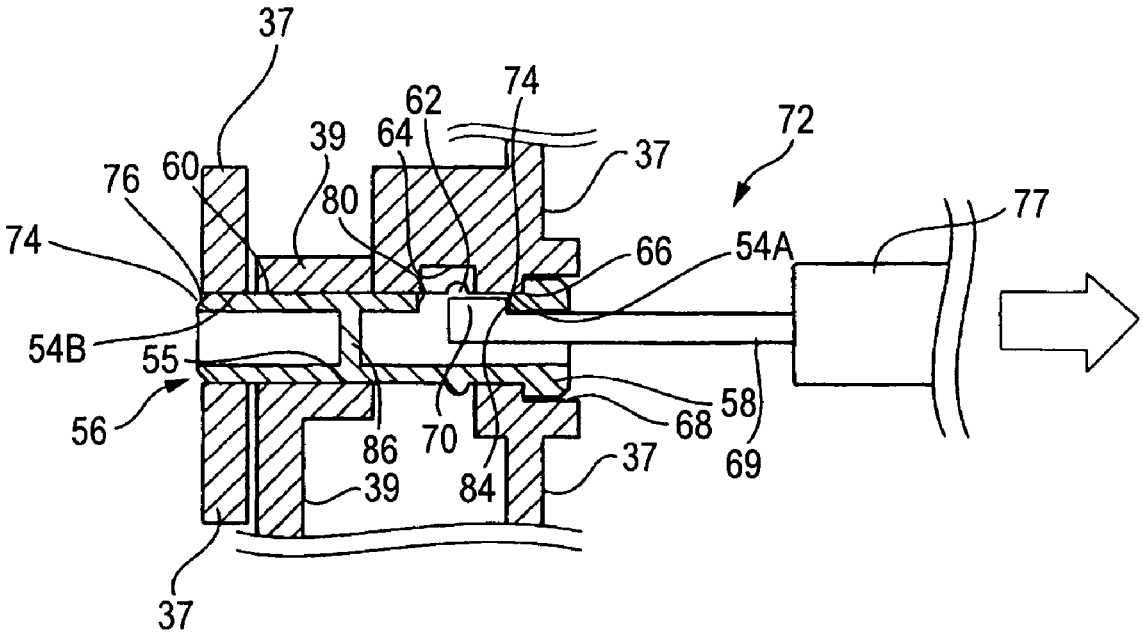
FIGS. 23A and 23B are process views showing a method of disassembling the process cartridge using the coupling pins according to the sixth embodiment of the present invention.

Next, a process of an embodiment of the method of disassembling the process cartridge 40 using the coupling pin 56 according to the sixth embodiment will be described below with reference to the accompanying drawings. In order to extract the coupling pin 56 of the fifth embodiment from the first insertion holes 54A and 54B of the first casing 37 and the second insertion hole 55 of the second casing 39, the insertion rod portion 69 of the jig 72 is first inserted into the hollow portion of the coupling pin 56, the protrusion portion 70 is located in the extraction hole 80, and the jig 72 is pulled out in the extraction direction of the coupling pin 56 (the right direction in FIGS. 23A and 23B) in the handle part 77, as shown in FIG. 23A. Thus, the outer end 74 of the protrusion portion 70 is being engaged with the edge 84 of the extraction hole 80.

Figure 23B:
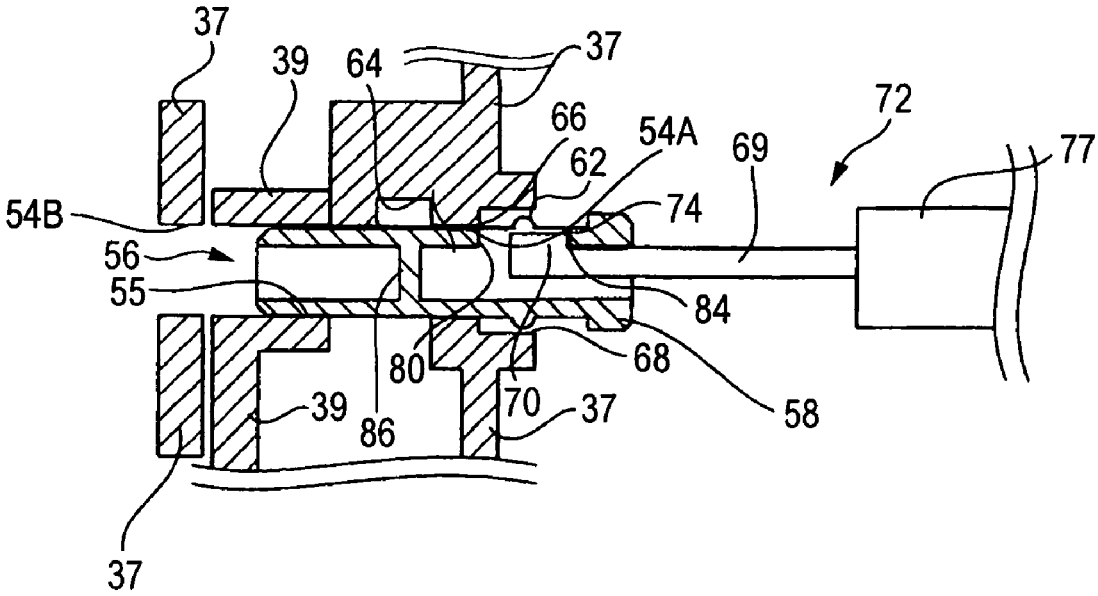

Furthermore, the convex portion 62 is elastically deformed by extracting the coupling pin 56 in the extraction direction by the jig 72. The convex portion 62 is press-fit into the first insertion hole 54A by widening the first insertion hole 54A, and thus passes through the first insertion hole 54A. Thereafter, at the time when the convex portion 62 reaches the coupling pin head fitting portion 68 outside the first insertion hole 54A as shown in FIG. 23B, the convex portion 62 that has been elastically deformed and the first insertion hole 54A that has widened return to their original shapes. The entire coupling pin 56 is also detached from the first casing 37 and the second casing 39 by extracting the coupling pin 56, and the first casing 37 and the second casing 39 can be separated from each other accordingly.

In this way, by extracting the coupling pin 56 using the jig 72, etc. during recycling, etc., the coupling pin 56 can be easily separated from the first casing 37 and the second casing 39. The efficiency of recycling can be thus enhanced. Further, the coupling pin 56 can not be separated from the first casing 37 and the second casing 39 without using the jig. This prevents the possibility that the first casing 37 and the second casing 39 can be separated from each other when a user extracts the coupling pin 56 inadvertently.

Next, the coupling pin 56 according to a seventh embodiment will now be described.

Figure 24:
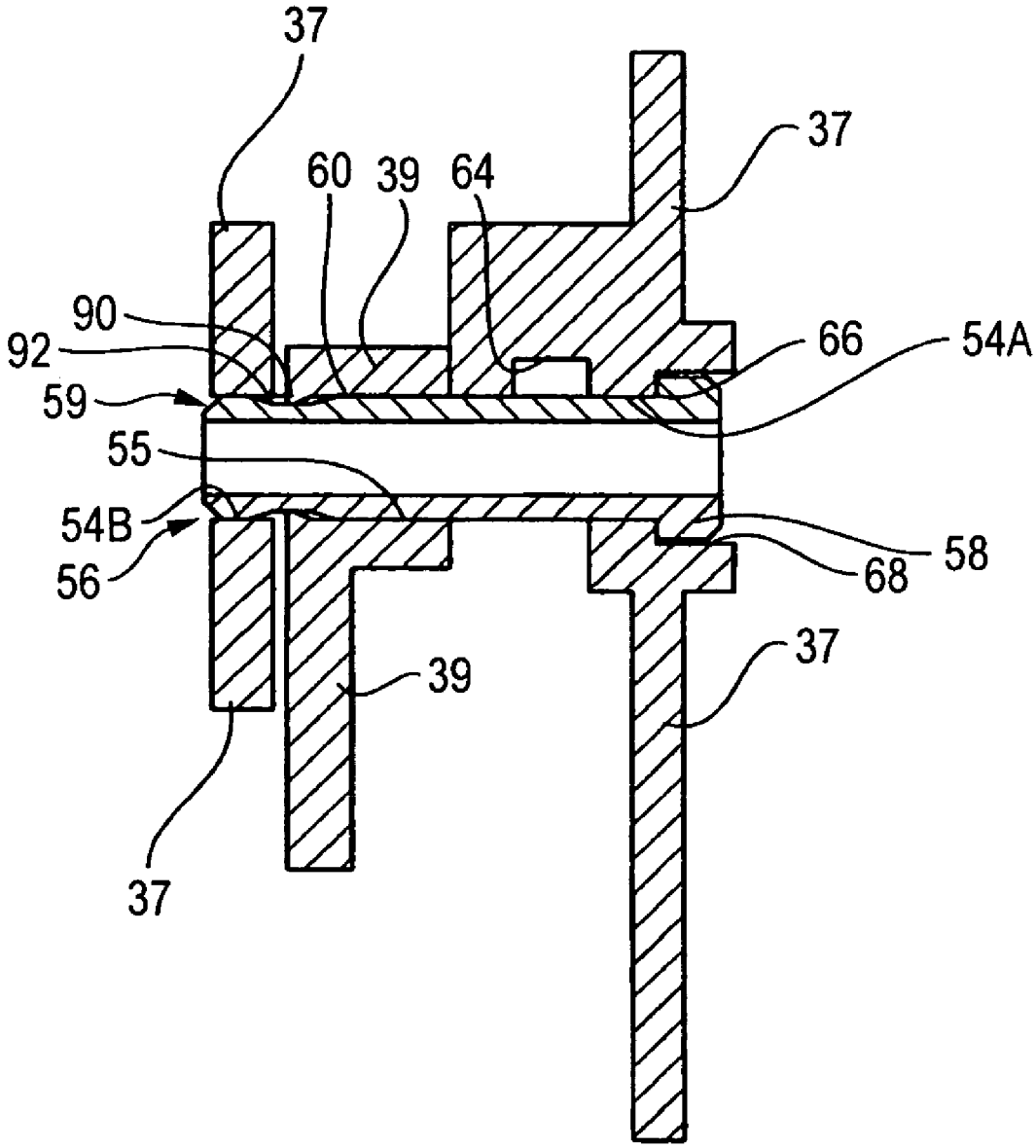
FIG. 24 is a cross-sectional view showing main elements of a process cartridge using coupling pins according to a seventh embodiment of the present invention.

As shown in FIG. 24, in the coupling pin 56 according to the seventh embodiment, a concave portion 92 is formed in the external wall 59. A protrusion portion (convex portion) 90, which has flexibility and is elastically deformable, is formed at a location corresponding to the location of the concave portion 92 of the second insertion hole 55 of the second casing 39.

In this way, as the coupling pin 56 is inserted into the first insertion holes 54A and 54B of the first casing 37 and the second insertion hole 55 of the second casing 39, the protrusion portion 90 is elastically deformed and the second insertion hole 55 widens, so that the concave portion 92 of the coupling pin 56 is engaged with the protrusion portion 90. Furthermore, the protrusion portion 90 may be disposed to go around an inner peripheral side of the second insertion hole 55 of the second casing 39 at a predetermined location of its axial direction, or a plurality of the protrusion portions 90 may be arranged in a distributed manner at a predetermined location of the axial direction of the inner peripheral side of the second insertion hole 55.

Figure 25A:
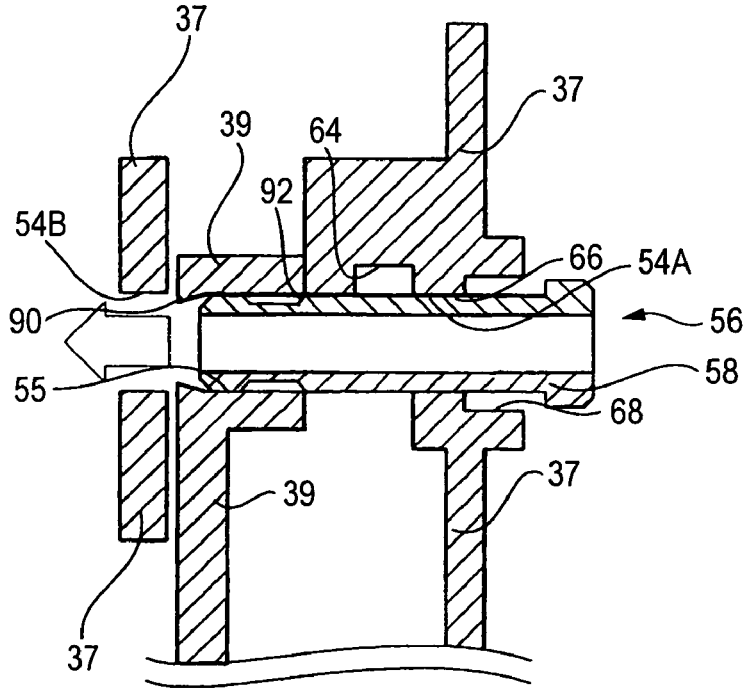
FIGS. 25A and 25B are a side view, a cross-sectional view, a perspective view, a front view and a top view showing the shape of the coupling pin according to the seventh embodiment of the present invention.
Figure 25B:
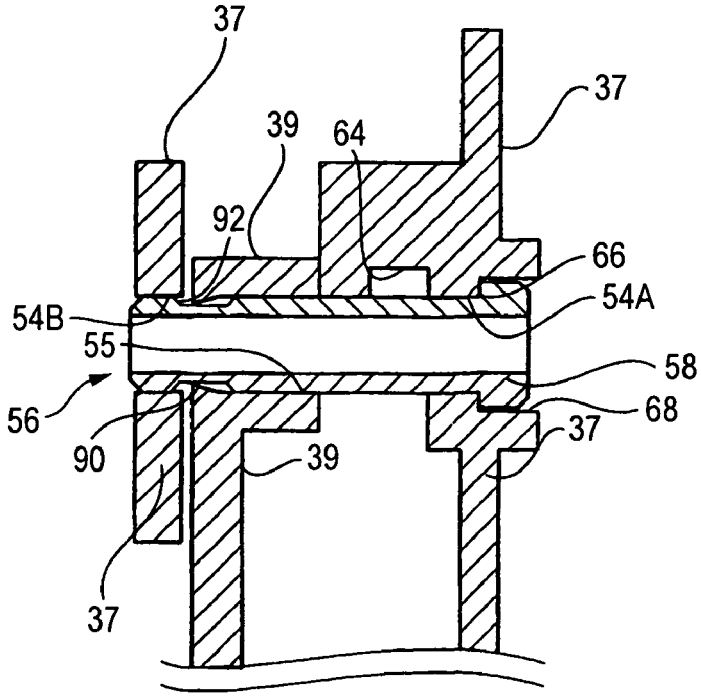

Hereinafter, a process of an embodiment of the method of assembling the process cartridge 40 using the coupling pin 56 according to the seventh embodiment will now be described with reference to the accompanying drawings. In the same manner as the coupling pin 56 of the first embodiment, as shown in FIG. 25A, the coupling pin 56 is inserted into the first insertion hole 54A and the second insertion hole 55 from the coupling pin insertion hole 66, and continues to be inserted until reaching to a location where the concave portion 92 abuts the protrusion portion 90. At this time, the coupling pin 56 is not inserted into the first insertion hole 54A and the second insertion hole 55 in a press-fit manner. Furthermore, as the protrusion portion 90 is elastically deformed by further being press-fit, and the coupling pin 56 is inserted deeper into the first insertion hole 54B by widening the second insertion hole 55 of the second casing 39. At the time when the protrusion portion 90 of the second insertion hole 55 is engaged with the concave portion 92, the protrusion portion 90 returns to its original shape. That is, the protrusion portion 90 is engaged with the concave portion 92 by snap fitting. The coupling pin 56 is attached to the first casing 37 and the second casing 39 in a state where the coupling pin 56 couples the first casing 37 and the second casing 39. By doing so, the coupling pin 56 is not press-fit into the first casing 37 and the second casing 39 in a state being attached to the first casing 37 and the second casing 39. Accordingly, there is no possibility that crack may occur since no load is applied to any of the first casing 37 and the second casing 39.

Figure 26A:
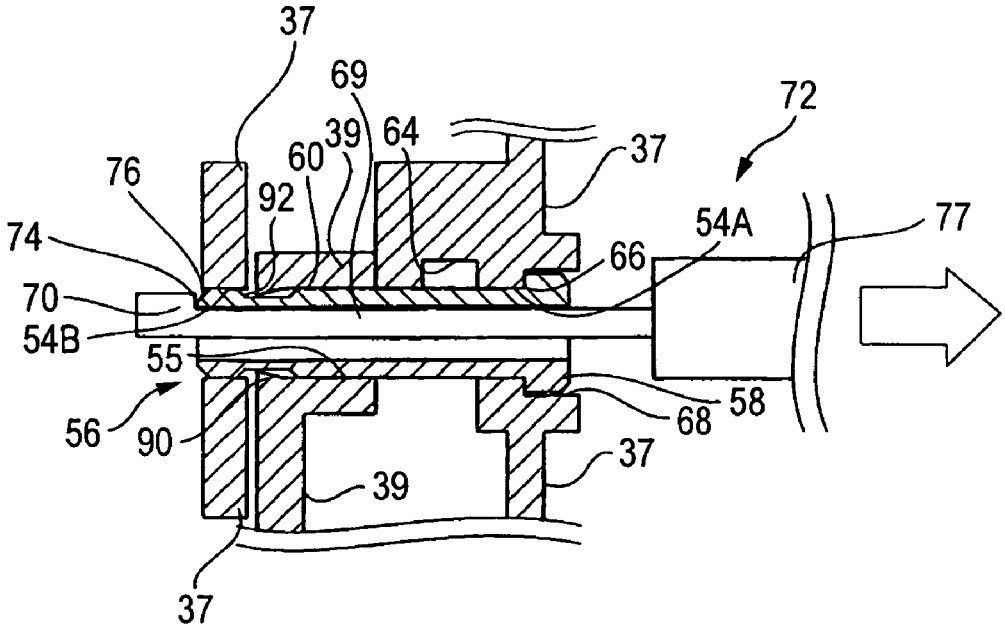
FIGS. 26A and 26B are process views showing a method of disassembling the process cartridge using the coupling pins according to the seventh embodiment of the present invention.

Next, a process of an embodiment of the method of disassembling the process cartridge 40 using the coupling pin 56 according to the seventh embodiment will be described below with reference to the accompanying drawings. In order to extract the coupling pin 56 of the seventh embodiment from the first insertion holes 54A and 54B of the first casing 37 and the second insertion hole 55 of the second casing 39, as shown in FIG. 26A, the insertion rod portion 69 of the jig 72 is first inserted into the hollow portion of the coupling pin 56, and then the outer end 74 of the protrusion portion 70 is brought to abut the insertion direction front end 76 of the coupling pin 56, so that the protrusion portion 70 of the jig 72 is being engaged with the coupling pin 56.

Figure 26B:
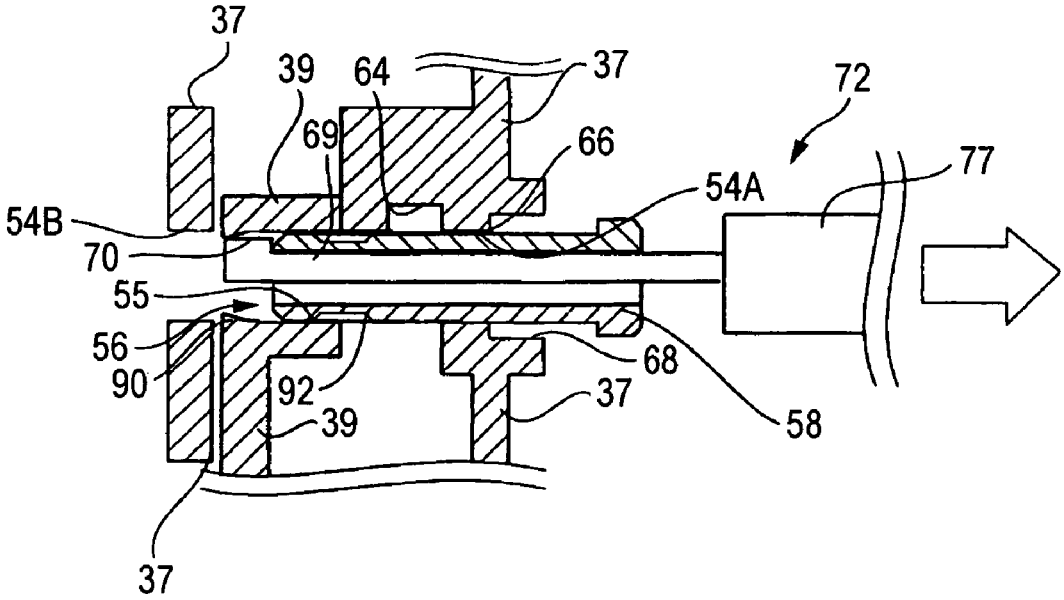

Further, the protrusion portion 90 is elastically deformed by extracting the coupling pin 56 in the extraction direction (the right direction in FIGS. 7A and 7B) by the jig 72, and the coupling pin 56 is press-fit into the second insertion hole 55 having the protrusion portion 90 by widening the second insertion hole 55, and then passes through the second insertion hole 55. Thereafter, as shown in FIG. 26B, at the time when the entire coupling pin 56 reaches the outside of the protrusion portion 90 of the second insertion hole 55, the protrusion portion 90 that has been elastically deformed and the second insertion hole 55 that has widened return to their original shapes. The entire coupling pin 56 is also detached from the first casing 37 and the second casing 39 by extracting the coupling pin 56, and the first casing 37 and the second casing 39 can be separated from each other accordingly.

In this way, by extracting the coupling pin 56 by the jig 72, etc. during recycling, etc., the coupling pin 56 can be easily separated from the first casing 37 and the second casing 39. It is thus possible to enhance the efficiency of recycling. Further, the coupling pin 56 can not be separated from the first casing 37 and the second casing 39 without using the jig. This prevents the possibility that the first casing 37 and the second casing 39 can be separated from each other when a user extracts the coupling pin 56 inadvertently.

Accordingly, even in this case, the same effects as that using the coupling pin 56 having the convex portion 62, which is shown in FIGS. 3 to 23, can be obtained. In addition, in a state where the coupling pin 56 is attached to the first casing 37 and the second casing 39, the coupling pin 56 is not press-fit into the first casing 37 and the second casing 39. Accordingly, since any load is not applied to the first casing 37 and the second casing 39, there is no possibility that crack may occur. Moreover, it has been described that the protrusion portion 90 is disposed in the second insertion hole 55 in the present embodiment. However, the protrusion portion 90 may be disposed in the first insertion hole 54A or 54B, or may be disposed at both sides of the first insertion hole and the second insertion hole 55.

Hereinafter, the coupling pin 56 according to an eighth embodiment will now be described.

Figure 27:
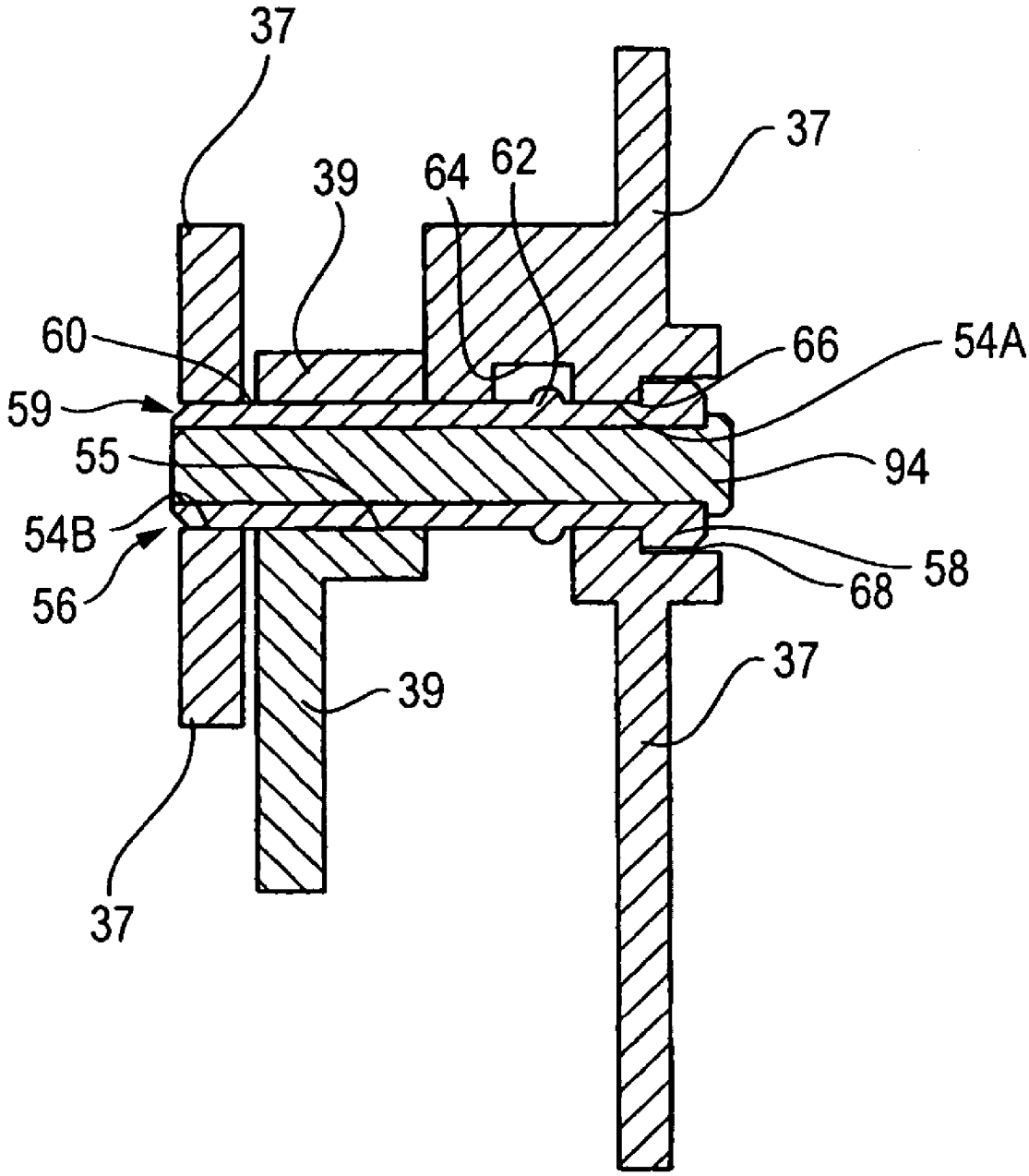
FIG. 27 is a cross-sectional view showing main elements of a process cartridge using coupling pins according to an eighth embodiment of the present invention.

In the coupling pin 56 according to the eighth embodiment, a core 94 is mounted in a hollow portion of the coupling pin 56 along the entire length of the axial direction by slightly being press-fit, as shown in FIG. 27. This enables the hollow coupling pin 56 to have a sufficient strength. At this time, the core 94 may be formed of the same material as that of the coupling pin 56, or a material different from that of the coupling pin 56. The core 94 is for enhancing the strength of the coupling pin 56, thus it may be attached to the coupling pin 56 in a state slightly being press-fit. Since load applied to the coupling pin 56 is minimal, there is no possibility that the coupling pin 56 can be damaged. In this case, furthermore, a convex portion 62 which is elastically deformable is disposed on the outer peripheral side 60 of the coupling pin 56.

A process of an embodiment of the method of assembling the process cartridge 40 using the coupling pin 56 according to the eighth embodiment will now be described with reference to the accompanying drawings. Further, when the coupling pin 56 according to the eighth embodiment is attached to the first casing 37 and the second casing 39, it is attached to the first casing 37 and the second casing 39 with the core 94 being slightly press-fit thereto.

Figure 28A:
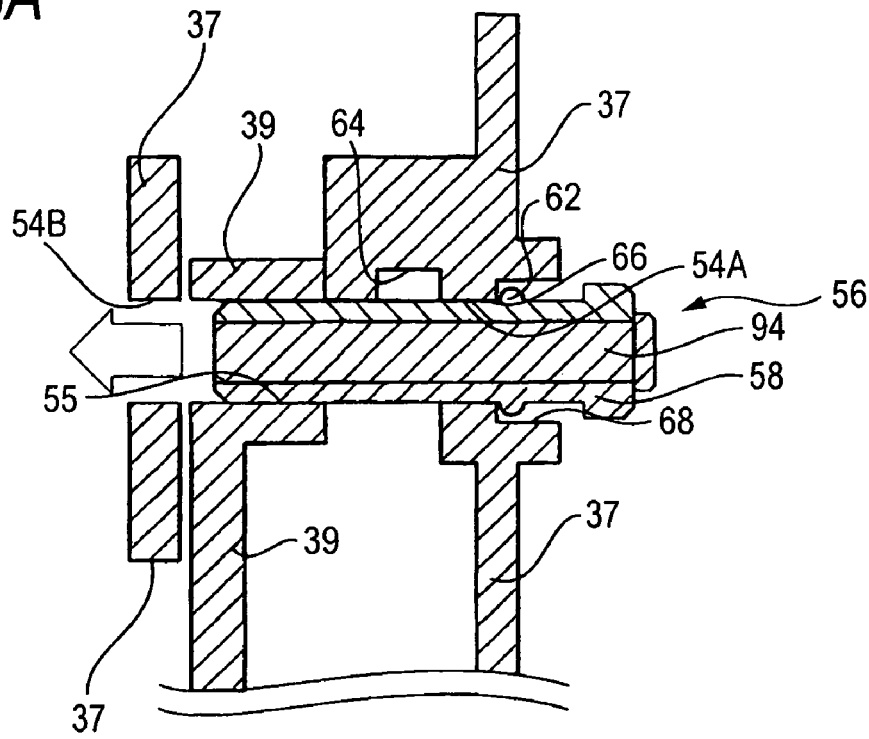
FIGS. 28A and 28B are a side view, a cross-sectional view, a perspective view, a front view and a top view showing the shape of the coupling pin according to the eighth embodiment of the present invention.
Figure 28B:
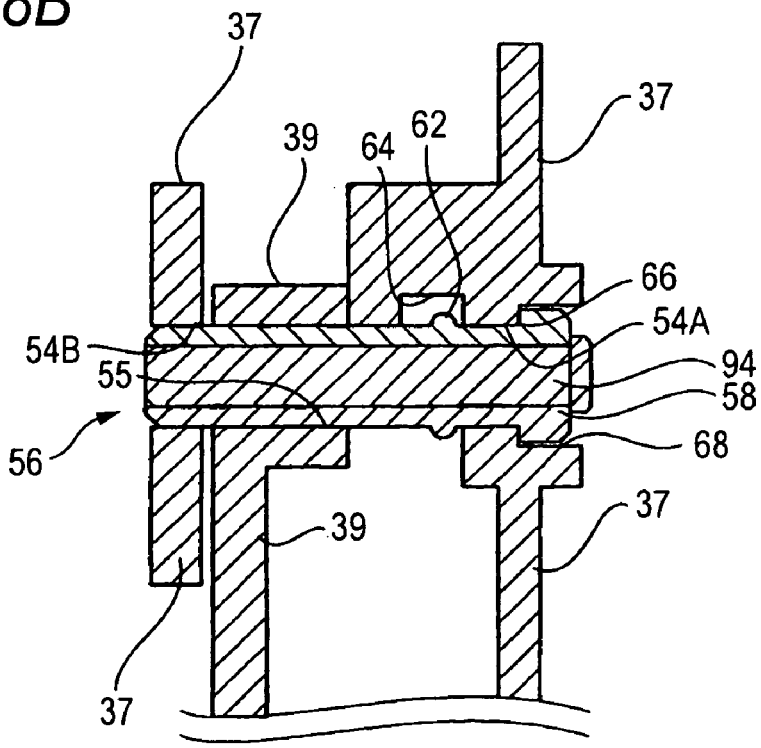

Therefore, in the coupling pin 56 having the core 94 slightly press-fitted thereto according to the eighth embodiment, as shown in FIG. 28A, in the same manner as the case of the coupling pin 56 according to the first embodiment, the coupling pin 56 is inserted into the first insertion hole 54A and the second insertion hole 55 from the coupling pin insertion hole 66, and continues to be inserted until reaching a location where the convex portion 62 abuts the coupling pin insertion hole 66. At this time, the coupling pin 56 is not attached to the first insertion hole 54A and the second insertion hole 55 in a press-fit manner. Moreover, the convex portion 62 is elastically deformed by being press-fit from the coupling pin insertion hole 66 of the first casing 37, and passes through the first insertion hole 54A by widening the first insertion hole 54A of the first casing 37. Thereafter, at the time when the convex portion 62 reaches the concave portion 64, as shown in FIG. 28B, the convex portion 62 returns to its original shapes, and the convex portion 62 is engaged with the concave portion 64. That is, the convex portion 62 is engaged with the concave portion 64 by snap fitting. The coupling pin 56 is also attached to the first casing 37 and the second casing 39 with the first casing 37 and the second casing 39 being coupled by the coupling pin 56. In addition, after the coupling pin 56 is attached to the first casing 37 and the second casing 39, the core 94 is slightly press-fit into the hollow portion of the coupling pin 56.

In this way, in a state being attached to the first casing 37 and the second casing 39, the coupling pin 56 is not attached to them in a press-fit manner. Thus, since any load is not applied to any of the first casing 37 and the second casing 39, there is no possibility that crack may occur. Further, as the core 94 is attached to the hollow portion of the coupling pin 56, which provides sufficient strength and does not cause damage.

Next, a process of an embodiment of the method of disassembling the process cartridge 40 using the coupling pin 56 according to the eighth embodiment will be described below. In order to extract the coupling pin 56 of the eighth embodiment from the first insertion holes 54A and 54B of the first casing 37 and the second insertion hole 55 of the second casing 39, the core 94, which is slightly press-fit into the hollow portion of the coupling pin 56, is first extracted. Thereafter, in the same manner as the disassembling method using the coupling pin 56 according to the first embodiment, as shown in FIG. 7A, the insertion rod portion 69 of the jig 72 is then inserted into the hollow portion of the coupling pin 56, and the outer end 74 of the protrusion portion 70 is brought to abut the insertion direction front end 76 of the coupling pin 56, so that the protrusion portion 70 of the jig 72 is being engaged with the coupling pin 56.

In addition, the convex portion 62 is elastically deformed by extracting the coupling pin 56 in the extraction direction (the right direction in FIGS. 7A and 7B) by the jig 72. The convex portion 62 is press-fit into the first insertion hole 54A by widening the first insertion hole 54A, and thus passes through the first insertion hole 54A. Thereafter, at the time when the convex portion 62 reaches the coupling pin head fitting portion 68 outside the first insertion hole 54A as shown in FIG. 7B, the convex portion 62 that has been elastically deformed and the first insertion hole 54A that has widened return to their original shapes. The entire coupling pin 56 is also detached from the first casing 37 and the second casing 39 by extracting the coupling pin 56, and the first casing 37 and the second casing 39 can be separated from each other accordingly.

In this way, by extracting the coupling pin 56 using the jig 72, etc. during recycling, etc., the coupling pin 56 can be easily separated from the first casing 37 and the second casing 39. Thus, the efficiency of recycling can be enhanced. Further, the coupling pin 56 can not be separated from the first casing 37 and the second casing 39 without using the jig. This prevents the possibility that the first casing 37 and the second casing 39 can be separated from each other when a user extracts the coupling pin 56 inadvertently.

Hereinafter, the coupling pin 56 according to a ninth embodiment will now be described.

Figure 29:
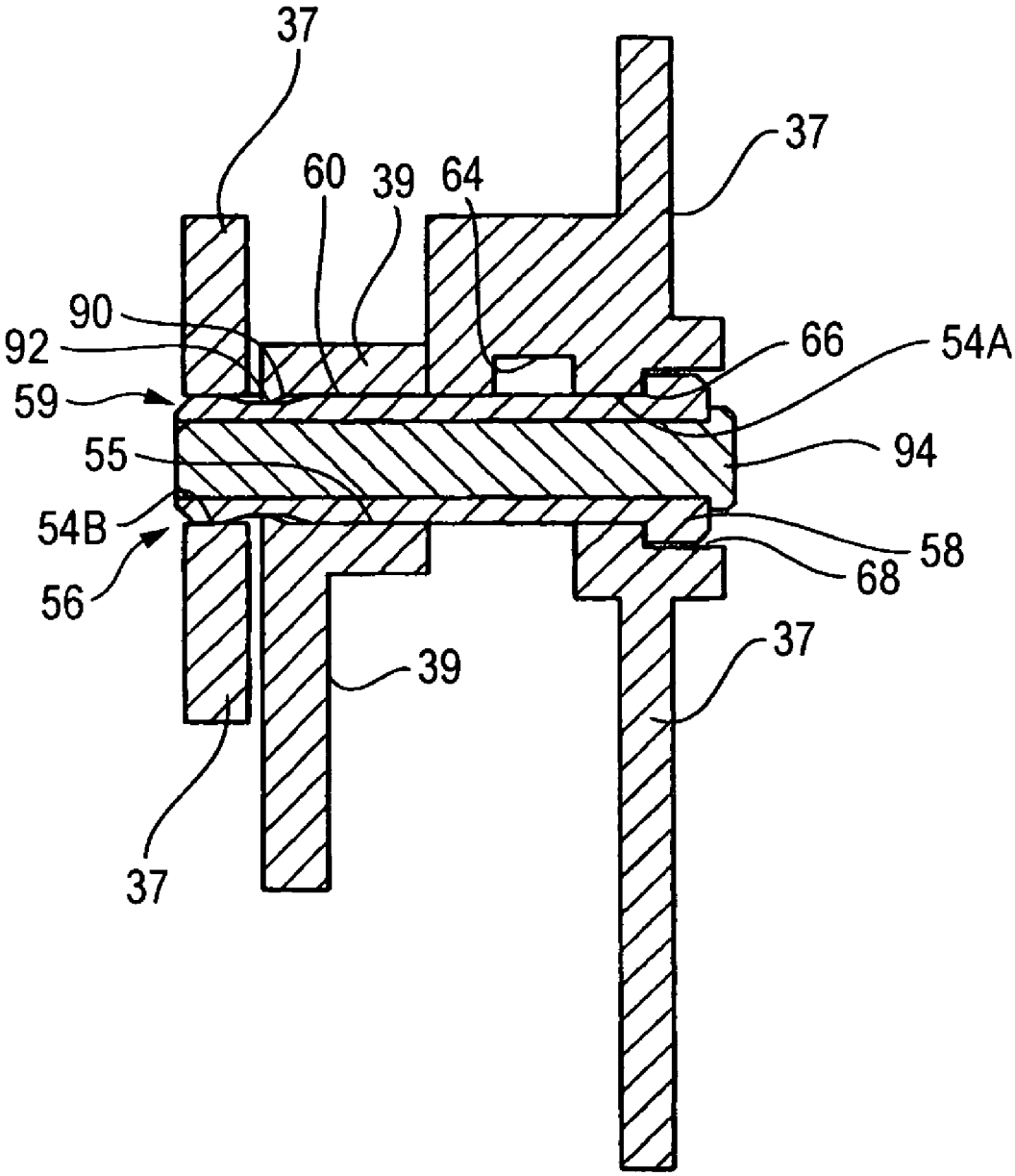
FIG. 29 is process view showing a method of disassembling the process cartridge using the coupling pins according to a ninth embodiment of the present invention.

As shown in FIG. 29, in the coupling pin 56 according to the ninth embodiment, the concave portion 92 is formed in the external wall 59. The protrusion portion (convex portion) 90, which has flexibility and is elastically deformable, is formed at a location corresponding to the location of the concave portion 92 of the second insertion hole 55 of the second casing 39. The core 94 is also attached to the hollow portion of the coupling pin 56 by slightly being press-fit, as shown in FIG. 27. This enables the hollow coupling pin 56 to have a sufficient strength. At this time, the core 94 may be formed of the same material as that of the coupling pin 56, or a material different from that of the coupling pin 56. Because the core 94 is for enhancing the strength of the coupling pin 56, thus it can be attached to the coupling pin 56 in a state slightly being press-fit. Since load applied to the coupling pin 56 is minimal, there is no possibility that the coupling pin 56 can be damaged.

Hereinafter a process of an embodiment of the method of assembling the process cartridge 40 using the coupling pin 56 according to the ninth embodiment will now be described with reference to the accompanying drawings. Further, when the coupling pin 56 according to the ninth embodiment is attached to the first casing 37 and the second casing 39, it is attached to the first casing 37 and the second casing 39 with the core 94 being slightly press-fit thereto.

Figure 30A:
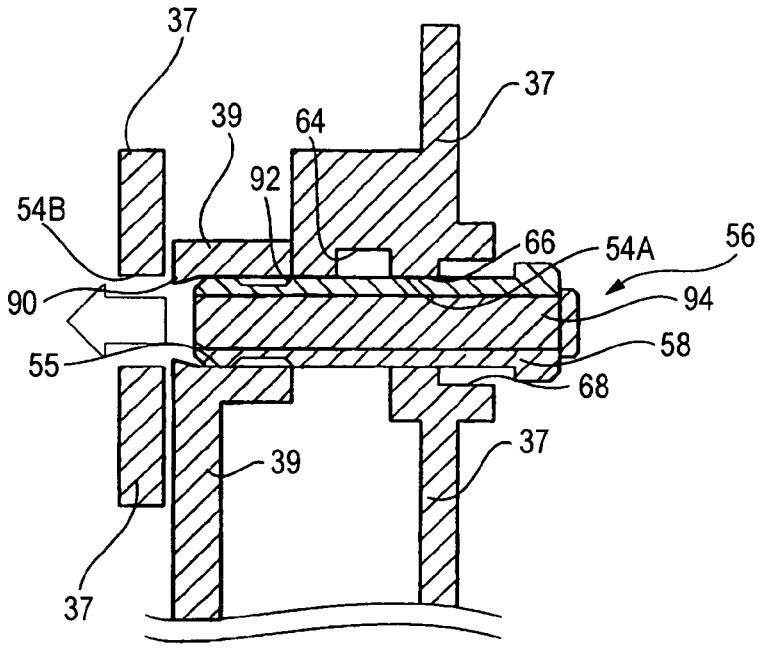
FIGS. 30A and 30B are cross-sectional views showing main elements of a process cartridge using coupling pins according to the ninth embodiment of the present invention.
Figure 30B:
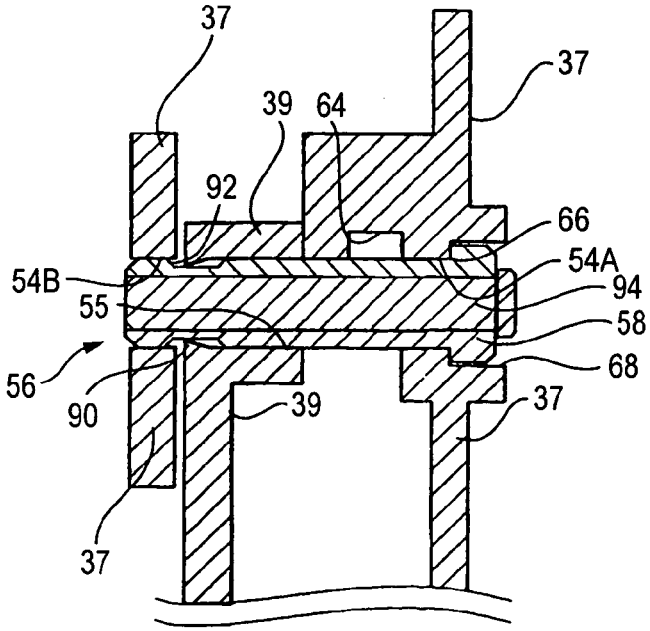

Therefore, in the coupling pin 56 with the core 94 slightly being press-fitted thereto according to the ninth embodiment, in the same manner as that of the coupling pin 56 according to the first embodiment, as shown in FIG. 30A, the coupling pin 56 is inserted into the first insertion hole 54A and the second insertion hole 55 from the coupling pin insertion hole 66, and continues to be inserted until reaching to a location where the concave portion 92 abuts the protrusion portion 90. At this time, the coupling pin 56 is not inserted into the first insertion hole 54A and the second insertion hole 55 in a press-fit manner. Furthermore, the protrusion portion 90 is elastically deformed by being further press-fit, and the coupling pin 56 is inserted deeper into the first insertion hole 54B by widening the second insertion hole 55 of the second casing 39. At the time when the protrusion portion 90 of the second insertion hole 55 is engaged with the concave portion 92, as shown in FIG. 30B, the protrusion portion 90 returns to its original shape. That is, the protrusion portion 90 is engaged with the concave portion 92 by snap fitting. The coupling pin 56 is also attached to the first casing 37 and the second casing 39 in a state where the first casing 37 and the second casing 39 are coupled by the coupling pin 56.

In this way, in a state being attached to the first casing 37 and the second casing 39, the coupling pin 56 is not attached to them in a press-fit manner. Thus, since any load is not applied to any of the first casing 37 and the second casing 39, there is no possibility that crack may occur. Further, as the core 94 is attached to the hollow portion of the coupling pin 56, which provides sufficient strength and does not cause damage.

A process of an embodiment of the method of disassembling the process cartridge 40 using the coupling pin 56 according to the ninth embodiment will be described below with reference to the accompanying drawings. In order to extract the coupling pin 56 of the ninth embodiment from the first insertion holes 54A and 54B of the first casing 37 and the second insertion hole 55 of the second casing 39, the core 94, which is slightly press-fit into the hollow portion of the coupling pin 56, is first extracted. Thereafter, in the same manner as the disassembling method using the coupling pin 56 according to the seventh embodiment, the insertion rod portion 69 of the jig 72 is inserted into the hollow portion of the coupling pin 56, and the outer end 74 of the protrusion portion 70 is brought to abut the insertion direction front end 76 of the coupling pin 56, so that the protrusion portion 70 of the jig 72 is being engaged with the coupling pin 56, as shown in FIG. 26A.

Further, the protrusion portion 90 is elastically deformed by extracting the coupling pin 56 in the extraction direction (the right direction in FIGS. 26A and 26B) by the jig 72. The coupling pin 56 is thus press-fit into the second insertion hole 55 having the protrusion portion 90 by widening the second insertion hole 55, and then passes through the second insertion hole 55. Thereafter, as shown in FIG. 26B, at the time when the entire coupling pin 56 reaches the coupling pin head fitting portion 68 outside the protrusion portion 90 of the second insertion hole 55, the protrusion portion 90 that has been elastically deformed and the second insertion hole 55 that has widened return to their original shapes. The entire coupling pin 56 is also detached from the first casing 37 and the second casing 39 by extracting the coupling pin 56, and the first casing 37 and the second casing 39 can be separated from each other accordingly.

In this way, by extracting the coupling pin 56 using the jig 72, etc. during recycling, etc., the coupling pin 56 can be easily separated from the first casing 37 and the second casing 39. It is thus possible to enhance the efficiency of recycling. Further, the coupling pin 56 can not be separated from the first casing 37 and the second casing 39 without using the jig. This prevents the possibility that the first casing 37 and the second casing 39 can be separated from each other when a user extracts the coupling pin 56 inadvertently.

As described above, according to the aspect of the present invention, in a state where a coupling pin is attached to a first casing and a second casing, the coupling pin is engaged with at least one of the first casing and the second casing. Thus, abnormalities such as crack, which is caused by press-fitting the coupling pin into the first casing and the second casing, do not occur. Therefore, the present invention can be applied to a process cartridge of a structure that facilitates recycling, and assembling method and disassembling method thereof.

Second Embodiment

A process cartridge, and an assembling method and a disassembling method thereof include configurations of the first embodiment that are explained by FIGS. 1 to 30. Therefore, in this embodiment, explanations of the overlapped configurations are omitted.

Figure 31:
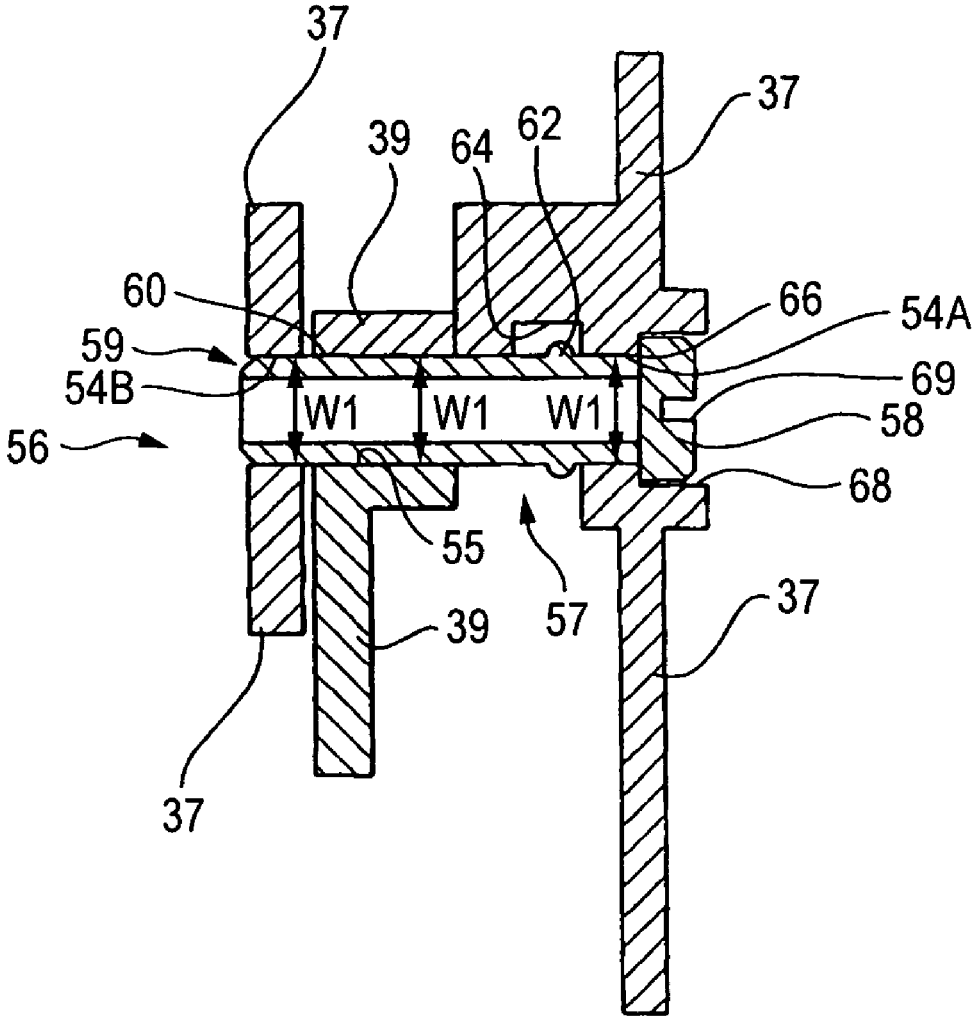
FIG. 31 is a cross-sectional view of main elements of the process cartridge according to an embodiment of the present invention.
Figure 32D:
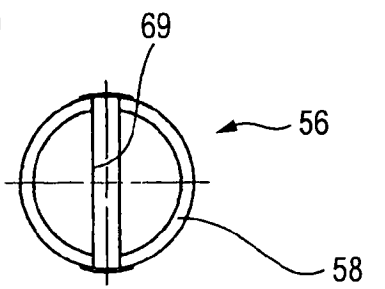
FIGS. 32A to 32E are a side view, a cross-sectional view, a perspective view, a front view and a top view showing the shape of a coupling pin according to a first embodiment of the present invention.
Figure 32E:
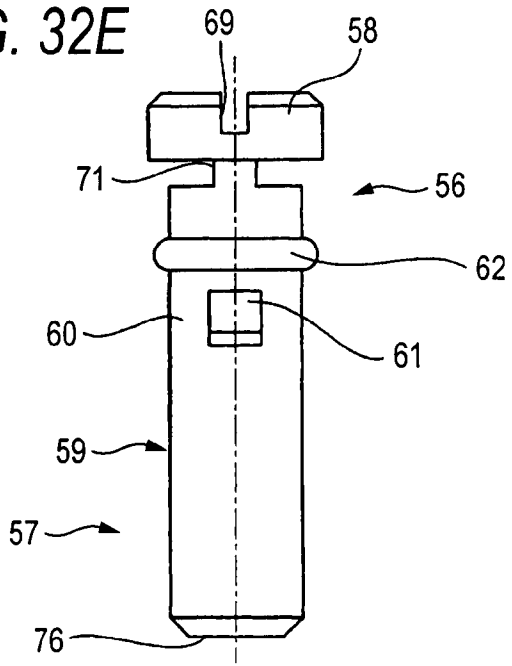
Figure 32A:
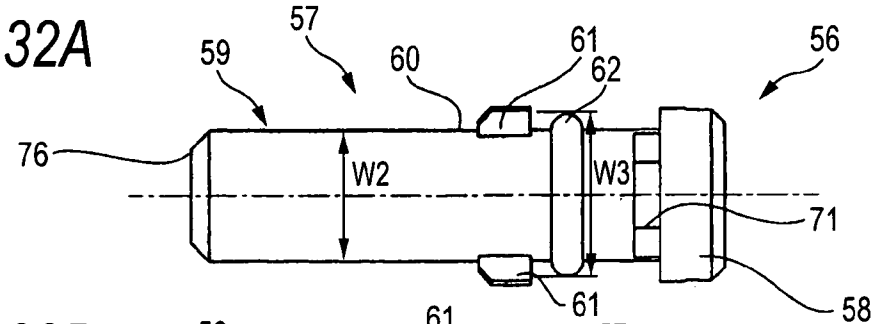
Figure 32B:
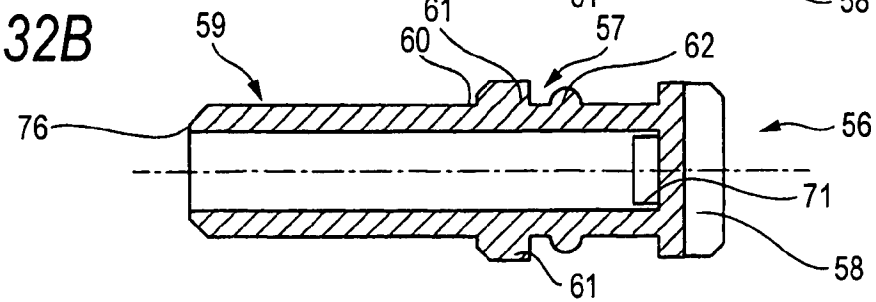
Figure 32C:
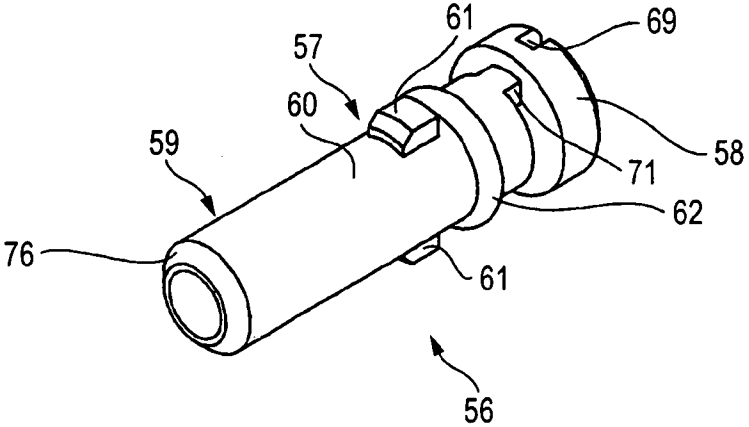

FIG. 31 is a cross-sectional view showing integral elements of a combined portion of the process cartridge 40, in which the first casing 37 and the second casing 39 are combined together by the coupling pins 56 according to an embodiment. There is shown, in FIG. 3, that the first casing 37 and the second casing 39 are coupled by means of the coupling pins 56 in a state where one portion of the second casing 39 is inserted between two portions of the first casing 37 from both sides. The second insertion hole 55 of the second casing 39 is disposed between first insertion holes 54A and 54B of the first casing 37. In this case, the first insertion holes 54A and 54B, and the second insertion hole 55 have a same inside diameter W1.

Hereinafter, a coupling pin 56 of a first embodiment of a process cartridge according to the present invention will now be described. The coupling pin 56 can be formed of, e.g., resin. FIGS. 32A to 32E are a side view, a cross-sectional view, a perspective view, a front view and a top view of the coupling pins 56 according to the first embodiment. As shown in the cross-sectional view of FIG. 32B, the coupling pin 56 of the present embodiment includes a coupling pin body 57 having a hollow and approximately cylindrical shape along the entire length in an axial direction. A solid head portion 58 having an outside diameter greater than other portions is integrally formed with the coupling pin body 57 at a rear end of the coupling pin 56 in its insertion direction. Furthermore, in the coupling pin 56, a connection 71 which is formed in a slit shape is arranged at two locations of a boundary between the coupling pin body 57 and the head portion 58. The head portion 58 can be easily screw-cut from the coupling pin body 57 with the connection 71 being interposed therebetween. Thus, the head portion 58 can be easily cut off from the coupling pin body 57. A convex portion 62, which has a hemispherical shape as its cross section in the axial direction and is elastically deformable, is formed at a portion of the outer peripheral side 60 of a cylindrical external wall 59 of the coupling pin body 57 to go around the outer peripheral side 60 at a predetermined location in the axial direction of the coupling pin body 57. The convex portion 62 is flexible. and elastically deformable and can have any kind of a shape if the coupling pin 56 is kept from being pulled out. For example, the convex portion 62 can be formed of resin and integrated with other portions of the coupling pin 56.

Furthermore, in the coupling pin 56 of the present embodiment, a pair of protrusion 61 is arranged closer at an insertion direction front end 76 than the convex portion 62 of the outer peripheral side 60 of the coupling pin body 57. The protrusion 61 can be formed of, e.g., resin and integrated with other portions of the coupling pin 56. Meanwhile, as shown in the perspective view of FIG. 33 and the side view of FIG. 34, an extraction portion 63 through which the protrusion 61 goes out and then reaches a concave portion 64 is disposed in a first insertion hole 54A of a first casing 37. Two anti-rotation portions 65 are formed in the concave portion 64, so that the coupling pin body 57 is hindered from rotating as a side face 67 of the protrusion 61 abuts the anti-rotation portions 65. By doing so, when the coupling pin 56 mounted in the first casing 37 and the second casing 39 is separated therefrom, in the case that the head portion 58 is rotatably cut off from the coupling pin body 57 by screw-cutting after inserting a tool such as a plus driver or a minus driver into a tool engagement groove 69 formed in the head portion 58, the coupling pin body 57 is stopped from rotating as the protrusion 61 abuts the anti-rotation portions 65. Accordingly, since the coupling pin body 57 does not rotate together with the head portion 58, the head portion 58 can be screw-cut in a convenient manner.

Moreover, as shown in FIG. 31, when the coupling pin 56 is inserted into the first insertion holes 54A and 54B formed in the first casing 37 and the second insertion hole 55 formed in the second casing 39, the convex portion 62 is press-fit into the first insertion hole 54A of the first casing 37, and is then engaged with the concave portion 64. In other words, the convex portion 62 is engaged with the concave portion 64 by snap fitting. Though not shown in FIG. 31, when the convex portion 62 is press-fit into the first insertion hole 54A as described above, the protrusion 61 passes through the extraction portion 63 disposed in the first insertion hole 54A, and then reach the concave portion 64. At this time, the concave portion 64 can have any kind of a shape if it is engaged with the convex portion 62 and the coupling pin body 57 is thus prevented from rotating. In FIG. 31, a top of the concave portion 64 is formed in a groove shape and a bottom in an opened state. For instance, however, the entire concave portion 64 can be formed in a groove shape.

Moreover, a coupling pin head fitting portion 68 having the head portion 58 of the coupling pin 56 fitted there into is disposed outside of the coupling pin insertion hole 66 of the first insertion hole 54A of the first casing 37. As the head portion 58 is fitted into the coupling pin head fitting portion 68, the head portion 58 of the coupling pin 56 is kept from protruding from the first casing 37, and the coupling pin 56 is prevented from being inadvertently pulled out by a user. It is therefore possible to prevent the first casing 37 and the second casing 39 from being separated from each other in occasions other than recycling.

In addition, as the convex portion 62 of the coupling pin 56 is engaged with the concave portion 64, an outside diameter W2 (refer to FIGS. 32A to 32E) of portions other than the convex portion 62 of the external wall 59 of the coupling pin body 57 is approximately the same as an inside diameter W1 of the first insertion holes 54A and 54B formed in the first casing 37 and the second insertion hole 55 formed in the second casing 39. It also has a diameter that can be inserted into the first insertion holes 54A and 54B and the second insertion hole 55 in a state where the coupling pin 56 does not apply load (pressure) to the first casing 37 and the second casing 39. Furthermore, an outside diameter W3 of the convex portion 62 of the coupling pin 56, which has not been elastically deformed, is greater than the inside diameter W1 of the first insertion hole 54A. The outside diameter W3 also has a diameter that can be inserted into the first insertion hole 54A as the convex portion 62 is elastically deformed and the first insertion hole 54A widens.

In this way, after being inserted into the first insertion holes 54A and 54B formed in the first casing 37 and the second insertion hole 55 formed in the second casing 39, the coupling pin 56 is engaged with at least one of the first casing 37 and the second casing 39 without being press-fit into them. Accordingly, since the coupling pin 56 is constructed not to apply any load to the first casing 37 and the second casing 39, abnormalities such as crack do not occur.

A process of an embodiment of a method of assembling the process cartridge 40 using the coupling pin 5 according to the first embodiment will now be described with reference to the accompanying drawings.

Figure 33:
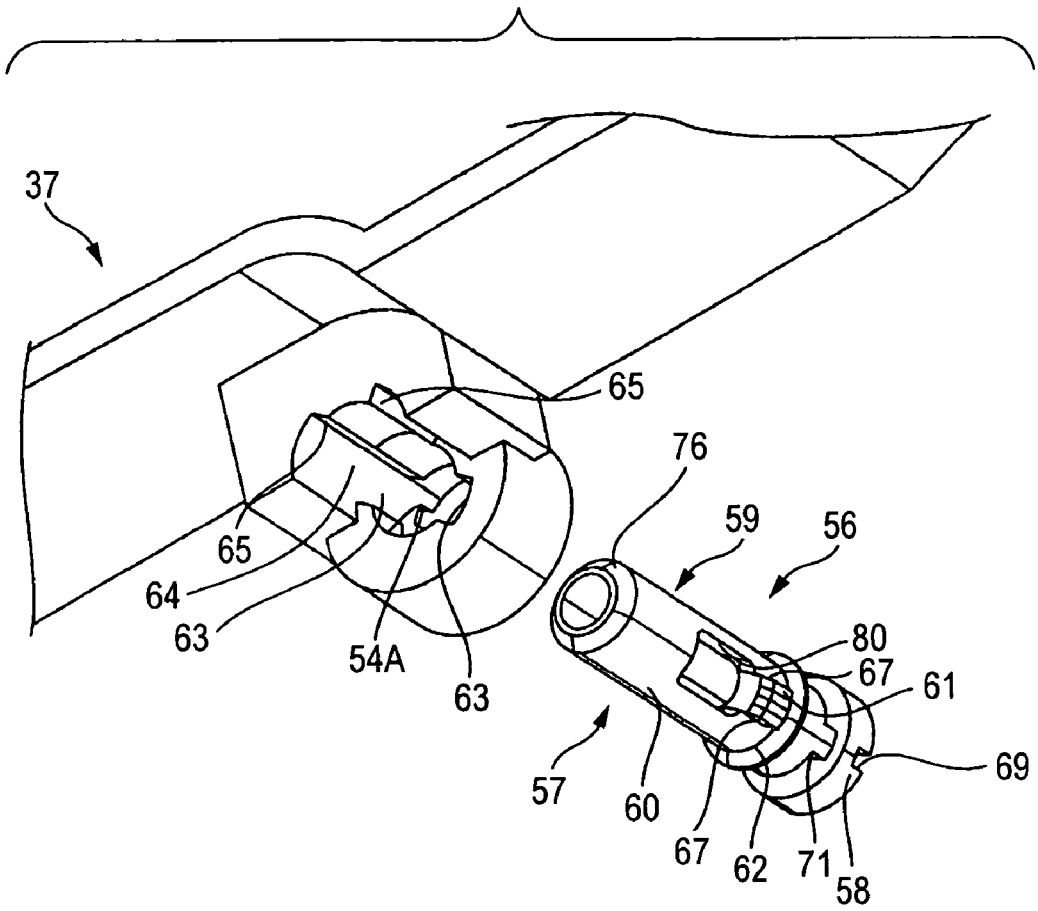
FIG. 33 is a perspective view showing a state where a first casing of the coupling pin is inserted into a first insertion hole according to the first embodiment of the present invention.
Figure 34:
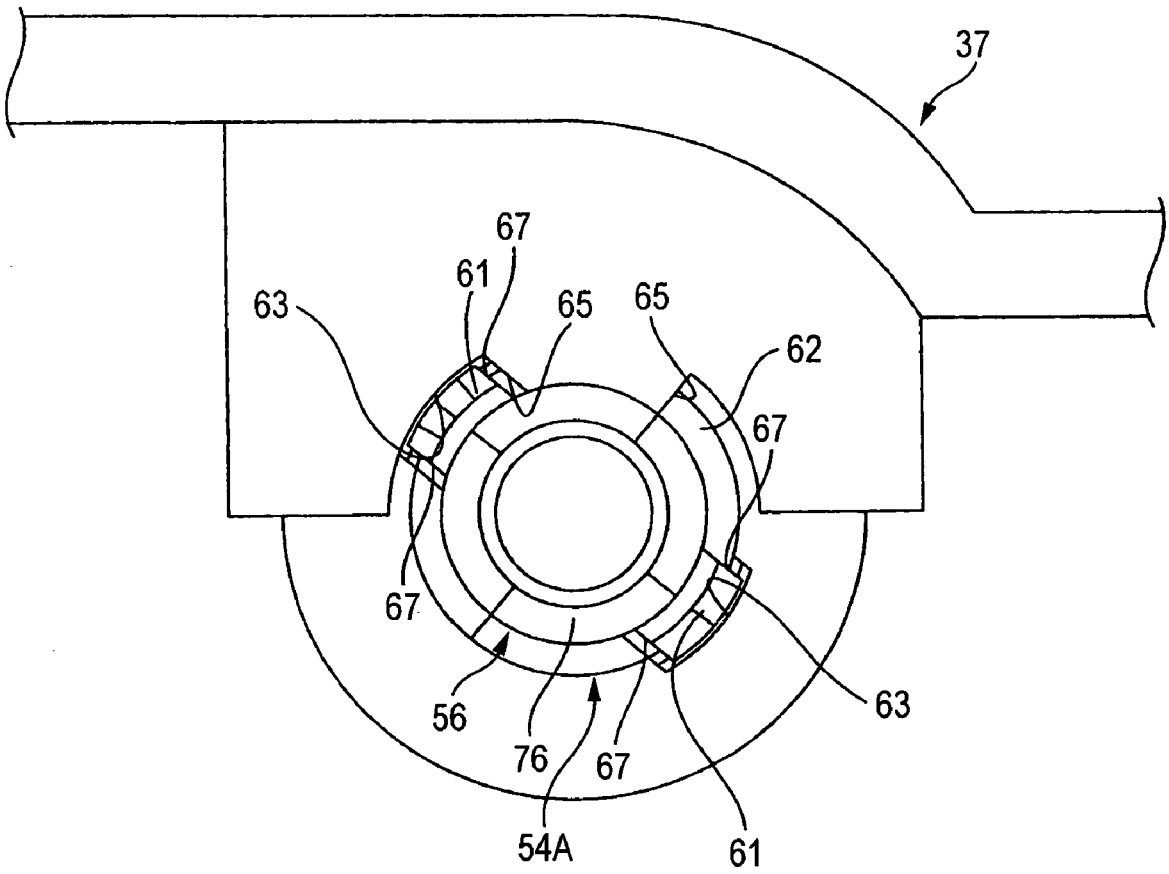
FIG. 34 is a side view showing a state where a first casing of the coupling pin is inserted into a first insertion hole according to the first embodiment of the present invention.
Figure 35A:
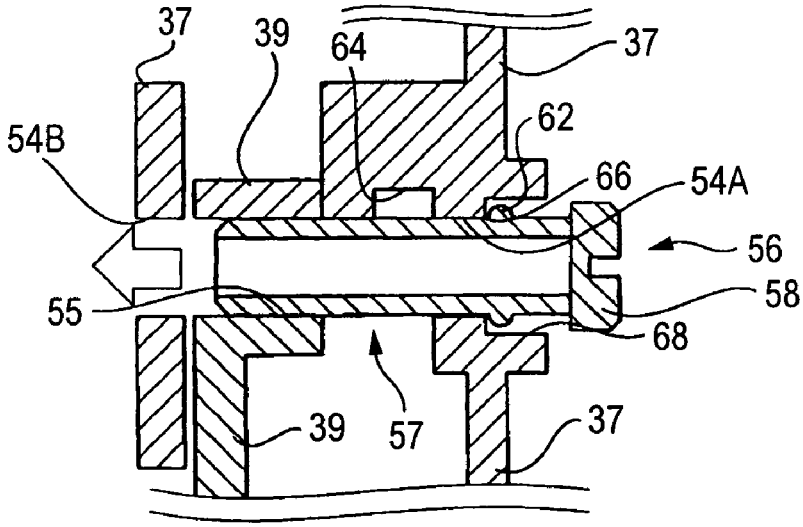
FIGS. 35A and 35B are process views showing a method of assembling the process cartridge according to the first embodiment of the present invention.
Figure 35B:
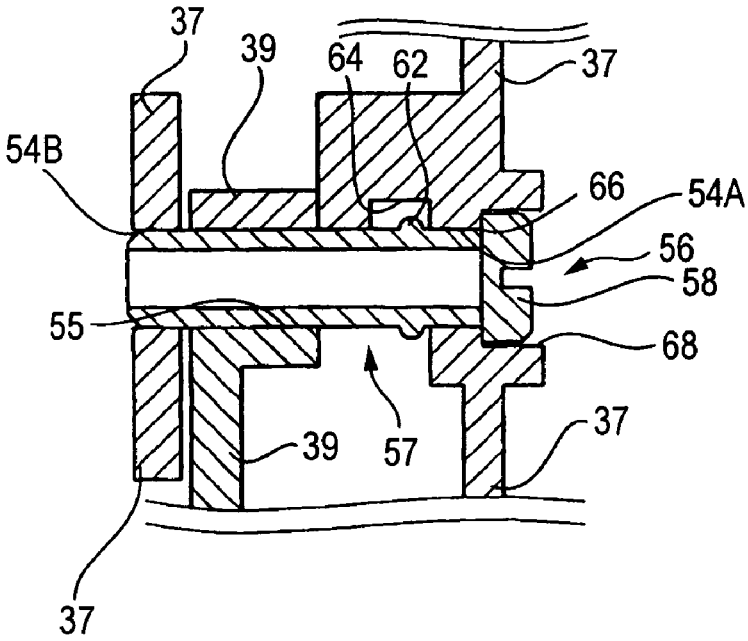

As shown in FIG. 35A, the coupling pin 56 is inserted into the first insertion hole 54A and the second insertion hole 55 from a coupling pin insertion hole 66, and continues to be inserted until reaching a location where the convex portion 62 abuts the coupling pin insertion hole 66. At this time, the coupling pin 56 is not press-fit into the first insertion hole 54A and the second insertion hole 55. Further, the convex portion 62 is elastically deformed by being press-fit from the coupling pin insertion hole 66, and passes through the first insertion hole 54A by widening the first insertion hole 54A of the first casing 37. As shown in FIG. 35B, at a time when the convex portion 62 reaches the concave portion 64, the convex portion 62 returns to its original shape, and is then engaged with the concave portion 64. That is, the convex portion 62 is engaged with the concave portion 64 by snap fitting. In addition, though not shown in FIGS. 35A and 35B, when the convex portion 62 is press-fit into the first insertion hole 54A, the protrusion 61 passes through the extraction portion 63 disposed in the first insertion hole 54A, and then reaches the concave portion 64, as shown in FIG. 33. The coupling pin 56 is then mounted in the first casing 37 and the second casing 39 while the coupling pin 56 couples the first casing 37 and the second casing 39 together. By doing so, the coupling pin 56 is mounted in the first casing 37 and the second casing 39 without being press-fit into them. Accordingly, since no load is applied to the first casing 37 and the second casing 39, there is no possibility that crack occurs.

A process of an embodiment of a method of disassembling the process cartridge 40 using the coupling pin 56 according to the first embodiment will now be described with reference to the accompanying drawings.

Figure 36:
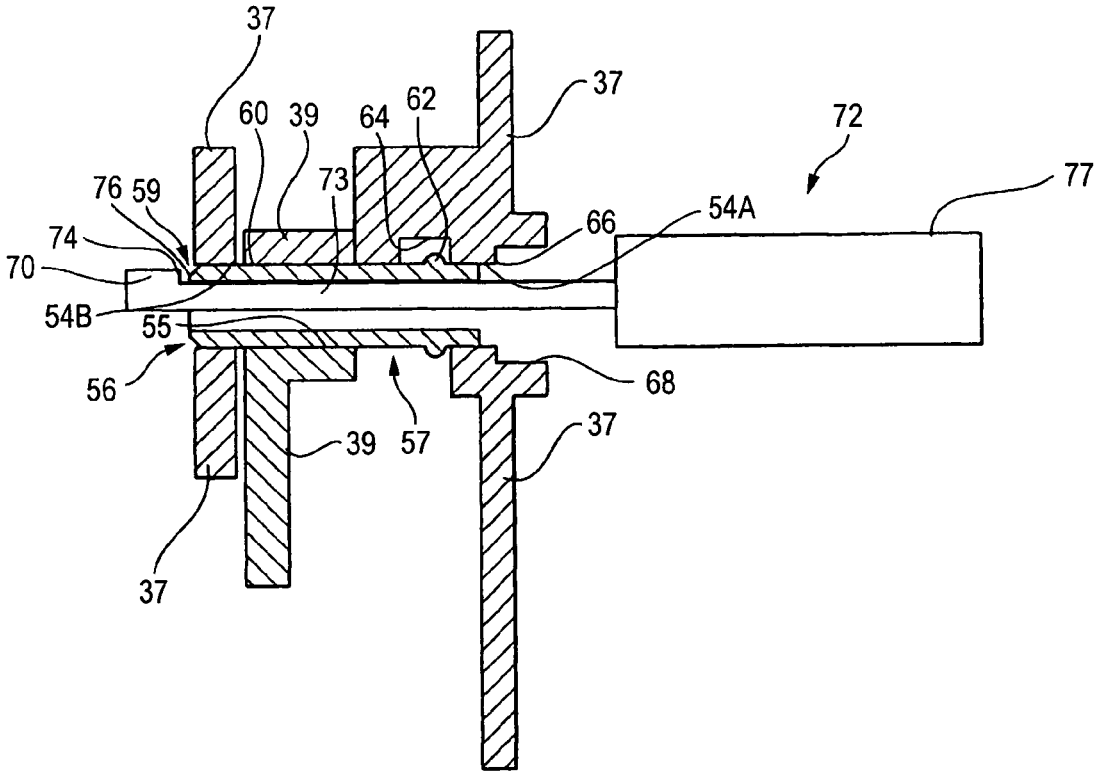
FIG. 36 is a cross-sectional view showing a method of extracting the coupling pin shown in FIGS. 32A to 32E.

For the purpose of disassembling the process cartridge 40 during recycling, etc., in order to extract the coupling pin 56 from the first insertion holes 54A and 54B of the first casing 37 and the second insertion hole 55 of the second casing 39, the head portion 58 is cut off from the coupling pin body 57 with the connection 71 being interposed therebetween, and an insertion portion 73 of a tool 72 is then inserted into a hollow portion of the coupling pin body 57 of the coupling pin 56 using the tool 72 having a hook portion 70 in the insertion portion 73, as shown in FIG. 36. Thus, by pulling the tool 72 in an extraction direction (the right direction in FIG. 36) of the coupling pin body 57, the first casing 37 and the second casing 39, which are coupled together, are separated from each other. A handle portion 77 is also disposed in the tool 72 of FIG. 36, which further facilitates the extraction of the coupling pin body 57.

Figure 37A:
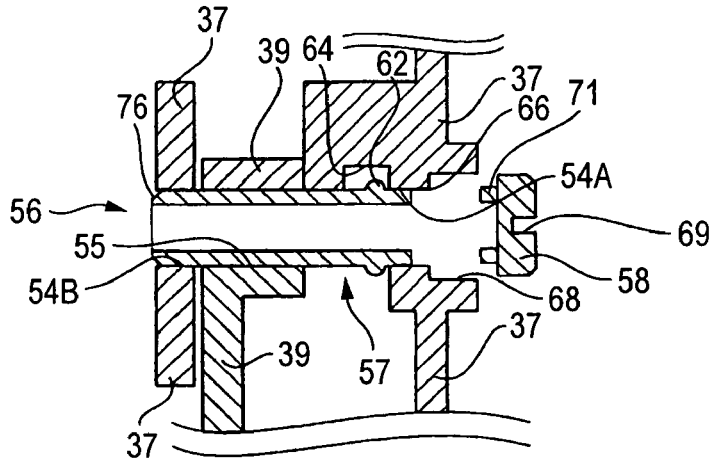
FIGS. 37A to 37C are process views showing the method of assembling the process cartridge according to the first embodiment of the present invention.

To describe in more detail, as shown in FIG., the head portion 58 is rotatably cut by inserting a plus driver or a minus driver into the tool engagement groove 69 of the head portion 58, and the head portion 58 is then cut off from the coupling pin body 57 with the connection 71 being interposed therebetween. At this time, though not shown in FIGS. 37A to 37C, since the coupling pin body 57 is stopped from rotating as the protrusion 61 abuts the anti-rotation portions 65 of the first casing 37 as described above, the coupling pin body 57 does not rotate together with the head portion 58. Accordingly, the head portion 58 is cut off from the coupling pin body 57 with the connection 71 interposed therebetween for connecting the coupling pin body 57 and the head portion 58, so that a hollow coupling pin body 57 appears.

Figure 37B:
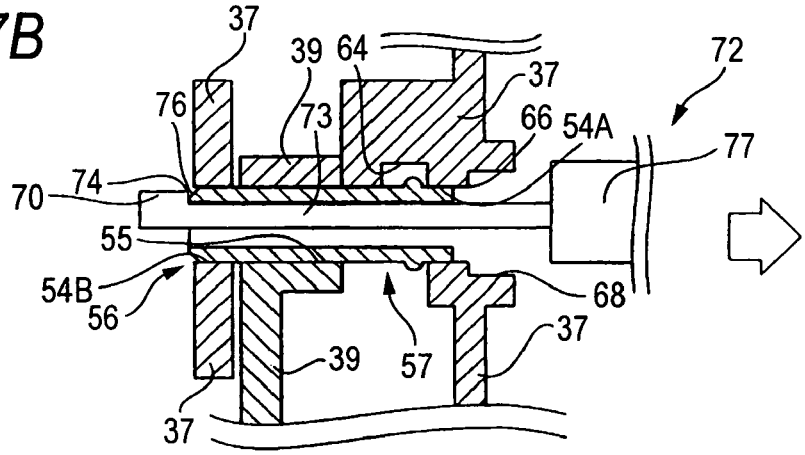

Next, as shown in FIG. 37B, the insertion portion 73 of the tool 72 is inserted into the hollow portion of the coupling pin body 57, and an outer end 74 of the hook portion 70 is made abut the insertion direction front end 76 of the coupling pin body 57, so that the hook portion 70 of the tool 72 is engaged with the coupling pin body 57.

Figure 37C:
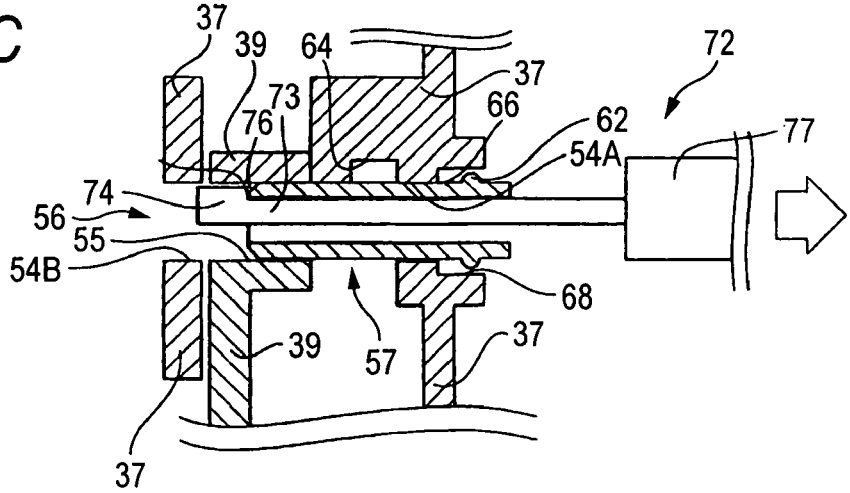

By extracting the coupling pin body 57 in an extraction direction (the right direction in FIGS. 37A to 37C) by the tool 72, the convex portion 62 is elastically deformed. By widening the first insertion hole 54A, the convex portion 62 is press-fit into the first insertion hole 54A, and thus passes through the first insertion hole 54A. Further, when the convex portion 62 is press-fit into the first insertion hole 54A, the protrusion 61 passes through the extraction portion 63 disposed in the first insertion hole 54A. Moreover, as shown in FIG. 37C, at a time when the convex portion 62 reaches the coupling pin head fitting portion 68 outside the first insertion hole 54A, the convex portion 62 that has been elastically deformed and the first insertion hole 54A that has widened return to their original states. Moreover, the entire coupling pin body 57 is separated from the first casing 37 and the second casing 39 by extracting the coupling pin body 57, and the first casing 37 and the second casing 39 can be separated from each other accordingly.

In this way, during recycling, etc., the coupling pin 56 can be easily separated from the first casing 37 and the second casing 39 by extracting the coupling pin 56 by the tool 72, etc. Thus, the efficiency of recycling can be enhanced. Further, the coupling pin 56 cannot be separated from the first casing 37 and the second casing 39 without using a tool. The inside of the coupling pin body is hidden unless the head portion 58 is cut off from the coupling pin body 57, and the coupling pin body 57 cannot be separated accordingly. Thus, it is possible to prevent the first casing 37 and the second casing 39 from being mistakenly separated from each other by a user.

A coupling pin 56 according to a second embodiment of the present invention will be described below.

Further, in the coupling pin 56 of the second embodiment, as shown in FIGS. 38A to 38E and FIGS. 39A to 39E, a portion approximately at the center of the external wall 59 of the coupling pin 56 in an axial direction according to the first embodiment is holed, thus forming an extraction hole 80 for extracting the coupling pin 56 from the first insertion holes 54A and 54B and the second insertion hole 55.

In addition, in the same manner as the coupling pin 56 according to the first embodiment, the coupling pin 56 according to the second embodiment can also be formed using, for example, resin. The convex portion 62 is flexible and elastically deformable and can have any kind of a shape if the coupling-pin 56 is kept from being pulled out. For example, the convex portion 62 can be formed of resin and integrated with other portions of the coupling pin 56. The coupling pin 56 of the present embodiment can have a hollow and approximately cylindrical shape over the entire length in the axial direction in the same manner as the coupling pin 56 of the first embodiment, as shown in the cross sections of FIG. 38B and FIG. 39B. A head portion 58 having an outside diameter greater than other portions is integrally formed with the coupling pin body 57 at the insertion direction rear end of the coupling pin 56. In the coupling pin 56 of the present embodiment, a connection 71 is formed in a slit shape for connecting the coupling pin body 57 and the head portion 58 and facilitating screw-cutting of the head portion 58 at a boundary between the coupling pin body 57 and the head portion 58. In the coupling pin 56, a pair of protrusions 61 is arranged closer at the insertion direction front end 76 than at the convex portion 62 of the outer peripheral side 60 of the coupling pin body 57 for stopping the coupling pin body 57 from rotating. The protrusion 61 can be formed of, for example, resin and integrated with other portions of the coupling pin 56. The protrusion 61 passes through the extraction portion 63 disposed in the first insertion hole 54A of the first casing 37, and then reaches the concave portion 64, as shown in FIGS. 5 and 6. When the head portion 58 is screw-cut, the coupling pin body 57 is stopped from rotating as the side face 67 of the protrusion 61 abuts the anti-rotation portions 65 disposed in the concave portion 64.

Figure 38D:
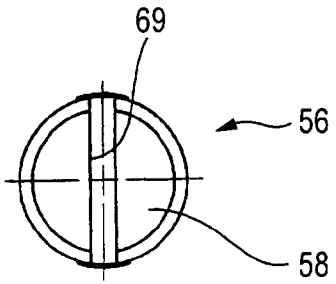
FIGS. 38A to 38E are a side view, a cross-sectional view, a perspective view, a front view and a top view showing the shape of the coupling pin having a straight tool engagement groove according to a second embodiment of the present invention.
Figure 38E:
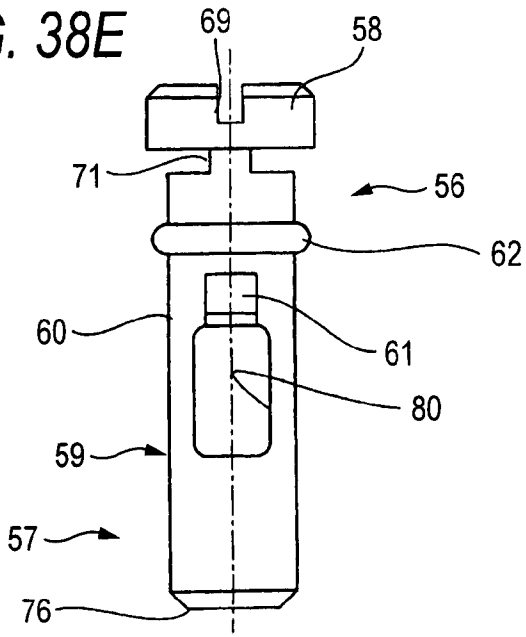
Figure 38A:
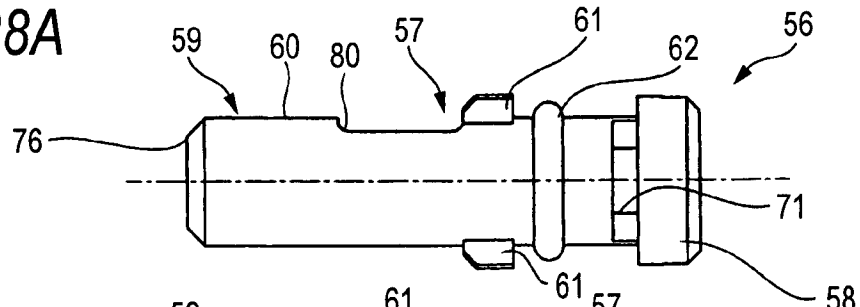
Figure 38B:
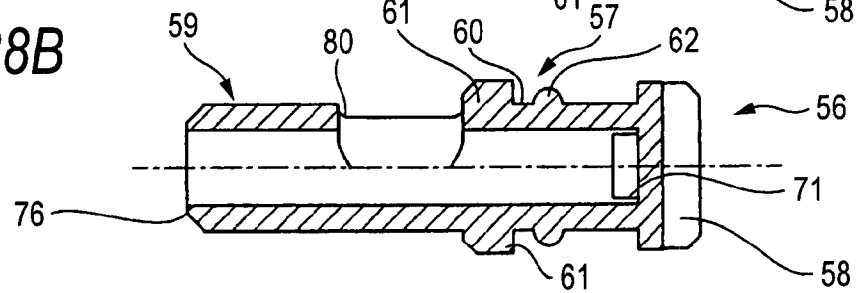
Figure 38C:
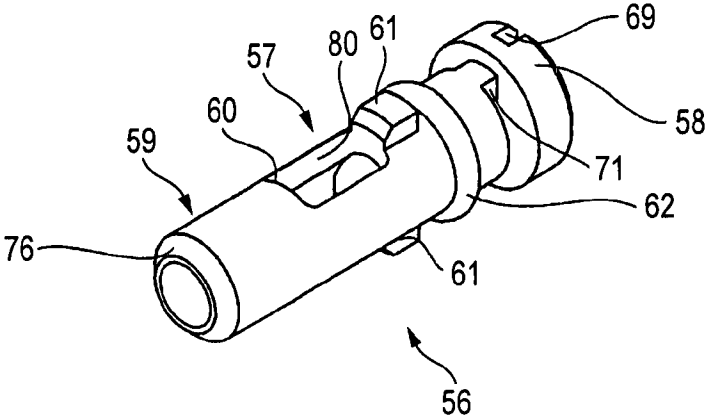
Figure 39D:
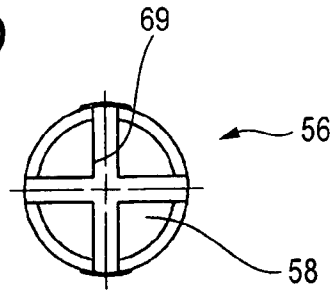
FIGS. 39A to 39E are a side view, a cross-sectional view, a perspective view, a front view and a top view showing the shape of the coupling pin having a tool engagement groove of a cross shape according to the second embodiment of the present invention.
Figure 39E:
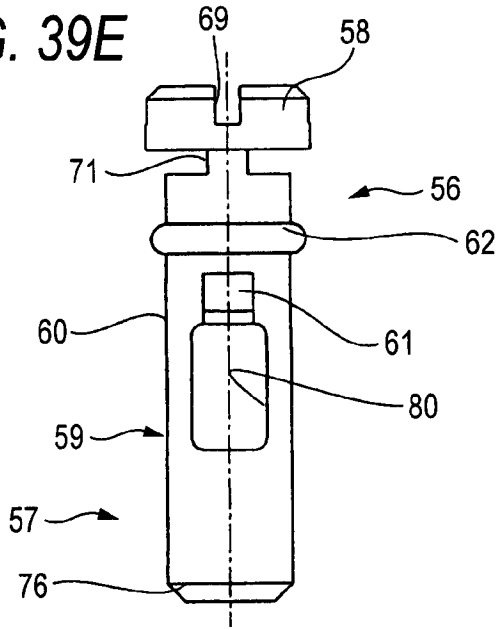
Figure 39A:
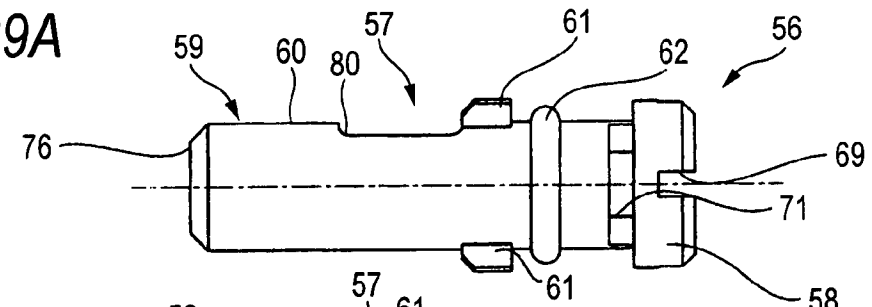
Figure 39B:
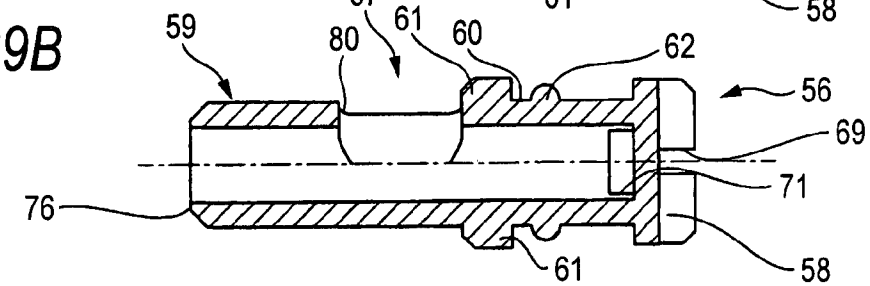
Figure 39C:
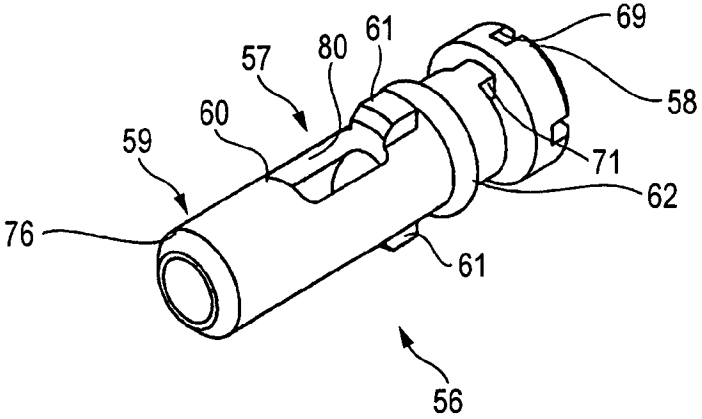

In addition, the tool engagement groove 69 is formed in a straight shape in the head portion 58 of the coupling pin 56 of FIGS. 38A to 38E (refer to FIG. 38D). The head portion 58 can be cut off from the coupling pin body 57 by inserting a minus driver into the tool engagement groove 69 and then rotatably screw-cutting the head portion 58. Meanwhile, the cross shaped tool engagement groove 69 is formed in the head portion 58 of the coupling pin 56 of FIGS. 39A to 39E (refer to FIG. 39D). The head portion 58 can be cut off from the coupling pin body 57 by inserting a plus driver into the tool engagement groove 69 and then screw-cutting the head portion 58.

Figure 40:
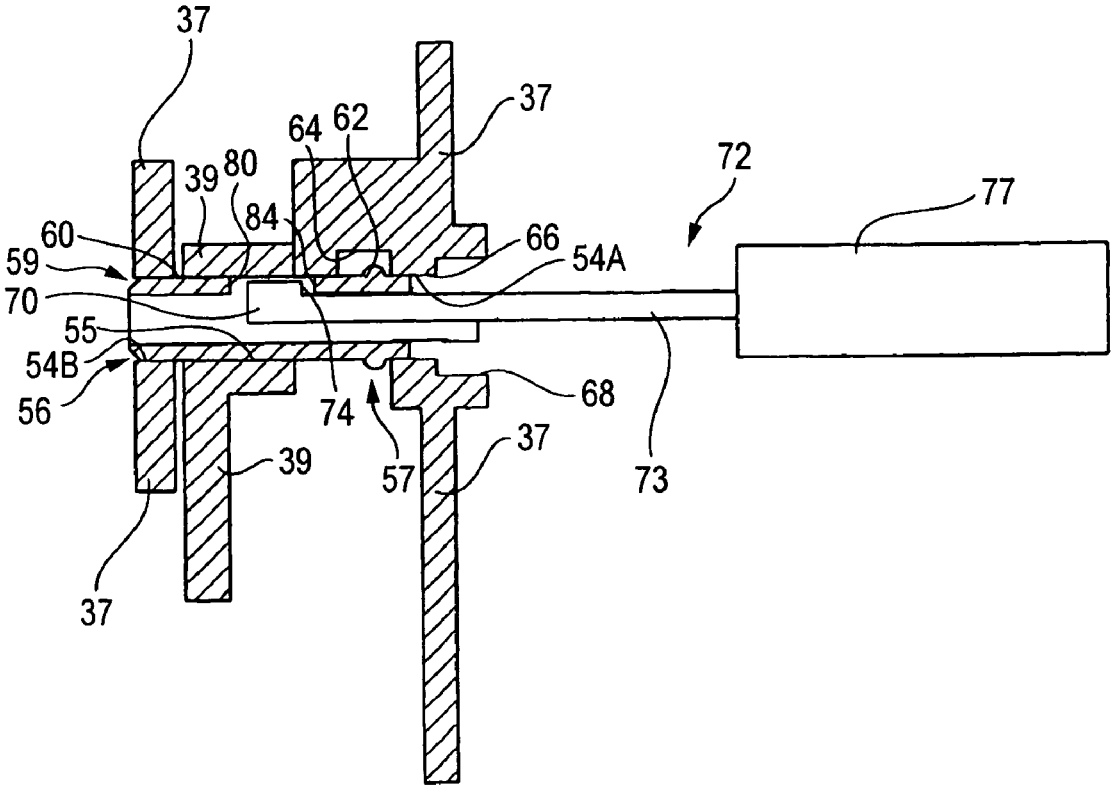
FIG. 40 is a cross-sectional view showing the method of extracting the coupling pin of FIGS. 38A to 38E and 39A to 39E.

In this way, for example, as shown in FIG. 40, after the head portion 58 is cut off from the coupling pin body 57 with the connection 71 interposed therebetween, the hook portion 70 is located at the extraction hole 80 by inserting the insertion portion 73 of the tool 72 into the hollow portion of the coupling pin body 57 using the tool 72 having the insertion portion 73 and the hook portion 70. In this state, by extracting the tool 72 in an extraction direction of the coupling pin body 57 (the right direction in FIG. 40) using the handle portion 77, the outer end 74 of the hook portion 70 is engaged with an edge 84 of the extraction hole 80. Therefore, the convex portion 62 is elastically deformed, the first insertion hole 54A widens, and the convex portion 62 passes through the first insertion hole 54A. As the coupling pin 56 is separated from the first casing 37 and the second casing 39, the first casing 37 and the second casing 39, which are coupled together, are separated from each other.

A process of an embodiment of the method of assembling the process cartridge 40 using the coupling pin 5 according to the second embodiment will now be described with reference to the accompanying drawings.

Figure 41A:
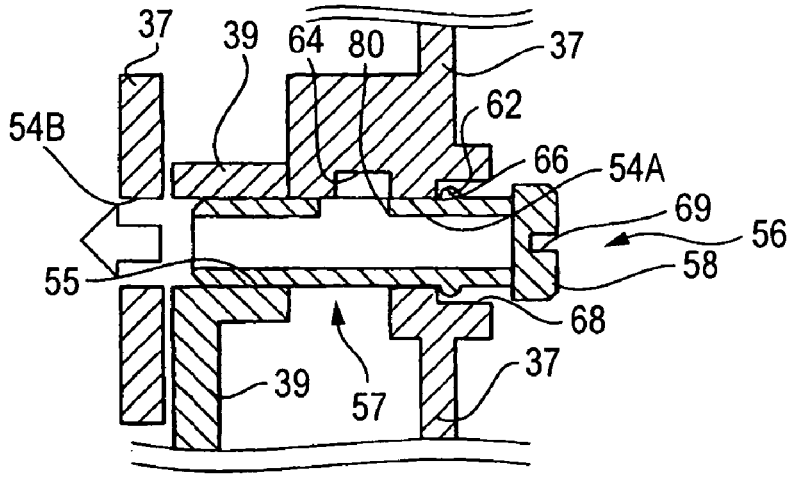
FIGS. 41A and 41B are process views showing the method of assembling the process cartridge according to the second embodiment of the present invention.
Figure 41B:
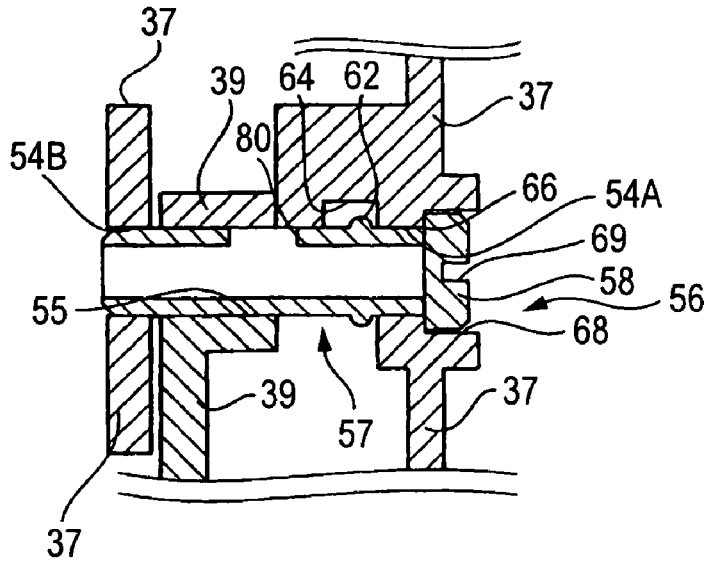

In the same manner as the coupling pin 56 of the first embodiment, as shown in FIG. 41A, the coupling pin 56 is inserted from the coupling pin insertion hole 66 to the first insertion hole 54A and the second insertion hole 55, and continues to be inserted until reaching a location where the convex portion 62 abuts the coupling pin insertion hole 66. At this time, the coupling pin 56 is not press-fit into the first insertion hole 54A and the second insertion hole 55. Further, the convex portion 62 is elastically deformed by being press-fit from the coupling pin insertion hole 66, and passes through the first insertion hole 54A by widening the first insertion hole 54A of the first casing 37. As shown in FIG. 41B, at the time when the convex portion 62 reaches the concave portion 64, the convex portion 62 returns to its original shape, and is then engaged with the concave portion 64. That is, the convex portion 62 is engaged with the concave portion 64 by snap fitting. In addition, though not shown in FIGS. 41A and 41B, when the convex portion 62 is press-fit into the first insertion hole 54A, the protrusion 61 passes through the extraction portion 63 disposed in the first insertion hole 54A, and then reaches the concave portion 64, as shown in FIG. 33. The coupling pin 56 is then mounted in the first casing 37 and the second casing 39 while the coupling pin 56 couples the first casing 37 and the second casing 39 together. By doing so, the coupling pin 56 is mounted in the first casing 37 and the second casing 39 without being press-fit into them. Accordingly, since no load is applied to the first casing 37 and the second casing 39, there is no possibility that crack occurs.

A process of an embodiment of the method of disassembling the process cartridge 40 using the coupling pin 56 according to the second embodiment will now be described with reference to the accompanying drawings.

Figure 42A:
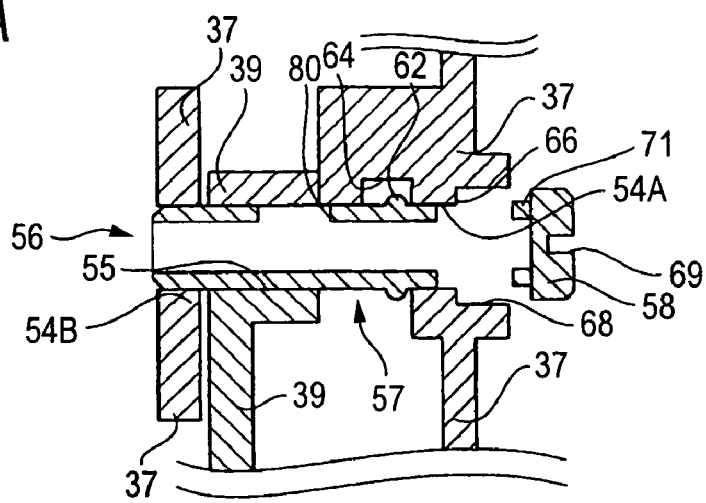
FIGS. 42A to 42C are process views showing a method of disassembling the process cartridge according to the second embodiment of the present invention.

For the purpose of disassembling the process cartridge 40 during recycling, etc., in order to extract the coupling pin 56 of the second embodiment from the first insertion holes 54A and 54B of the first casing 37 and the second insertion hole 55 of the second casing 39, as shown in FIG. 42A, the head portion 58 is rotated with a plus driver or a minus driver being inserted into the tool engagement groove 69 of the head portion 58, thus the head portion 58 is cut off from the coupling pin body 57 with the connection 71 interposed therebetween, whereby a hollow coupling pin body 57 appears. At this time, though not shown in FIGS. 42A to 42C, the coupling pin body 57 is stopped from rotating as the protrusion 61 abuts the anti-rotation portions 65 of the first casing 37. Thus, the coupling pin body 57 does not rotate together with the head portion 58.

Figure 42B:
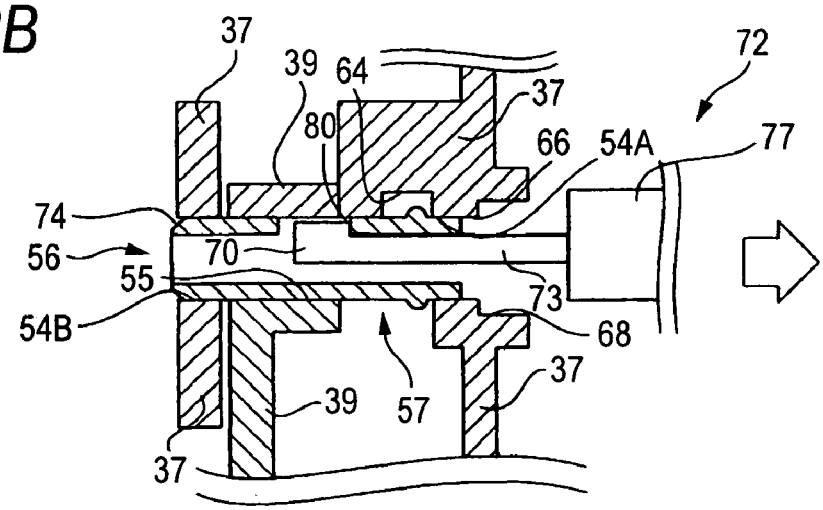

As shown in FIG. 42B, the insertion portion 69 of the tool 72 is inserted into the hollow portion of the coupling pin body 57, and the hook portion 70 is then located in the extraction hole 80. In this state, the outer end 74 of the hook portion 70 is engaged with the edge 84 of the extraction hole 80 (refer to FIG. 40) by extracting the tool 72 in an extraction direction (the right direction in FIGS. 42A to 42C) by the handle portion 77 of the coupling pin 56.

Figure 42C:
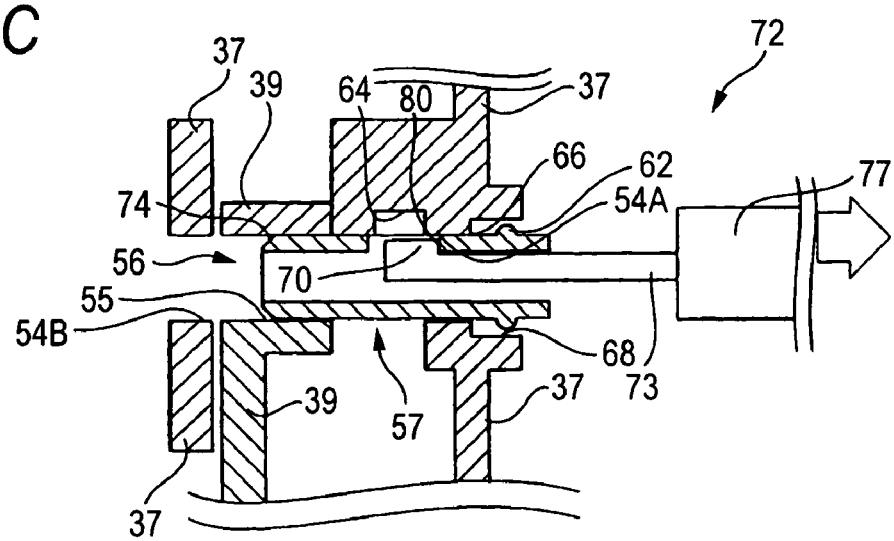
Figure 43D:
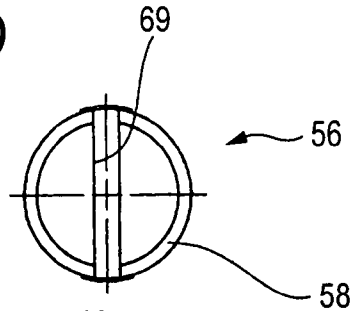
FIGS. 43A to 43E are a side view, a cross-sectional view, a perspective view, a front view and a top view showing the shape of the coupling pin according to a third embodiment of the present invention.
Figure 43E:
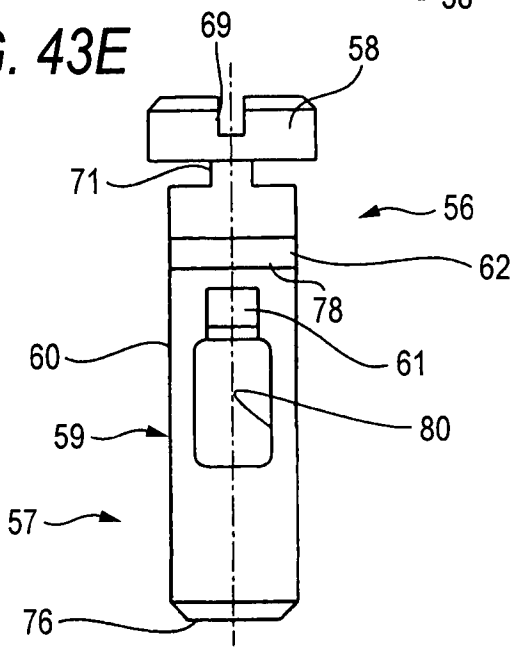
Figure 43A:
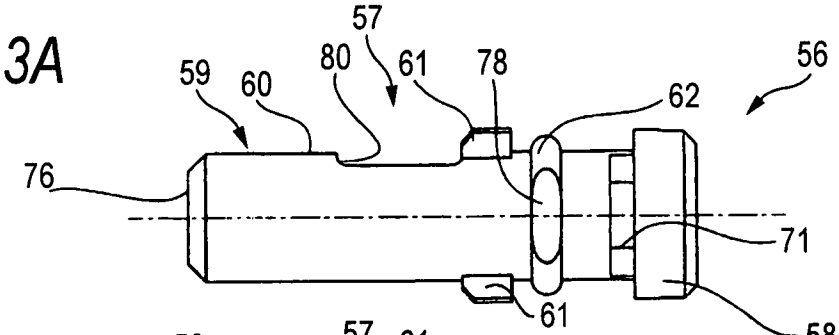
Figure 43B:
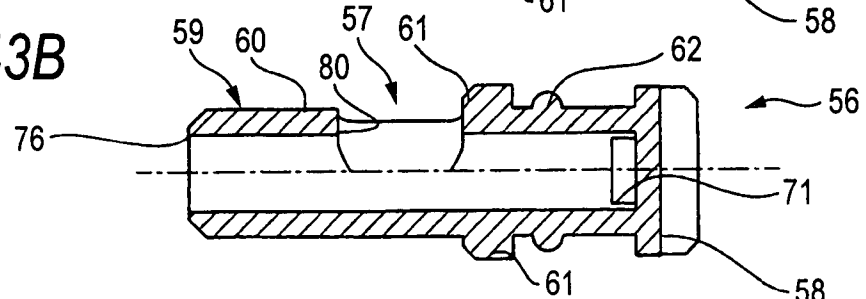
Figure 43C:
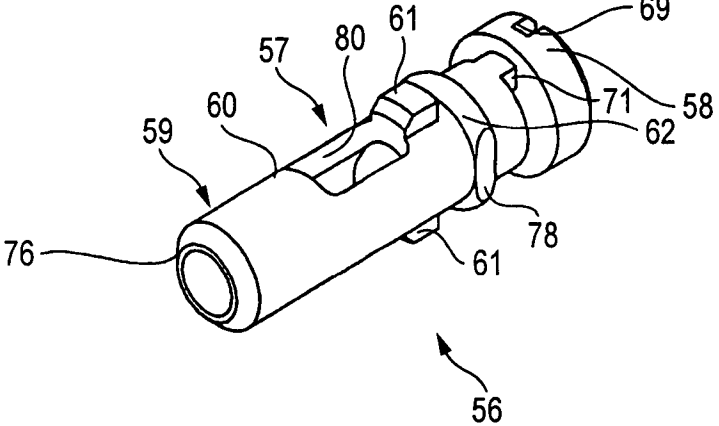
Figure 44D:
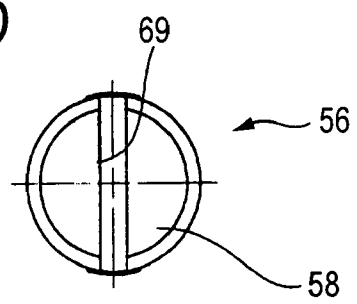
FIGS. 44A to 44E are a side view, a cross-sectional view, a perspective view, a front view and a top view showing the shape of the coupling pin according to a fourth embodiment of the present invention.
Figure 44E:
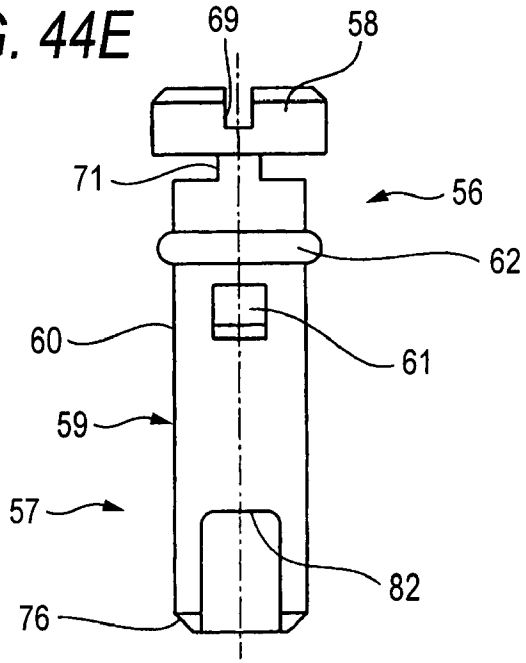
Figure 44A:
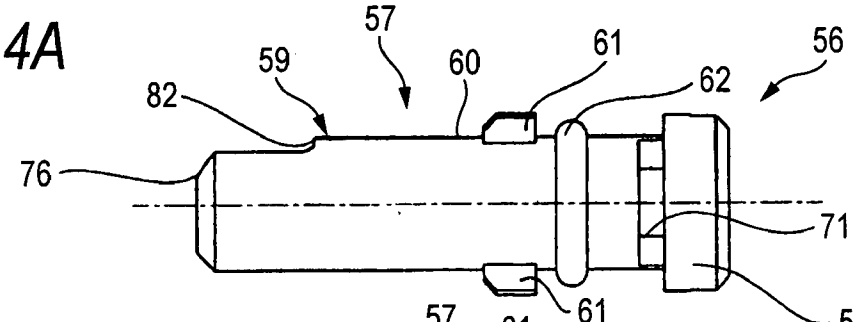
Figure 44B:
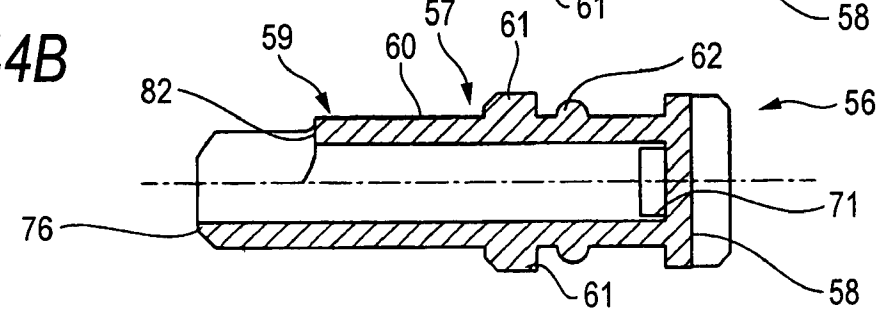
Figure 44C:
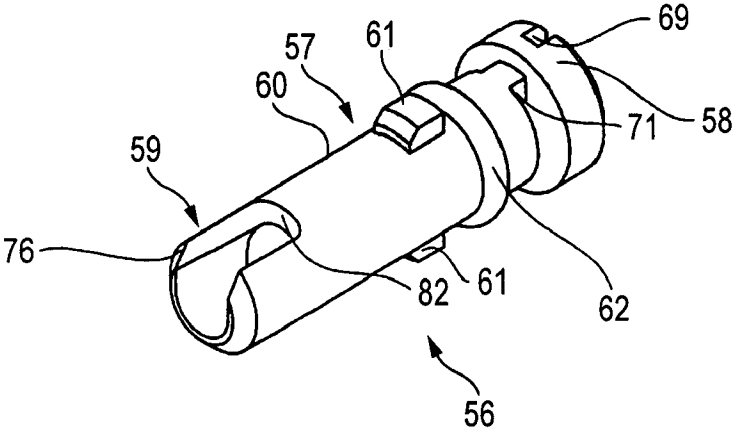

The convex portion 62 is elastically deformed by extracting the coupling pin 56 by the tool 72 in the extraction direction. The convex portion 62 is press-fit into the first insertion hole 54A by widening the first insertion hole 54A, and thus passes through the first insertion hole 54A. Though not shown in FIGS. 42A to 42C, when the convex portion 62 is press-fit into the first insertion hole 54A, the protrusion 61 passes through the extraction portion 63 disposed in the first insertion hole 54A. Moreover, as shown in FIG. 42C, at the time when the convex portion 62 reaches the coupling pin head fitting portion 68 outside the first insertion hole 54A, the convex portion 62 that has been elastically deformed and the first insertion hole 54A that has widened return to their original states. The entire coupling pin body 57 is separated from the first casing 37 and the second casing 39 by extracting the coupling pin body 57 again. The first casing 37 and the second casing 39 can be separated from each other accordingly.

In this way, during recycling, etc., the coupling pin 56 can be easily separated from the first casing 37 and the second casing 39 by extracting the coupling pin 56 using the tool 72, etc. Thus, the efficiency of recycling can be enhanced. Further, the coupling pin 56 cannot be separated from the first casing 37 and the second casing 39 without using a tool. The inside of the coupling pin body is hidden unless the head portion 58 is cut off from the coupling pin body 57, and the coupling pin body 57 cannot be separated accordingly. Thus, it is possible to prevent the first casing 37 and the second casing 39 from being mistakenly separated from each other by a user.

A coupling pin 56 according to a third embodiment will now be described.

In the coupling pin 56 of the first and second embodiments, the convex portion 62 is disposed to go around the outer peripheral side 60 at a predetermined location of the axial direction of the coupling pin 56. In the coupling pin 56 of the third embodiment, however, as shown in FIGS. 43A to 43E, the convex portion 62 is formed on the outer peripheral side 60 of the coupling pin body 57 in a state where a notched portion 78 formed by notching a portion of the hemispherical shaped convex portion is disposed.

In this way, although the convex portion 62 is disposed on a portion of the outer peripheral side 60 without being disposed to go around the outer peripheral side 60 of the coupling pin 56, the coupling pin 56 can be inserted into the first insertion holes 54A and 54B, and the second insertion hole 55 from the coupling pin insertion hole 66 by using elastic deformation of the convex portion 62. In addition, in the coupling pin 56 of FIGS. 43A to 43E, it has been described that the notch portions 78 are located at two symmetrical locations. The notch portion 78 can be located at one location, or three or more locations. Moreover, a plurality of the convex portions 62 having, e.g., a hemispheric shape can be located at plural points in such a way to go around the outer peripheral side 60 at a predetermined location of the axial direction of the coupling pin 56, or the convex portion 62 having shapes other than the hemispherical shape as its cross section can be used.

A process of an embodiment of the method of assembling the process cartridge 40 using the coupling pin 56 according to the third embodiment will now be described with reference to the accompanying drawings.

In the same manner as the coupling pin 56 of the second embodiment, as shown in FIG. 41A, the coupling pin 56 is inserted into the first insertion hole 54A and the second insertion hole 55 from a coupling pin insertion hole 66, and continues to be inserted until reaching a location where the convex portion 62 abuts the coupling pin insertion hole 66. At this time, the coupling pin 56 is not press-fit into the first insertion hole 54A and the second insertion hole 55. Further, the convex portion 62 is elastically deformed by being press-fit from the coupling pin insertion hole 66, and passes through the first insertion hole 54A by widening the first insertion hole 54A of the first casing 37. As shown in FIG. 41B, at the time when the convex portion 62 reaches the concave portion 64, the convex portion 62 returns to its original shape, and is then engaged with the concave portion 64. That is, the convex portion 62 is engaged with the concave portion 64 by snap fitting. In addition, though not shown in FIGS. 41A and 41B, when the convex portion 62 is press-fit into the first insertion hole 54A, the protrusion 61 passes through the extraction portion 63 disposed in the first insertion hole 54A, and then reaches the concave portion 64, as shown in FIG. 33. The coupling pin 56 is then mounted in the first casing 37 and the second casing 39 while the coupling pin 56 couples the first casing 37 and the second casing 39 together. By doing so, the coupling pin 56 is mounted in the first casing 37 and the second casing 39 without being press-fit into them. Accordingly, since no load is applied to the first casing 37 and the second casing 39, there is no possibility that crack occurs.

A process of an embodiment of the method of disassembling the process cartridge 40 using the coupling pin 56 according to the third embodiment will now be described with reference to the accompanying drawings.

For the purpose of disassembling the process cartridge 40 during recycling, etc., in order to extract the coupling pin 56 of the third embodiment from the first insertion holes 54A and 54B of the first casing 37 and the second insertion hole 55 of the second casing 39, the head portion 58 is rotated with a plus driver or a minus driver being inserted into the tool engagement groove 69 of the head portion 58, and the head portion 58 is thus cut off from the coupling pin body 57, as shown in FIG. 42A. At this time, though not shown in FIGS. 42A to 42C, the coupling pin body 57 is stopped from rotating as the protrusion 61 abuts the anti-rotation portions 65 of the first casing 37 as described above. Thus, the coupling pin body 57 does not rotate together with the head portion 58. Accordingly, the head portion 58 is cut off from the coupling pin body 57 with the connection 71, disposed at a connection between the coupling pin body 57 and the head portion 58 of the coupling pin body 57, interposed therebetween, so that the hollow coupling pin body 57 appears.

As shown in FIG. 42B, the insertion portion 69 of the tool 72 is inserted into the hollow portion of the coupling pin body 57, and the hook portion 70 is then located in the extraction hole 80. In this state, the outer end 74 of the hook portion 70 is engaged with the edge 84 of the extraction hole 80 (refer to FIG. 40) by extracting the tool 72 in the extraction direction (the right direction in FIGS. 42A to 42C) of the coupling pin 56 by the handle portion 77.

The convex portion 62 is elastically deformed by extracting the coupling pin 56 in the extraction direction (the right direction in FIGS. 42A to 42C) by the tool 72. The convex portion 62 is press-fit into the first insertion hole 54A by widening the first insertion hole 54A, and thus passes through the first insertion hole 54A. When the convex portion 62 is press-fit into the first insertion hole 54A, the protrusion 61 passes through the extraction portion 63 disposed in the first insertion hole 54A. Moreover, as shown in FIG. 42C, at the time when the convex portion 62 reaches the coupling pin head fitting portion 68 outside the first insertion hole 54A, the convex portion 62 that has been elastically deformed and the first insertion hole 54A that has widened return to their original states. The entire coupling pin body 57 is separated from the first casing 37 and the second casing 39 by extracting the coupling pin body 57 again. The first casing 37 and the second casing 39 can be separated from each other accordingly.

In this way, during recycling, etc., the coupling pin 56 can be easily separated from the first casing 37 and the second casing 39 by extracting the coupling pin 56 by the tool 72, etc. Thus, the efficiency of recycling can be enhanced. Further, the coupling pin 56 cannot be separated from the first casing 37 and the second casing 39 without using a tool. The inside of the coupling pin body is hidden unless the head portion 58 is cut off from the coupling pin body 57, and the coupling pin body 57 cannot be separated accordingly. Thus, it is possible to prevent the first casing 37 and the second casing 39 from being mistakenly separated from each other by a user.

A coupling pin 56 according to a fourth embodiment will now be described.

Figure 45:
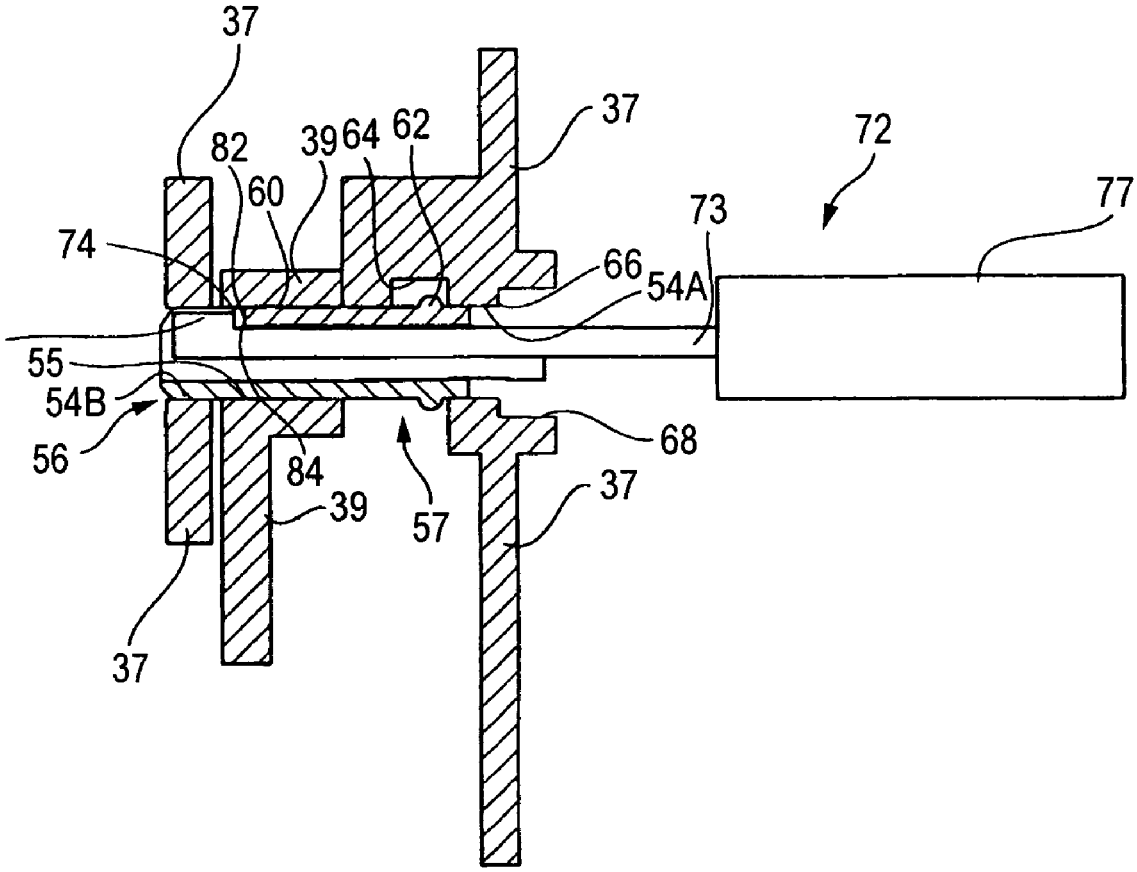
FIG. 45 is a cross-sectional view showing the method of extracting the coupling pin shown in FIGS. 44A to 44E.

In the coupling pin 56 of the fourth embodiment, as shown in FIGS. 44A to 44E, a portion formed by notching a portion of the insertion direction front end 76 of the coupling pin 56 is disposed as a notch groove 82 for extracting the coupling pin 56 from the first insertion holes 54A and 54B, and the second insertion hole 55. By doing so, as shown in the cross section of FIG. 45, for example, the insertion portion 69 of the tool 72 is inserted into the hollow portion of the coupling pin 56 by using the tool 72 having the insertion portion 69 and the hook portion 70, and the hook portion 70 is then located in the notch groove 82. In this state, by extracting the tool 72 in the extraction direction of the coupling pin 56 (the right direction in FIGS. 43A to 43E) by the handle portion 77, the outer end 74 of the hook portion 70 is engaged with the edge 84 of the notch groove 82. Thus, the convex portion 62 is elastically deformed, the first insertion hole 54A widens, and the convex portion 62 passes through the first insertion hole 54A. As the coupling pin 56 is separated from the first casing 37 and the second casing 39, the first casing 37 and the second casing 39, which are coupled together, are separated from each other.

A process of an embodiment of the method of assembling the process cartridge 40 using the coupling pin 56 according to the fourth embodiment will now be described with reference to the accompanying drawings.

Figure 46A:
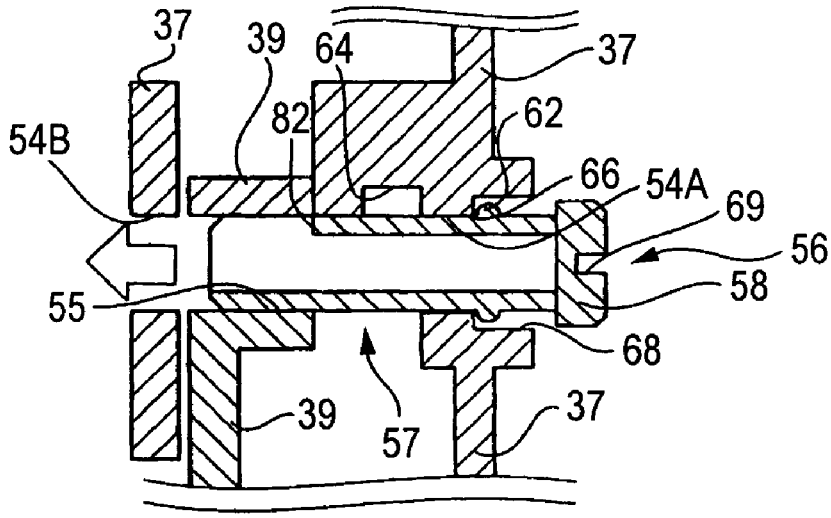
FIGS. 46A and 46B are process views showing the method of assembling the process cartridge according to the fourth embodiment of the present invention.
Figure 46B:
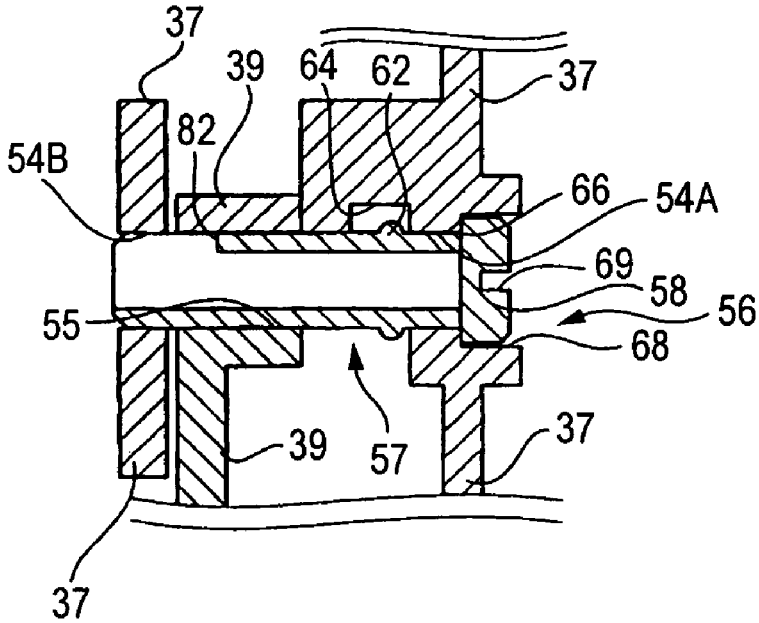

In the same manner as the coupling pin 56 of the second embodiment, as shown in FIG. 46A, the coupling pin 56 is first inserted into the first insertion hole 54A and the second insertion hole 55 from a coupling pin insertion hole 66, and continues to be inserted until reaching a location where the convex portion 62 abuts the coupling pin insertion hole 66. At this time, the coupling pin 56 is not press-fit into the first insertion hole 54A and the second insertion hole 55. Further, the convex portion 62 is elastically deformed by being press-fit from the coupling pin insertion hole 66, and passes through the first insertion hole 54A by widening the first insertion hole 54A of the first casing 37. As shown in FIG. 46B, at the time when the convex portion 62 reaches the concave portion 64, the convex portion 62 returns to its original shape, and is then engaged with the concave portion 64. That is, the convex portion 62 is engaged with the concave portion 64 by snap fitting. In addition, though not shown in FIGS. 46A and 46B, when the convex portion 62 is press-fit into the first insertion hole 54A, the protrusion 61 passes through the extraction portion 63 disposed in the first insertion hole 54A, and then reaches the concave portion 64, as shown in FIG. 33. The coupling pin 56 is then mounted in the first casing 37 and the second casing 39 while the coupling pin 56 couples the first casing 37 and the second casing 39 together. By doing so, the coupling pin 56 is mounted in the first casing 37 and the second casing 39 without being press-fit into them. Accordingly, since no load is applied to the first casing 37 and the second casing 39, there is no possibility that crack occurs.

A process of an embodiment of the method of disassembling the process cartridge 40 using the coupling pin 56 according to the fourth embodiment will now be described with reference to the accompanying drawings.

Figure 47A:
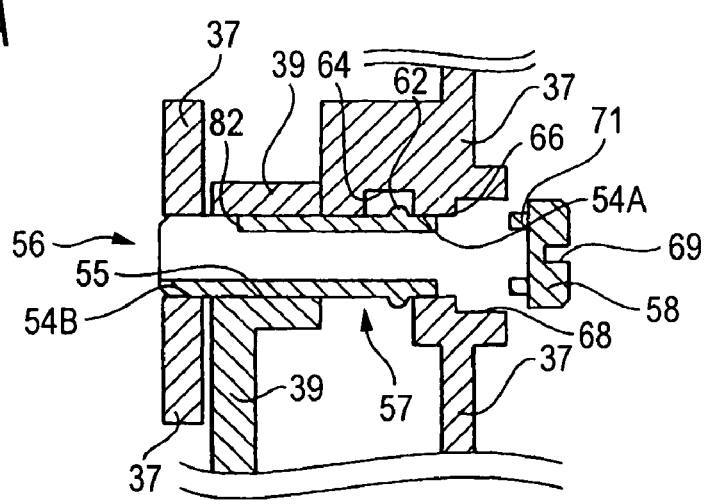
FIGS. 47A to 47C are process views showing the method of disassembling the process cartridge according to a fourth embodiment of the present invention.

For the purpose of disassembling the process cartridge 40 during recycling, etc., in order to extract the coupling pin 56 of the third embodiment from the first insertion holes 54A and 54B of the first casing 37 and the second insertion hole 55 of the second casing 39, the head portion 58 is rotated with a plus driver or a minus driver being inserted into the tool engagement groove 69 of the head portion 58, and the head portion 58 is thus cut off from the coupling pin body 57 with the connection 71 interposed therebetween, as shown in FIG. 47A. At this time, though not shown in FIGS. 47A to 47C, the coupling pin body 57 is stopped from rotating as the protrusion 61 abuts the anti-rotation portions 65 of the first casing 37 as described above. Thus, the coupling pin body 57 does not rotate together with the head portion 58. Accordingly, the head portion 58 is cut off from the coupling pin body 57 with the connection 71, disposed at a connection between the coupling pin body 57 and the head portion 58 of the coupling pin body 57, interposed therebetween, so that the hollow coupling pin body 57 appears.

Figure 47B:
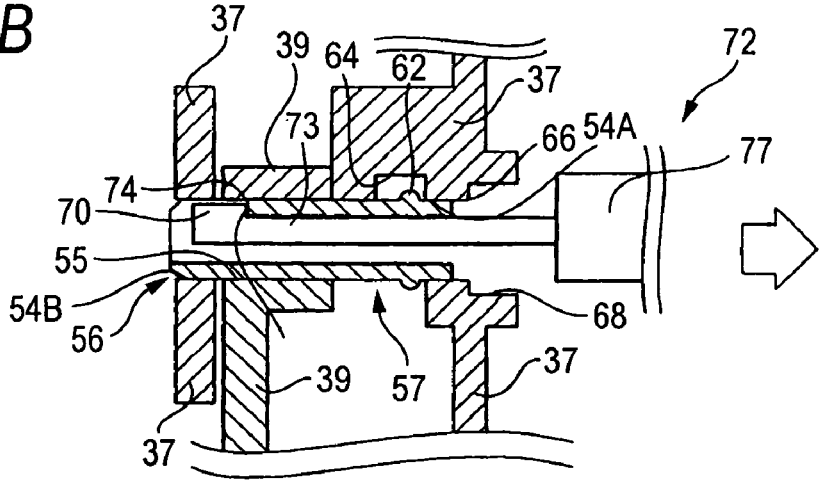

As shown in FIG. 47B, the insertion portion 69 of the tool 72 is inserted into the hollow portion of the coupling pin body 57, and the hook portion 70 is then located in the extraction hole 80. In this state, the outer end 74 of the hook portion 70 is engaged with the edge 84 of the extraction hole 80 (refer to FIGS. 42A to 42C) by extracting the tool 72 in an extraction direction (the right direction in FIGS. 47A to 47C) of the coupling pin 56 by the handle portion 77.

Figure 47C:
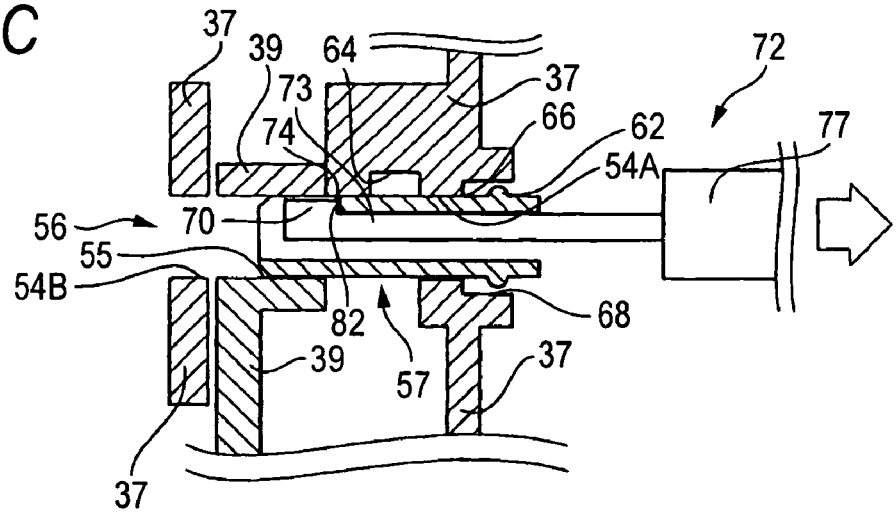
Figure 48:
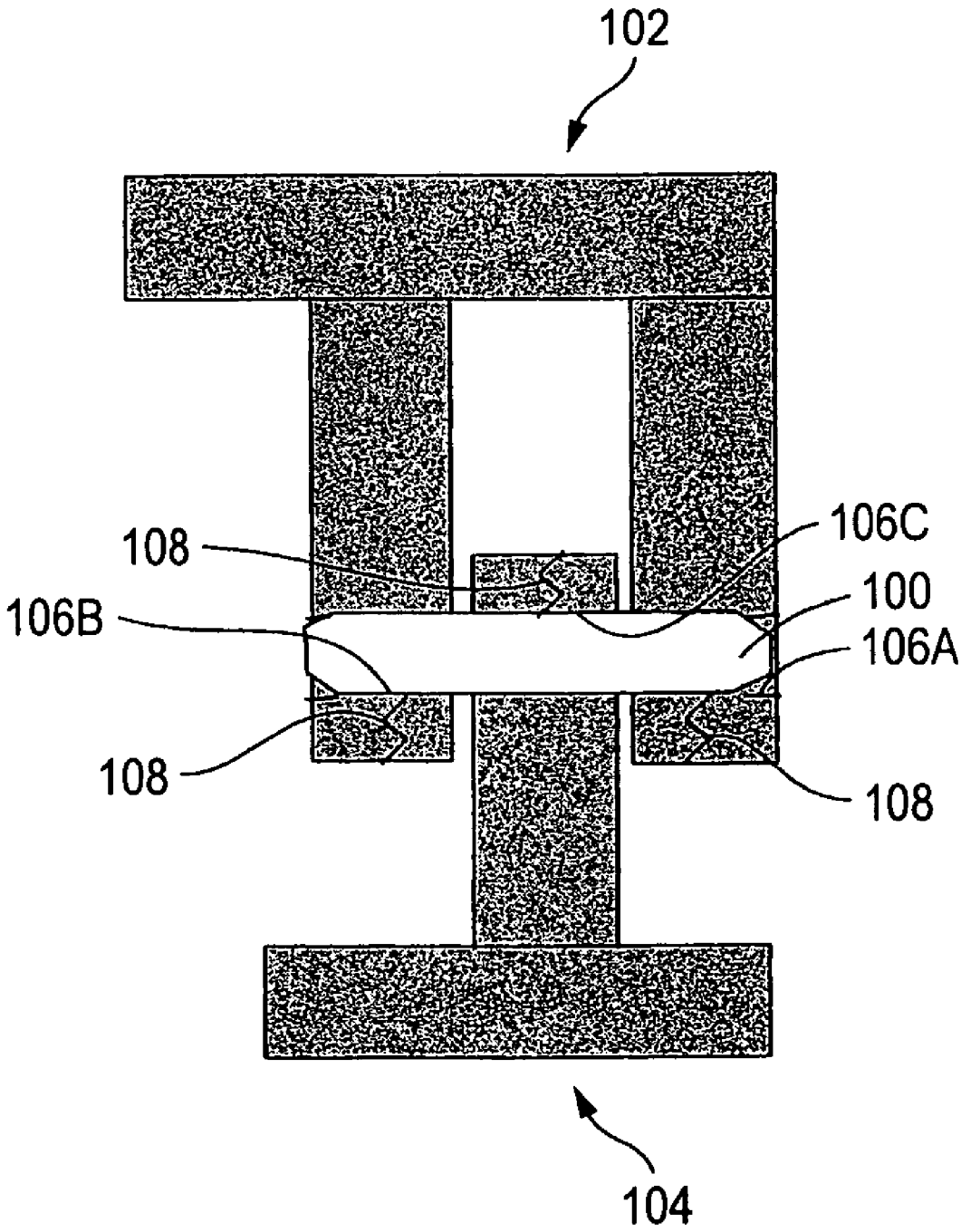
FIG. 48 is a cross-sectional view showing problems of a coupling pin according to the prior art.

The convex portion 62 is elastically deformed by extracting the coupling pin 56 in the extraction direction (the right direction in FIGS. 47A to 47C) by the tool 72. The convex portion 62 is press-fit into the first insertion hole 54A by widening the first insertion hole 54A, and thus passes through the first insertion hole 54A. When the convex portion 62 is press-fit into the first insertion hole 54A, the protrusion 61 passes through the extraction portion 63 disposed in the first insertion hole 54A. Moreover, as shown in FIG. 47C, at the time when the convex portion 62 reaches the coupling pin head fitting portion 68 outside the first insertion hole 54A, the convex portion 62 that has been elastically deformed and the first insertion hole 54A that has widened return to their original states. The entire coupling pin body 57 is separated from the first casing 37 and the second casing 39 by extracting the coupling pin body 57 again. The first casing 37 and the second casing 39 can be separated from each other accordingly.

In this way, during recycling, etc., the coupling pin 56 can be easily separated from the first casing 37 and the second casing 39 by extracting the coupling pin 56 by the tool 72, etc. Thus, the efficiency of recycling can be enhanced. Further, the coupling pin 56 cannot be separated from the first casing 37 and the second casing 39 without using a tool. The inside of the coupling pin body is hidden unless the head portion 58 is cut off from the coupling pin body 57, and the coupling pin body 57 cannot be separated accordingly. Thus, it is possible to prevent the first casing 37 and the second casing 39 from being mistakenly separated from each other by a user.

As described above, according to a process cartridge, and assembling method and disassembling method thereof in accordance with the present invention, abnormalities such as crack, which are caused as a coupling pin is mounted in a first casing and a second casing in a press-fit manner, do not occur, and recycling is also facilitated. It is also possible to prevent the first casing and the second casing from being separated from each other in the case that a coupling pin is mistakenly pulled out by a user.

What is claimed is:

1. A process cartridge that is detachable from an image forming apparatus body, comprising:

an image carrier;

a developing device;

a first casing for supporting at least the image carrier; and a second casing for supporting at least the developing device, wherein the first casing and the second casing are freely combined in a rotatable manner as a coupling pin is inserted into a first insertion hole formed in the first casing and a second insertion hole formed in the second casing, and an engaging means that engages the coupling pin with at least one of the first insertion holes and the second insertion hole by snap-fitting is disposed in the first casing or the second casing and in the coupling pin;

wherein one of:

the engaging means has a convex portion disposed in the coupling pin that extends around at least a majority of an external wall of the coupling pin, and a concave portion disposed in the first casing or the second casing; and the engaging means has a concave portion disposed in the coupling pin that extends around at least the majority of the external wall of the coupling pin, and a convex portion disposed in the first casing or the second casing.

2. The process cartridge according to claim 1, wherein at least a portion of the coupling pin is partially hollow in its axial direction.

3. The process cartridge according to claim 2, wherein an extraction hole for extracting the coupling pin is formed at the portion of the coupling pin.

4. The process cartridge according to claim 2, wherein a notch groove for extracting the coupling pin is formed at a front end of the coupling pin in an insertion direction.

5. The process cartridge according to claim 2, wherein a wall is formed at a portion of a hollow portion of the coupling pin in its axial direction.

6. The process cartridge according to claim 2, wherein a core is slightly press-fit into the hollow portion of the coupling pin.

7. A process cartridge that is detachable from an image forming apparatus body, comprising:

an image carrier;

a developing device;

a first casing for supporting at least the image carrier; and a second casing for supporting at least the developing device, wherein the first casing and the second casing are rotatably coupled as a coupling pin is inserted into first insertion holes formed in the first casing and a second insertion hole formed in the second casing, an engaging means for engaging the coupling pin with at least one of the first insertion holes and the second insertion hole by snap-fitting is disposed in at least one of the first casing and the second casing, and in the coupling pin, and the coupling pin has a head portion capable of being cut off;

wherein one of:

the engaging means has a convex portion disposed in the coupling pin that extends around at least a majority of an external wall of the coupling pin, and a concave portion disposed in at least one of the first casing and the second casing, and the engaging means has the concave portion disposed in the coupling pin that extends around at least the majority of the external wall of the coupling pin, and the convex portion disposed in at least one of the first casing and the second casing.

8. The process cartridge according to claim 7, wherein the coupling pin includes a coupling pin body extending in an axial direction, the head portion, and connection for connecting the coupling pin body and the head portion, and wherein the head portion capable of being cut off from the coupling pin body is formed with the connection disposed therebetween.

9. The process cartridge according to claim 8, wherein at least a portion of the coupling pin body is hollow, and a tool can be inserted into the coupling pin body.

10. The process cartridge according to claim 9, wherein an extraction hole for extracting the coupling pin is formed at a portion of the coupling pin.

11. The process cartridge according to claim 9, wherein a notch groove for extracting the coupling pin is formed at a front end portion of the coupling pin in its insertion direction.

12. The process cartridge according to claim 7, wherein the coupling pin includes a pair of protrusions, and anti-rotation portions for hindering the coupling pin from rotating as the protrusions abut the first casing or the second casing.

13. The process cartridge according to claim 7, wherein a tool engagement groove for rotating the head portion is disposed at the head portion of the coupling pin.

14. The process cartridge according to claim 1, wherein the engaging means has the convex portion disposed in the coupling pin, and the concave portion disposed in the first casing or the second casing.

15. The process cartridge according to claim 1, wherein each of the first casing and the second casing are freely rotatable around the coupling pin.

16. The process cartridge according to claim 7, wherein each of the first casing and the second casing are freely rotatable around the coupling pin.

* * * * *